US012595663B2

(12) United States Patent
Freeman

(10) Patent No.: US 12,595,663 B2
(45) Date of Patent: Apr. 7, 2026

(54) PREFABRICATED FRAMES FOR MASONRY SLIPS

(71) Applicant: ACS Stainless Steel Fixings Limited, Leeds (GB)

(72) Inventor: Matthew Freeman, Leeds (GB)

(73) Assignee: ACS Stainless Steel Fixings Limited, Leeds (GB)

( * ) Notice: Subject to any disclaimer, the term of this patent is extended or adjusted under 35 U.S.C. 154(b) by 187 days.

(21) Appl. No.: 17/597,539

(22) PCT Filed: Jul. 13, 2020

(86) PCT No.: PCT/EP2020/069802

§ 371 (c)(1),
(2) Date: Jan. 11, 2022

(87) PCT Pub. No.: WO2021/005245

PCT Pub. Date: Jan. 14, 2021

(65) Prior Publication Data

US 2022/0243481 A1 Aug. 4, 2022

(30) Foreign Application Priority Data

| | | |
|---|---|---|
| Jul. 11, 2019 | (GB) | 1909988 |
| Dec. 23, 2019 | (GB) | 1919159 |
| Jun. 11, 2020 | (GB) | 2008847 |

(51) Int. Cl.

| | |
|---|---|
| ***E04F 13/08*** | (2006.01) |
| ***E04B 1/41*** | (2006.01) |
| ***E04C 2/00*** | (2006.01) |
| ***E04C 2/04*** | (2006.01) |
| ***E04F 13/14*** | (2006.01) |

(52) U.S. Cl.
CPC ..... *E04F 13/0862* (2013.01); *E04F 13/0803* (2013.01); *E04B 1/4178* (2013.01); (Continued)

(58) Field of Classification Search
CPC ..... E04F 13/0862; E04F 13/0803; E04F 13/0826; E04F 13/142; E04F 13/144; (Continued)

(56) References Cited

U.S. PATENT DOCUMENTS 1,888,611 A * 11/1932 Wolfson ..... E04F 15/04 52/512
2,245,785 A * 6/1941 Jentzer, Jr. ..... E04F 13/0803 52/506.08

(Continued)

FOREIGN PATENT DOCUMENTS

GB 2231890 A * 11/1990 ..... E04F 13/0862
JP 2004324119 A * 11/2004

*Primary Examiner* — Omar F Hijaz
(74) *Attorney, Agent, or Firm* — Woodard, Emhardt, Henry, Reeves & Wagner, LLP

(57) ABSTRACT

The present disclosure relates to a system of providing a façade wall for a building. In particular, the disclosure presents a series of frames and frameworks which are adapted to integrate with a number of different designs of masonry slips. These masonry slips are parts of bricks, or other building items and the like, which by means of appropriately placed slots can integrate and be held by lips and extensions on the frames. Corner units, soffit panelling and free standing archways are also possible by appropriate combination of the concepts described herein.

20 Claims, 52 Drawing Sheets

(52) U.S. Cl.
CPC ..... *E04C 2002/007* (2013.01); *E04C 2/041* (2013.01); *E04F 13/14* (2013.01); *E04F 13/142* (2013.01)

(58) Field of Classification Search
CPC ... E04F 13/0857; E04F 13/14; E04F 13/0846; E04F 13/083; E04C 2002/007; E04C 2/041; E04B 1/4178; E04D 13/158
See application file for complete search history.

(56) References Cited

U.S. PATENT DOCUMENTS

| | | | | | |
|---|---|---|---|---|---|
| 2,292,984 | A * | 8/1942 | Alvarez, Jr. | E04F 13/0803 | 52/471 |
| 3,005,293 | A * | 10/1961 | Hunter | E04F 13/0826 | 52/510 |
| 3,754,365 | A * | 8/1973 | Carrick | E04F 13/0835 | 52/471 |
| 4,987,712 | A * | 1/1991 | Mancuso | E04F 13/0862 | 52/387 |
| 6,421,974 | B1 * | 7/2002 | Whitehouse | E04F 13/147 | 52/510 |
| 7,010,894 | B1 * | 3/2006 | Cappelle | E04F 13/0826 | 52/489.1 |
| 8,782,988 | B2 * | 7/2014 | Wolf | B29C 39/36 | 52/526 |
| 2007/0151190 | A1 * | 7/2007 | Huff | E04F 13/0846 | 52/592.5 |
| 2018/0209154 | A1 * | 7/2018 | Ausseur | E04F 13/072 | |

* cited by examiner

PREFABRICATED FRAMES FOR MASONRY SLIPS

The present invention relates to a masonry panel for a building structure, in particular a masonry panel for use as part of the façade of a building.

BACKGROUND TO THE INVENTION

Modern building techniques make use of prefabricated components that are used to speed up and simplify the erection of building structures. Many buildings are constructed with an inner substructure that is provided with a decorative masonry façade that is secured to the substructure by various means. The masonry façade provides an attractive external appearance for the building but does not form part of the load-bearing substructure. It is therefore suitable for prefabrication and, as it is not load bearing, complex masonry patterns can be employed in its construction as specified by an architect that would otherwise be difficult to execute directly on site or not be possible if load-bearing considerations needed to be taken into account.

Conventionally, such prefabricated façade panels are constructed using several known systems. Some are produced by an adhesive-based system wherein thin brick slips are bonded to a rigid, supporting back panel by adhesives, such as a polymer adhesive mortar. Others use mechanical ties or clips to secure brick slips to a back panel. Both of these systems have disadvantages. Some adhesive-based systems are prone to failure, particularly in climates with widely varying temperatures as this can weaken the bond between the slips and the back panel with the result that brick slips can become loose and fall off. This is a totally unacceptable and dangerous situation. For this reason, systems using mechanical ties or clips are preferred. However, these systems have the disadvantage that the prefabricated panels have to be tailored exactly to the position where they are to be employed as they cannot be adjusted once manufactured. This means that should unforeseen events happen during construction of a building, the prefabricated panels made for it may no longer fit or be appropriate to the position for which they were made. This can increase the cost of the building and delay its construction.

In both cases, the prefabricated panels tend to be heavy and difficult to transport during which damage may occur to the slips, which can mar the appearance of the panel and mean that it cannot be used without replacement of the damaged slips, which may not be possible.

It is an object of the present invention to overcome or substantially mitigate the aforementioned disadvantages.

According to a first aspect of the present invention there is provided frame for retaining one or more masonry slips, the one or more masonry slips each having two slots formed on two sides thereof respectively, the frame comprising: an elongate channel structure comprising a back plate with two extensions extending away from the back plate, to thereby form the channel, two lips extend from distal edges of the two extensions configured so as to engage with each of the two slots on the one or more masonry slips respectively when said one or more masonry slips are present, so as to thereby hold the one or more masonry slips within the elongate channel when said one or more masonry slips are present, wherein a first of the two lips has a straight portion which extends substantially parallel to the back plate and an angled end portion at the end of the straight portion which projects in the direction away from the back plate, thereby making an angle with the straight portion.

The masonry panel of the present invention has been designed so that it can either be prefabricated or at least partially constructed on-site. In particular, it is possible to secure the slips to the elongate members after the panel has been secured to the substructure of a building. This makes fitment of the panel easier as it reduces the weight of the panel during transportation and securement to the substructure and ensures that damage to the slips does not occur during these processes.

It will be appreciated that after securement of the masonry panel to a building substructure and location of the slips therein the panel is pointed so that the panel appears as an unbroken part of adjoining masonry and to hide all parts of the masonry panel other than the outer surface of the slips.

According to a second aspect of the present invention there is provided a masonry framework for a building structure comprising one or more frames for holding masonry slips, the frames being attached to a supporting structure in a side-by-side relationship so that their channels lie parallel with each other.

According to a third aspect a masonry framework is provided comprising one or more frames for retaining one or more masonry slips, the one or more masonry slips each having two slots formed on two sides thereof respectively, the frame comprising an elongate channel structure comprising a back plate with two extensions extending away from the back plate to thereby form the channel, two lips extending from distal edges of the two extensions configured so as to engage with each of the two slots on the one or more masonry slips respectively when said one or more masonry slips are present, so as to thereby hold the one or more masonry slips within the elongate channel when said one or more masonry slips are present. According to a fourth aspect, a support system adapted to support one or more bricks, stones or other masonry items of a wall which will be positioned above the support system when in use is provided, the support system comprising: means for supporting the one or more bricks, stones or other masonry items of the wall in a load bearing manner; and a carrier which is adapted to carry one or more angled masonry slips such that they will be at a location beneath the one or more bricks, stones or other masonry items of the wall.

Other preferred but non-essential features of the present invention are described in the dependent claims appended hereto.

DESCRIPTION OF THE FIGURES

The present invention will now be described by way of example with reference to the accompanying drawings, in which:—

DESCRIPTION OF THE INVENTION

Figure 1:
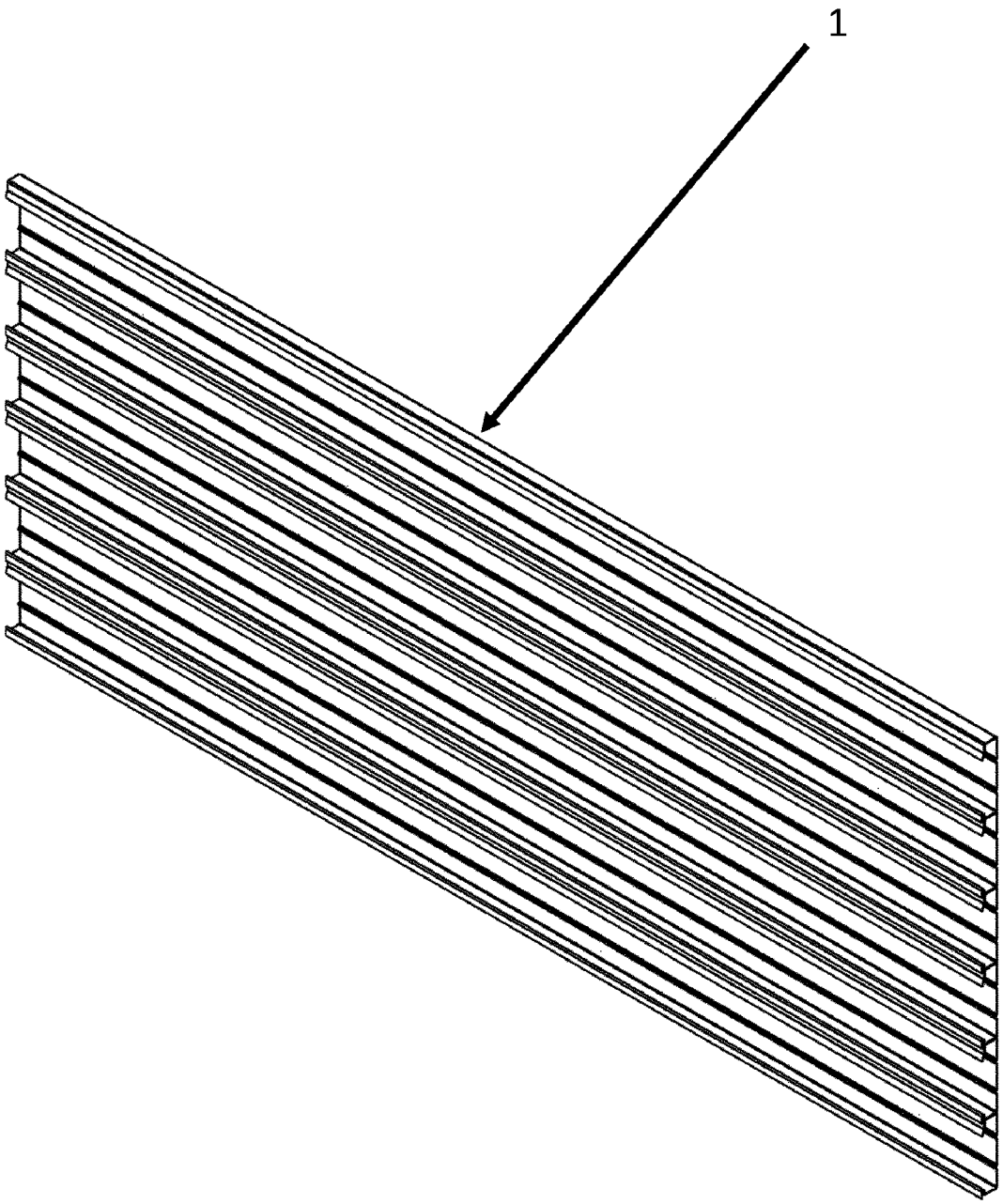
FIG. 1 is a perspective front view of a masonry framework of the present disclosure.
Figure 2:
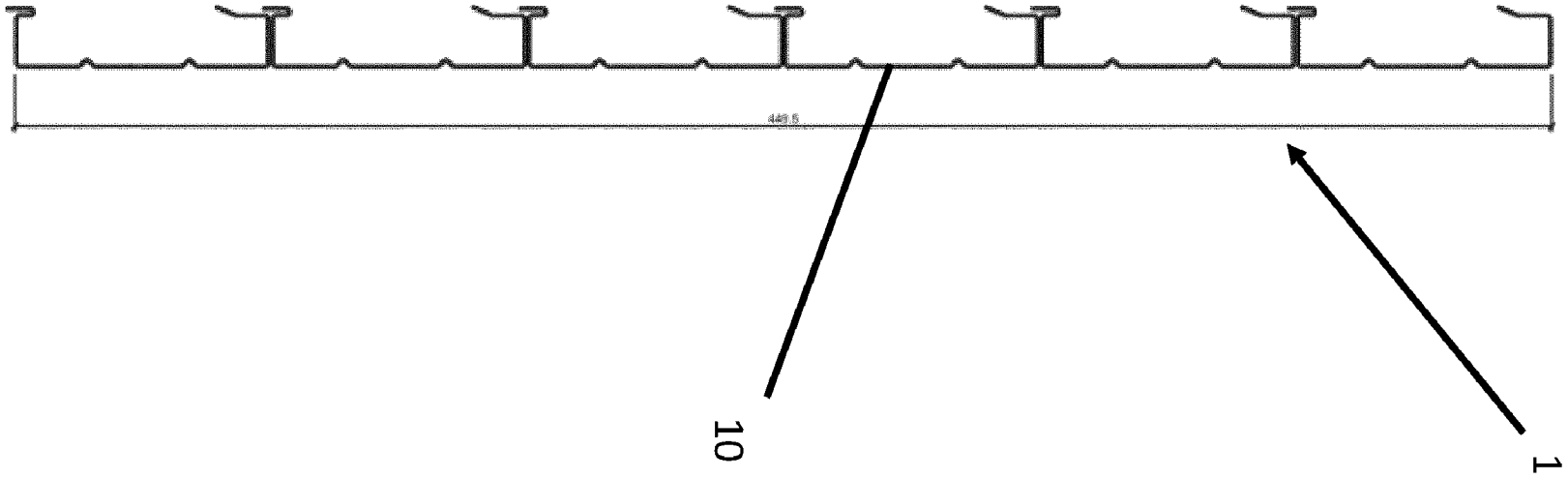
FIG. 2 is a cross-sectional view of the masonry framework in FIG. 1
Figure 3:
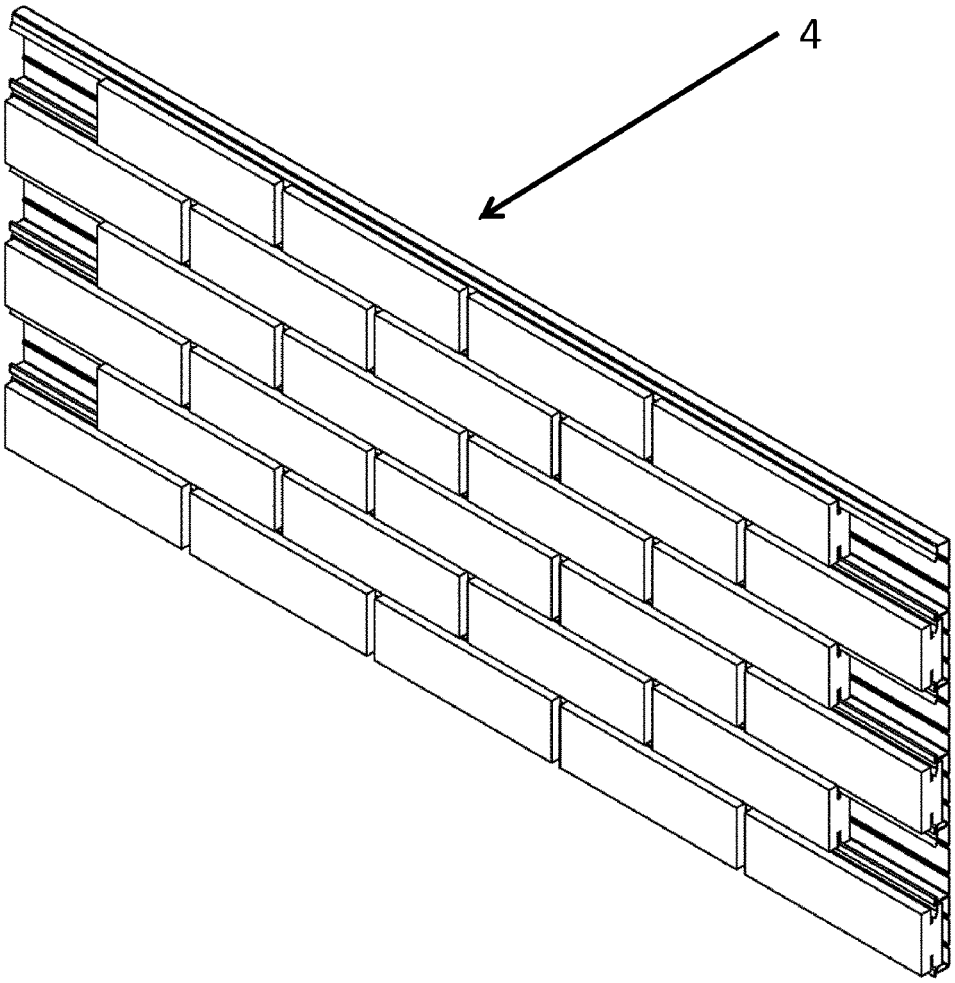
FIG. 3 shows a masonry framework of FIGS. 1 and 2 with masonry slips therein
Figure 4A:
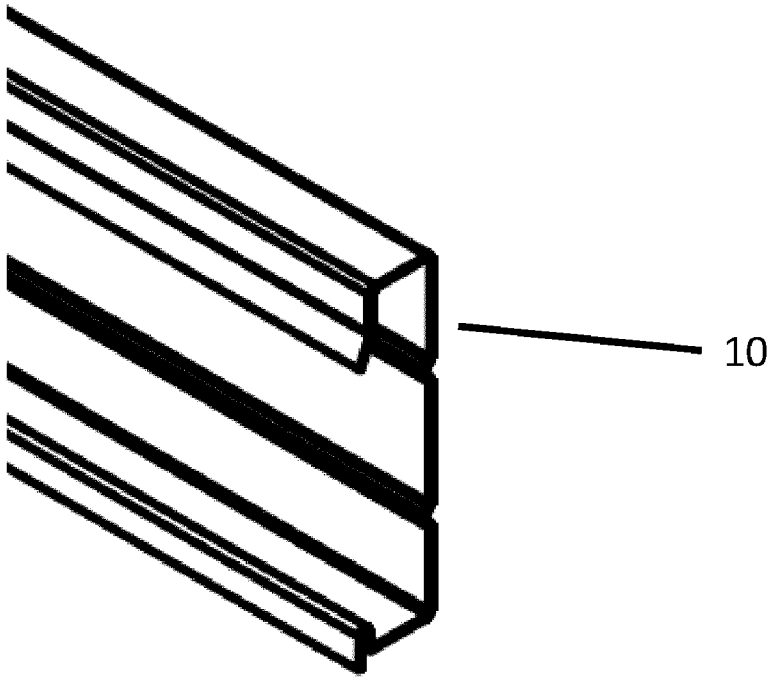
FIG. 4*a* shows a perspective view of a frame for holding masonry slips
Figure 4B:
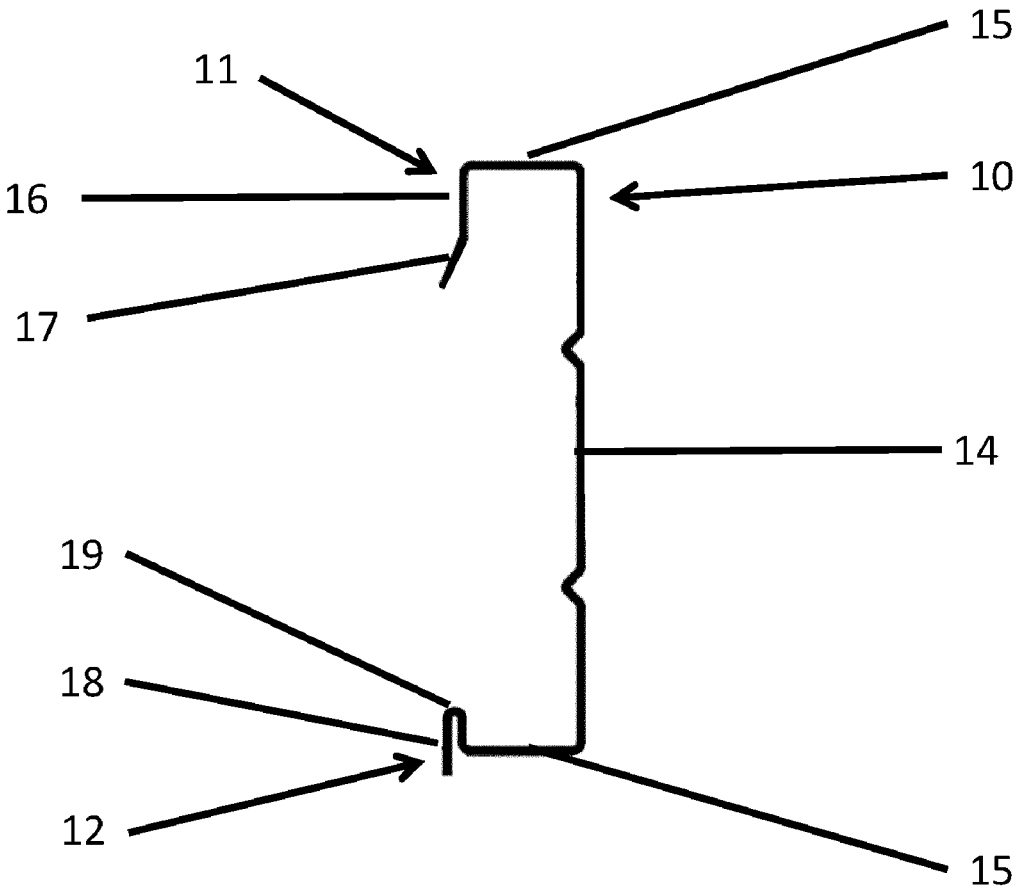
FIG. 4*b* shows a cross-sectional view of the frame of FIG. 4*a*

A masonry framework 1 can generally be seen in FIGS. 1 and 2; FIG. 1 showing a perspective view of such a framework 1. The framework 1 comprises one or more individual frames 10, wherein FIG. 4 shows one such frame 10 in both perspective view, in FIG. 4*a*, and cross-section, in FIG. 4*b*. As will become clear from the following, the frame 10 is intended to interact with one or more masonry slips 2, which can generally be seen in FIGS. 5 and 6, in order to generate a masonry panel. The masonry panel 3 is thus comprised of the masonry framework 1, itself comprising one or more frames 10, and one or more masonry slips 2. As can be seen in FIG. 3, the masonry slips 2 when integrated with the frames 10 lead to an apparent brick wall structure, wherein this can form the outer surface of a building. As will be appreciated, once the masonry slips 2 are properly cemented and pointed in, the final structure will look like a normal brick wall.

The masonry framework 1 brings the advantage of allowing a prefabrication of said framework 1 away from the building site. Building sites tend to be busy environments and in modern building techniques it is desirable that as much of the fabrication work for the buildings be performed away from the building site, this can be achieved by using prefabricated or finished products which are delivered for integrating with the buildings under construction. As will be apparent, the framework 1 shown in FIG. 1 can be largely designed away from the building site, prefabricated at a specialist facility and then readily shipped to the building site for mounting to the exterior of a building. The mounting of the framework 1 can proceed in any number of ways, the simplest being to provide a cavity behind the framework 1 and mounting the framework 1 by means of well-known support structures to the exterior of the building. Such support structures can be in the form of a frame attached to the building on one side, wherein the framework 1 is then attached to the other side to provide the exterior of the building. As is evident from FIG. 1, the one or more frames 10 are generally positioned in side-by-side alignment to provide multiple elongate frames 10 in generally parallel engagement, this then allows the masonry slips 2 to be positioned within the frames 10 to form the final wall.

Figure 5:
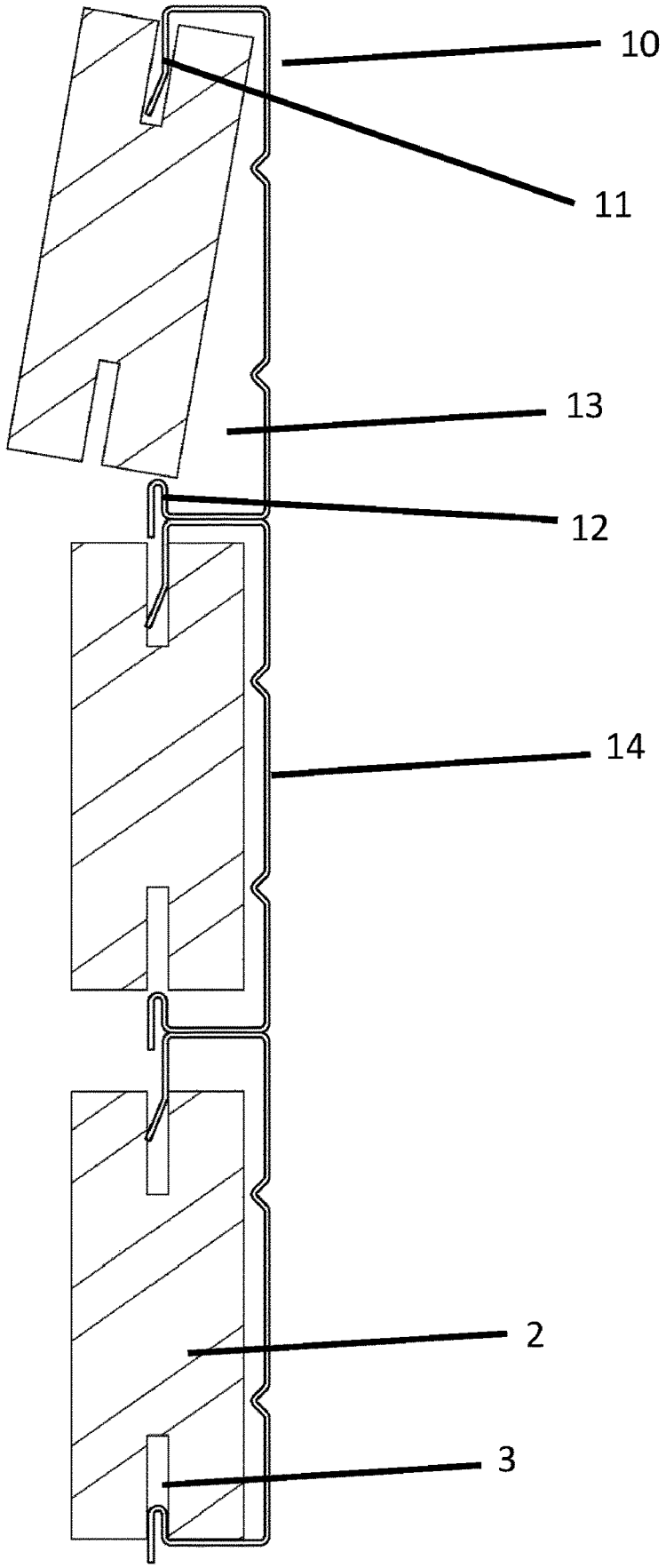
FIG. 5 shows a cross sectional view of mounting a masonry slip into the frames making up a masonry framework.

As can be seen in FIG. 5, the masonry slip 2 is generally provided with two slots 3 on opposing sides of the masonry slip 2. Masonry slips 2 are known products, and are typically formed in similar manner to that when making a standard house brick. The composite materials are mixed and fired to provide a final brick structure; the masonry slips 2 can either be cut from a standard fired brick, thus allowing the production of multiple masonry slips 2 from a single brick, or the end portions of the brick are removed to provide two masonry slips 2. Alternatively, it is possible to mould and fire the masonry slips 2 directly, thereby leading to less waste of material. Once the masonry slips 2 have been formed, notably without the slots 3, the slots 3 are then cut into opposing ends or side faces of the masonry slip 2. Whilst it would be possible to conceive of firing the masonry slips 2 with the slots 3 already formed, it has been found that it is more reliable to form the masonry slips 2 without slots 3, and then cut the slots 3 into the relevant surfaces or sides of the masonry slip 2.

It will be appreciated that the slots 3 on either side of the masonry slips 2 can be cut and formed in the masonry slips 2 with great accuracy. In particular, the width of the slots 3 can be very accurately determined and controlled, thus leading to masonry slips 2 with very precise and repeatable sizes of slots 3 formed therein. It is also advantageous for the final structure of the wall if the front surface of the masonry slip 2, that being the surface which will be seen once the final masonry panel has been formed, can be accurately positioned within the frame 10 so as to lead to a very regular final wall structure. The present disclosure also takes advantage of the very accurate positioning and sizes of the slots 3 in the masonry slips 2, in order to provide an improved final surface of the end masonry panel.

When considering FIG. 5, the specifics of mounting and fixing the masonry slip 2 within the frame 10 becomes evident. In particular, the present disclosure utilises the fact that the slots 3 can be formed with high precision accuracy and tailored dimensions, so as to provide a repeatable final wall-like structure. The concept of the present disclosure preferably relates to the prefabrication of the frames 10 or framework 1 at an offsite location, the delivery and mounting of said frames 10 or framework 1 to the outside of the building, and then populating of the empty frames 10 and/or framework 1 with multiple masonry slips 2 to provide the final wall structure. As can be seen from FIG. 5, the positioning of the masonry slips 2 within the frame 10 can readily be formed by slotting the masonry slip 2 onto lips 11, 12 in the frame 10. When looking at the uppermost frame 10 in FIG. 5, the slip 2 is positioned such that one of the slots 3 is located around an upper, or first, lip 11, thus allowing the top part of the masonry slip 2 to be positioned within a cavity or channel region 13 of the frame 10. The masonry slip 2 is introduced at an angle to allow the top part of the masonry slip 2 to be fed into the frame 10, in particular the channel 13 thereof, and then the lower portion of the masonry slip 2 is rotated such that the rear side of the masonry slip 2 is also held within the channel 13 of the frame 10. This arrangement is shown in the central frame 10 in in FIG. 5. Finally, the positioning and holding of the masonry slip 2 within the frame 10 proceeds by moving the masonry slip 2 downwards such that the lower of the slots 3 engages with the lower, or second, lip 12. This is shown in the lowermost frame in FIG. 5. The two slots 3 on either side of the masonry slip 2 therefore hold the upper 11 and lower 12 lips of the frame 10; in this manner, the masonry slip 2 is properly positioned within the frame 10 and the workmen can then proceed to install further masonry slips 2 to therefore populate the wall and create the final masonry panel.

One aspect of importance to the present disclosure, is that the masonry slips 2 are firmly held within the frame 10, and additionally that each of the masonry slips 2 will not readily move either forwards or backwards within the frame 10 (this forwards and backwards direction being the left and right directions shown in FIG. 5) or along the channel 13 of the frame 10. It will be appreciated, as indicated above, that worksites are busy places, and it is not inconceivable that vibration and knocks will occur to the frames 10 or framework 1, which may lead to uneven positioning of the masonry slips 2. Uneven positioning of the masonry slips 2 will destroy the final look of the masonry panel, and will not promote the concept appearing to be a brick wall rather simply a façade. The present disclosure employs multiple concepts in order to improve the engagement and positional fixation of the masonry slips 2 within each frame 10, wherein these relate to the specific forms of the upper lip 11 and the lower lip 12, and the fact that the slots 3 on the masonry slip 2 can be positioned and formed with high tolerance and reliability. Knowing that the slots 3 will have a well-defined width, allows for careful design of the lips 11 and 12 of the frame 10 to properly align and hold the masonry slips 2 within the frame 10.

When looking at the cross-section view of the frame 10 in FIG. 4*b*, it is clear that the frame 10 comprises an elongate back plate 14 which runs the entire length of the frame 10. Two extensions 15 are provided at either side of the back plate 14, and these generally extend forward away from the back plate 14 to create the channel 13 in the frame 10. In general, the figures show that the extensions 15 are positioned approximately 90°, or normal, to the plane of the back plate 14, however this is not a limiting feature. It will also be appreciated that the extensions 15 may proceed at different angles to the plane of the back plate 14, as long as they extend far enough away from the back plate 14 to create the channel 13 which is large enough to hold the rear portion of the masonry slips 2. The design as shown in the figures with the extensions being at 90° to the back plate 14, obviously provides the most compact structure with the largest channel 13. Other advantages of providing the extensions 15 extending in the normal direction from the back plate 14, relate to forming the framework 1; it is clear that the upper extension 15 provides a flat surface to which the lower extension 15 of the next frame 10 can rest. This improves the alignment of the frames 10 as well as leading to a more sturdy framework 1.

As can be seen in the figures, in particular FIG. 4*b*, the lips 11, 12 are provided at distal ends of the extensions 15; distal with respect to the back plate 14. The lips 11, 12, are shown extending toward each other approximately parallel with the back plate 14, in order to define an enclosed cavity region 13 at the upper and lower portions of the frame 10. The lips 11, 12 will then, evidently, be able to interact and slot within the slots 3 of the masonry slips 2, thus properly holding the masonry slips 2 within the frames 10.

Considering the upper lip 11: this is shown in the figures with two sections forming the lip 11. A first section provides a straight portion 16 which extends in a plane approximately parallel to the plane of the back plate 14. At the lower end of the straight portion 16, one notes the angled end portion 17; the angled end portion 17 provides an extension or flange away from the back plate 14 and therefore provides an angled portion with respect to the straight portion 16. The structure of the angled end portion 17 firstly allows for the upper lip 11 to be longer than would be possible with a straight upper lip only, as the angled end portion 17 improves the fitting of the slot 3 of the masonry slip 2 over the upper lip 11—as seen in FIG. 5. As will also be appreciated, the longer upper lip 11 increases the interaction with the masonry slip 2 to hold this in proper alignment within the frame 10. The particular dimensions of the upper lip 11, and in particular the straight portion 16 and angled end portion 17, are chosen with specific consideration of the width of the slot 3 on the masonry slip 2 in mind. As mentioned above, the slots 3 on the masonry slips 2 are of well-defined width; as can be seen in FIG. 5, the particular length and angle which the angled end portion 17 makes with respect to the straight portion 16, allows for careful alignment of the masonry slip 2 within the frame 10. As will be seen from FIG. 5, when the masonry slip 2 is properly engaged with the frame 10, the rear side of the straight portion 16 of the upper lip 11 is held in contact with one side of the inner surface of the slot 3 in the masonry slip 2. The angled end portion 17 is so structured that it extends from one side of the slot 3 in the masonry slip 2 to the other side, that being the front inner surface of the slot 3 in the Figures, to provide an edge contact with the slot 3 in the masonry slip 2. The inverse structure, wherein the front side of the straight portion 16 of the upper lip 11 is held in contact with one side of the inner surface of the slot 3, this being the inner surface further away from the frame 10, in the masonry slip 2 and the angled end portion 17 extends back toward the frame 10 across the slot 3 to make an edge contact with the other inner surface of the slot 3 in the masonry slip 2, is also conceivable. Again, the surface and edge contact will securely hold the masonry slip 2 within the frame 10.

Crucially, to improve the workability and lifetime of the product and masonry panel: the upper lip 11 is primarily designed such that the contact at the back side of the straight portion 16 and the edge contact at the front side of the slot 3 with the angled end portion 17, leads to no deformation forces on the upper lip 11. That is, the upper lip 11 is structured such that it will be held in the slot 3 of the masonry slip 2 without forces acting upon it trying to deform the lip 11, but will make solid frictional engagement by means of the back surface of the straight portion 16 and the edge contact of the angled end portion 17. It will be appreciated that these two frictional contacts between the inner surfaces of the upper slot 3 in the masonry slip 2 will properly align and frictionally hold the masonry slip 2; this is both in a forwards and backwards direction, as well as minimising the slippage of the masonry slip 2 along the frame 10.

The present design offers the potential for a second or alternative fixation of the masonry slip 2 within the frame 10. The second, lower, lip 12 may be so structured as to also firmly engage with the lower slot 3 on the masonry slip 2. The structure of the lower lip 2 can be in addition to the structure defined above for the upper lip 11, or may be provided instead of such a structure. Once again, by taking advantage of the accurate tolerance to the slots 3 in the masonry slips 2, the thickness of the lower lip 12 can be appropriately tailored such that frictional engagement with the slot 3 on the masonry slip 2 can be provided. If the thickness of the lower lip 12 approximates the thickness of the lower slot 3 in the masonry slip 2, it will be appreciated that a frictional engagement between the lower lip 12 and the slot 3 will arise, thus providing a further or alternative mechanism for reliably holding the slip 2 within the frame 10. As can be seen in FIGS. 4*b* and 5, the lower lip 12 may be formed by simply bending the material making up the lower lip 12 back on itself so as to provide a dual, or multiple, layered structure for frictionally engaging with the lower slot 3 on the masonry slip 2. Carefully choosing the thickness of the lower lip 12 will provide a good frictional engagement with the slot 3 of the masonry slip 2, thus also ensuring that the movement of the masonry slip 2 within the frame 10, either back and forth or along the frame 10, will be avoided.

As shown in FIGS. 4*b* and 5, the lower lip 12 can be provided by a single fold in the material making up the lower lip 12. Carefully defining the end thickness of the lower lip 12 by means of folding the material and providing a gap 18 between the two adjacent pieces, allows for a high degree of accuracy in the thickness of the lower lip 12 for interacting with the slot 3. It will be appreciated that when the lower lip 12 is possessed of a single fold 19, thus providing a two layer lower lip 12, the two sides of the lower lip 12 will be able to move slightly with respect to each other, thus allowing for a very tight friction-fit between the lower lip 12 and the slot 3. An alternative design, not shown in the figures, allows for the lower lip 12 to be structured from material which is bent back on itself, but wherein the two adjacent halves of the lower lip 12 are not parallel with each other. If the gap 18 between the two adjacent parts of the lower lip 12 increases from the bend or fold position 19 of the lower lip 12, it will be clear that the thickness of the lower lip 12 will increase moving from the fold 19 downward toward the bottom of the frame 10. This increasing gap 18 can be used to provide an increased frictional fit between the lower lip 12 and the slot 3, thereby providing an improved holding of the masonry slip 2 within the frame 10.

As shown in FIG. 5, the combination of the angled upper lip 11 and the folded lower lip 12 with tailored slot 3 thickness, allows for two frictional engagements between the slots 3 and the lips 11, 12. This dual accurate positioning of the masonry slip 2 within the frame 10 leads to a much more even and regular looking end wall, once the masonry slips 2 have been positioned within the framework 1 and the slips 2 are pointed, thereby improving the end structure. Furthermore, the good engagement between the masonry slip 2 and the frame 10 means that in the busy worksite environment, it is less likely that the slips 2 will be knocked and moved within the frame 10, thus ensuring that when the frame 10 or framework 1 is to be fully populated with multiple masonry slips 2, the masonry slips 2 only need to be introduced once and are most unlikely to move prior to being cemented and pointed in.

To further improve the final view of the wall once the framework 1 is populated with slips 2, the rear surfaces of the straight portion 16 of the upper lip 11 and the rear portion of the lower lip 12 are generally extending along the same plane. By having the rear sides of the upper and lower lips 11, 12 being on the same plane, and also desirably parallel with the plane of the back plate 14, the precise and repeatable positioning of the front visible surfaces of the masonry slips 2 can be achieved. As highlighted above, not only can the width of the slots 3 in the masonry slip 2 be controlled with great tolerance, also the distance from the front surface of the masonry slip 2 may be well controlled. These two features, in combination with the accurate positioning of the rear sides of the lips 11, 12, leads to an improved final structure of the masonry panel. Furthermore, the gap between the upper fold portion of the lower lip 12 and the lowest portion of the angled end portion 17 of the upper lip 11, is so tailored such that both lips 11, 12 will be held within the slots 3 of the masonry slip 2. The gap between the upper and lower lips 11, 12 is larger than the solid portion in the middle of the masonry slip 2, that is the portion between the internal ends of the slots 3. The gap between the lips 11, 12 is, however, smaller than the overall width of the masonry slip 2. The gap between the lips 11, 12 is, however, greater than the distance from the bottom of one of the slots to the opposing outer side of the masonry slip 2. This gap can be seen best in FIG. 5*a*, and this size of gap between the lips 11, 12 allows for the masonry slip 2 to be slotted within the channel 13 as shown in the three steps of FIG. 5.

The individual frames 10 are ideally structured from a single piece of formed or rolled material, thus improving the ease of manufacture. In particular, the frames 10 can be formed from rolled metal material, stainless steel being a good choice. As can also be seen in the figures, when the frame 10 is fabricated, one or more ridges 20 can be positioned along the length of the frame 10, thus providing additional stability to the frame 10 and framework 1. Another feature which can be provided on the frame 10, is that of extensions or bumps provided around one or more of the bends within the frame 10. In particular, by having these bumps or extensions, or even braces, on the external side of the bend between the back plate 14 and the extensions 15, the rigidity of the frame 10 is improved. Finally, it will be noted from FIGS. 2, 4*b* and 5 that the lower lip 12 can be of such a structure that the lowest portion, after folding the material over, extends beyond and below the lower extension 15. This extension of the lower lip 12 is useful in improving the alignment in the forward and back direction, as seen in the left and right direction in FIG. 5, of the adjacent frames 10. By providing the lower lip 12 extending to overlap with the upper portion of the upper lip 11 on the adjacent frame 10, the forward and back alignment of each of the frames 10 can be improved and the final overall regularity of the framework 1, and consequently the masonry panel, can be ensured.

By provision of the accurately located slots 3 in the masonry slips 2, the overall structure of the masonry panel can be improved. Providing this combination will lead to a reliable end product of a brick wall, whilst allowing for fabrication of the individual items to be performed away from the building site.

Figure 6:
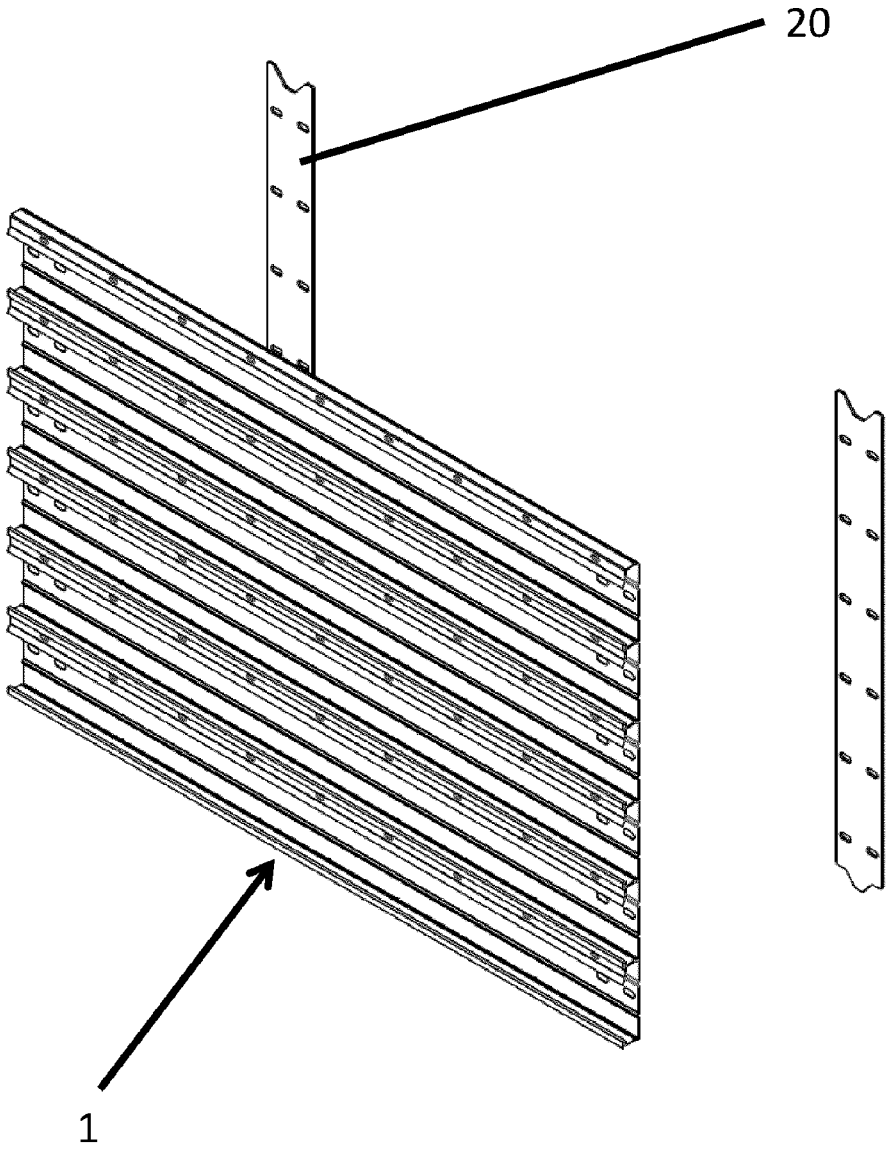
FIG. 6 shows a masonry framework with jointing plates in exploded form

One of the key aspects of the present disclosure is the ability to pre-fabricate the masonry framework 1 away from a building site and then deliver this in a state which is ready for installation on the building. It is further possible, and in many cases desirable, to deliver the masonry framework 1 with the masonry slips 2 in place, thus meaning that an entire pre-fabricated masonry panel 4, as seen in FIG. 3, can be delivered to the work site and integrated with the building. Proceeding in this way brings significant improvements to building site, as much of the fabrication work of the façades/cladding (these two terms are used interchangeably in the following) can be performed at a remote site and prior to final installation on the building. In order to improve the uniform production and final regularity of the masonry framework 1 and prefabricated masonry panel 4, individual frames 10 making up these can be aligned in a side-by-side manner, as shown in FIG. 1, and then attached together by means of one or more jointing plates 20. FIG. 6 shows an exploded view of a masonry framework 1 and two jointing plates 20; the number of jointing plates 20 is exemplary, and any number of jointing plates 20 can be conceived.

It will be appreciated that the completed masonry framework 1 when attached to the jointing plates 20, can be delivered either with masonry slips 2 incorporated (as shown in FIG. 4), or without said masonry slips 2. After installation of the completed masonry framework 1 incorporating the jointing plates 20, the masonry slips 2 can be added into the masonry framework 1 as shown in FIG. 5 and discussed above. If the pre-fabricated masonry panel 4 incorporating the masonry framework 1 as shown in FIG. 6 is delivered to the work site, it is a simple matter to align and attach said pre-fabricated masonry panels 4 on the exterior of the building to make the cladding. Once the pre-fabricated masonry panels 4 are in place, a member of the work force to add the missing masonry slips to bridge across the gap between adjacent masonry frameworks 1. Once the masonry slips 2 are cemented in place, the exterior cladding wall will be complete.

Figure 7:
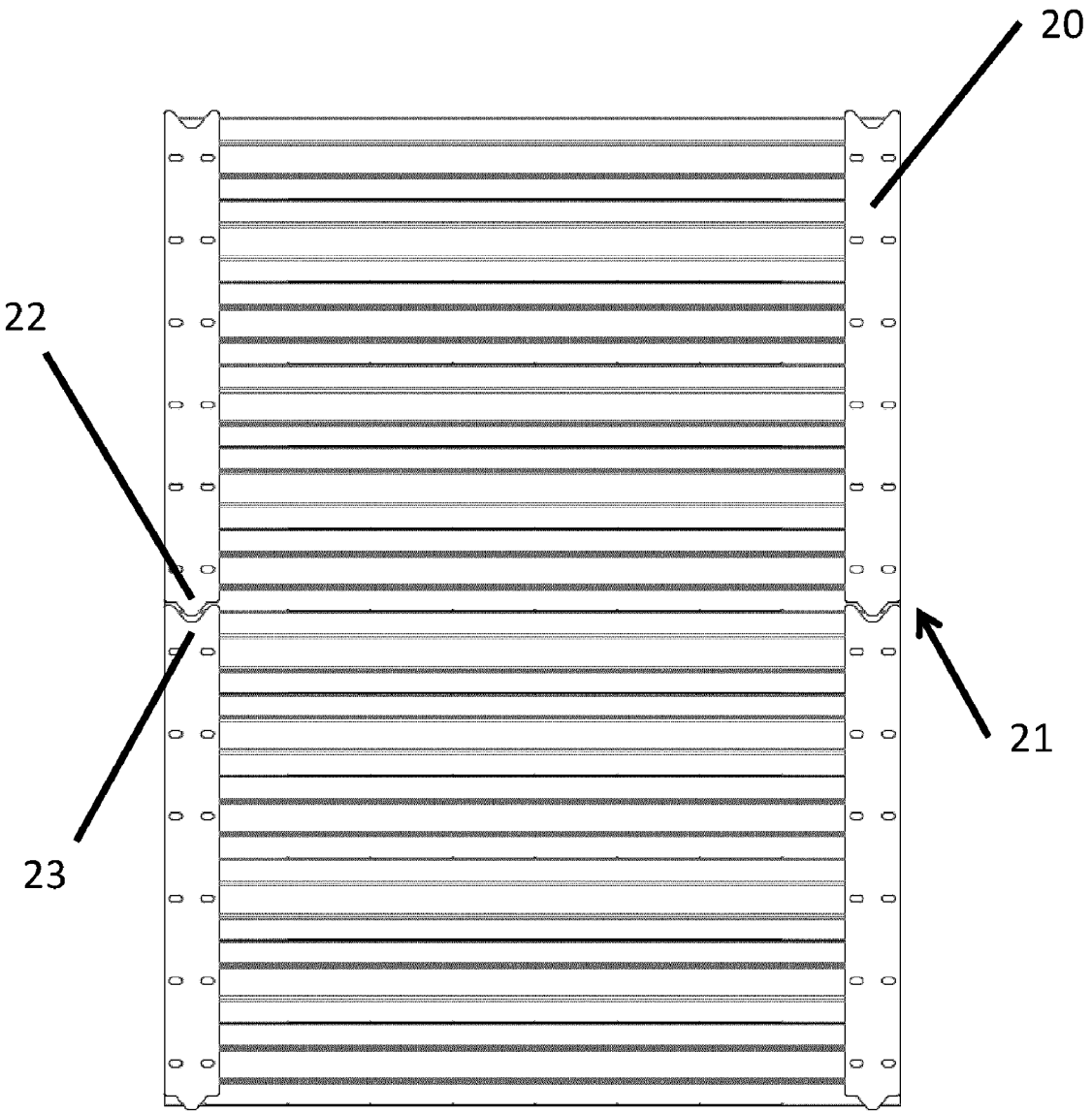
FIG. 7 shows the rear of two, vertically aligned masonry frameworks and jointing plates

When delivering the masonry framework 1 with associated jointing plates 20, it is beneficial to provide the ends of the jointing plates 20 with appropriate alignment means 21. In order to improve the final appearance of the exterior wall, it is desirable for each of the frames 10 in adjacent masonry frameworks 1 to be appropriately aligned in vertical and horizontal directions. Vertical in this sense is the up-down direction in each of FIGS. 1, 3 and 6. The alignment means 21 as seen in FIG. 7 assist in ensuring that vertically adjacent masonry frameworks 1 will be appropriately horizontally aligned, that is in the left-right direction according to FIG. 7. FIG. 7 is a rear view of the masonry framework 1 shown in FIG. 6, and the attachment of the jointing plates 20 at either end of the vertically aligned frames 10 can be seen. Each of the frames 10 is provided with fixing means for attachment to the jointing plates 20. FIG. 7 shows one jointing plate 20 positioned at each longitudinal end of the frame 10, with the jointing plate 20 being provided with attachment means which align with the individual frames 10.

In the example shown in FIGS. 6 and 7, the jointing plate 20 and frame 10 are each provided with holes or slots which will align when constructing the masonry framework 1, fasteners can then be positioned within the holes or slots to construct the complete masonry framework 1 with jointing plates 20. Other means of attaching the frames 10 to the jointing plates 20 will be well known, and are considered to be equally appropriate in constructing the completed masonry framework 1. The alignment means 21 at either end of the jointing plates 20 are shown in FIG. 7 as an extending tongue on a first of the jointing plates 20, wherein this extending tongue 22 fits within a corresponding indent 23 on the adjacent mounting plate 20. The use of the tongue 22 and indent 23 allows for the vertically adjacent masonry frameworks 1 to be properly aligned in the horizontal direction. As shown, the tongue 22 slots within the indent 23, thus meaning that the adjacent, vertically aligned, jointing plates 20 are held in appropriate horizontal alignment thus making for a complete horizontally and vertically aligned façade when multiple masonry frameworks 1 are attached together. It will be appreciated that the tongue 22 and indent 23 are merely exemplary structures: any number of mechanically interacting structures may be conceived, the principle being that one end of a first jointing plate 20 has an alignment means 21 which physically interlocks with the alignment means 21 of the adjacent jointing plate 20. For example, the alignment means may comprise a sinusoidal wave, with a first tongue portion and a first indent portion on the first jointing plate 20, a second indent portion and second tongue portion on the second jointing plate 20 would have the corresponding and matching inverse structure; such a sinusoidal structure would ensure that the two mounting places 20 mechanically interlock to form the vertically and horizontally aligned façade.

Figure 8A:
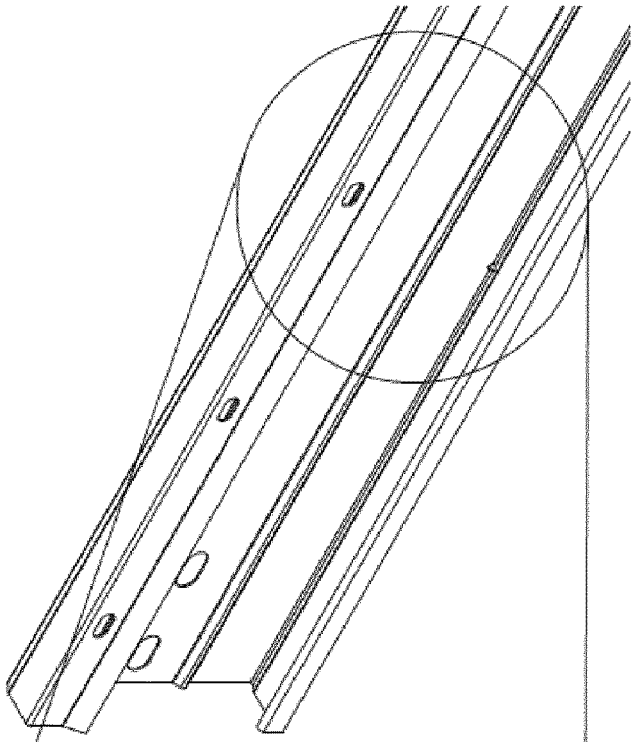
FIG. 8*a* shows a perspective view of a frame
Figure 8B:
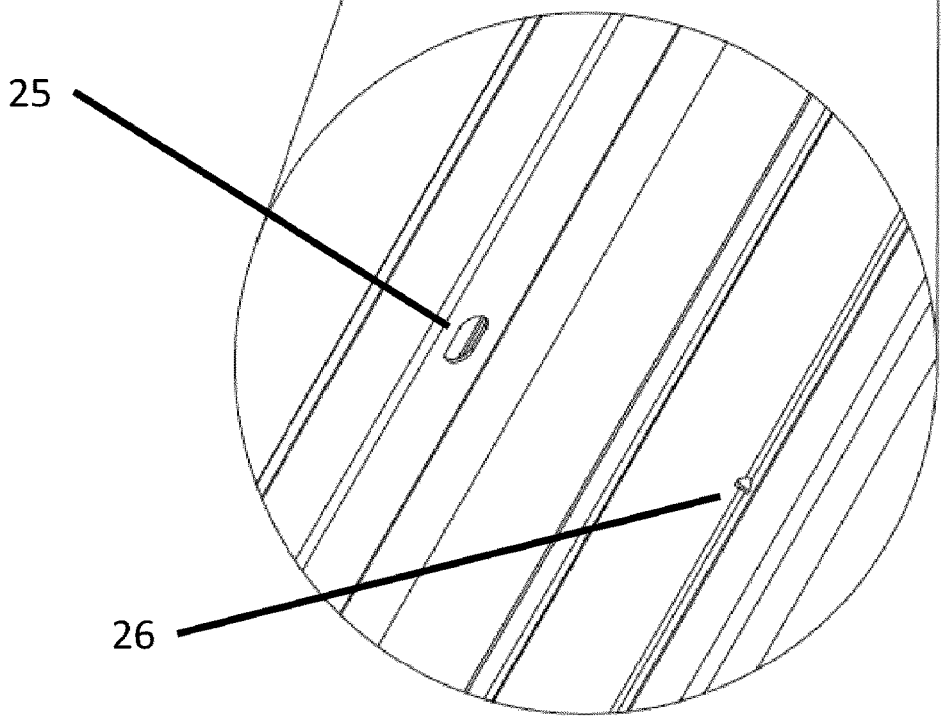
FIG. 8*b* shows a close-up view of part of a frame, showing drainage holes and holes for improving the mortar course connection

Once the completed façade is provided on the outside of the building by means of multiple masonry framework panels 1 aligned as described above, the finished building will comprise a gap between the main structure of the building and the façade comprising the multiple masonry frameworks 1. This gap provides a useful air barrier for increasing the insulation of the building, whilst also providing a secure place for external fittings and the like for the building. Moisture may accumulate in the gap between the façade and the main building, without careful handling, this moisture may lead to excessive water build-up and associated damage therefrom. In order to improve the handling of water which accumulates within the masonry framework 1, the frame 10 can be provided with one or more drainage holes 26. FIG. 8*a* shows a first perspective view of a frame 10 showing drainage holes 26, wherein FIG. 8*b* shows an enlarged view of the highlighted section of FIG. 8*a*. As seen in FIG. 8*b*, at least one drainage hole 26 may be provided at the lower portion of the frame 10 in order to allow any moisture which gathers between the masonry slip 2 and the frame 10, to drain out into the cavity between the frame 10 and the building structure. Water which drains into the cavity can then appropriately drip down to the floor, or be handled by other means present within said cavity. The ideal positioning of the drainage holes 26 is at the lower portion of the frame 10, this being the lower portion when the frame 10 is in use, at a location between the back plate 14 of the frame 10 and the lower of the extensions 15. Positioning the one or more drainage holes 26 at this point will allow for moisture which builds up between the masonry slip 2 and the frame 10 to escape from the gap between the masonry slip 2 and the frame 10 into the cavity. As will be described later with reference to FIG. 11, wherein a second frame 40 is described, the drainage holes 26 are positioned at the lowest and rearmost point of the frame 10 and the second frame 40 as this will provide an exit for any moisture out of the frame 10 and into the cavity between the masonry framework 1 and the building structure.

As shown in FIGS. 8*a* and 8*b*, the straight portion 16 of the upper lip 11 can be provided with a hole 25 therethrough. The hole 25 in the upper lip 11 is provided so as to improve the connection of the masonry slip 2 to the frame 10. As seen in FIG. 5: once the masonry slip 2 is properly held in the frame 10 (which is best seen in the lowest masonry slip 2 and frame 10 combination of FIG. 5), a gap exists between the adjacent masonry slips 2 which will form the mortar course once the masonry slips 2 are properly mortared and embedded within the frame. In order to improve the connection between the mortar and the frame 10, each of the upper lips 11 is provided with one or more holes 25. The holes 25 allow for mortar to pass from the front side of the upper lip 11, through the hole 25 and into the region behind the upper lip 11. It will be appreciated that allowing the mortar to pass from the front side of the upper lip 11 to the back side of the upper lip 11 will provide a much stronger anchoring of the mortar making up the mortar course with the frame 10, thus ensuring that the mortar does not come loose once the entire masonry panel 4 is positioned on the building. In order to improve the connection of the mortar into the mortar course, the spacing between each of the holes 25 may be chosen to be less than half the length of the masonry slip 2. This frequency of holes 25, ensures that each section of mortar between the masonry slips 2 will be properly held within the masonry panel 4 and lead to a reliable end structure.

Figure 9A:
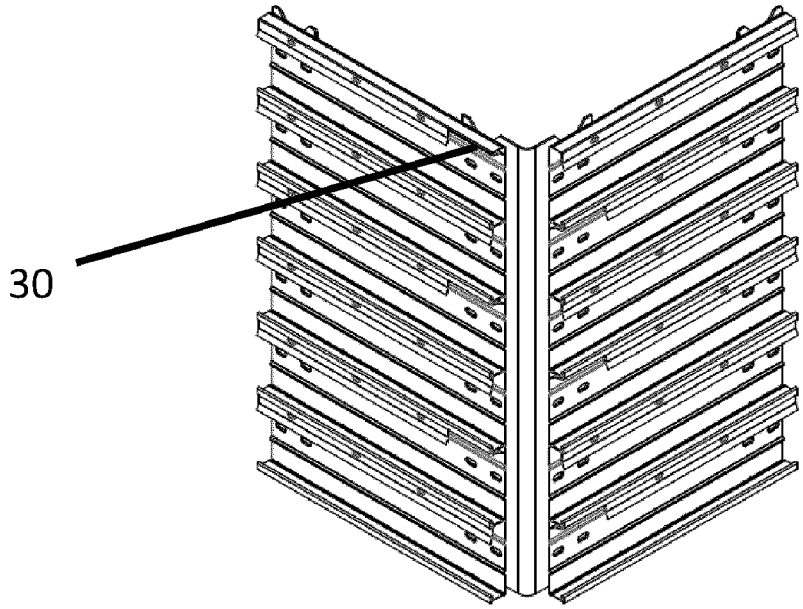
FIG. 9*a* shows a corner framework
Figure 9B:
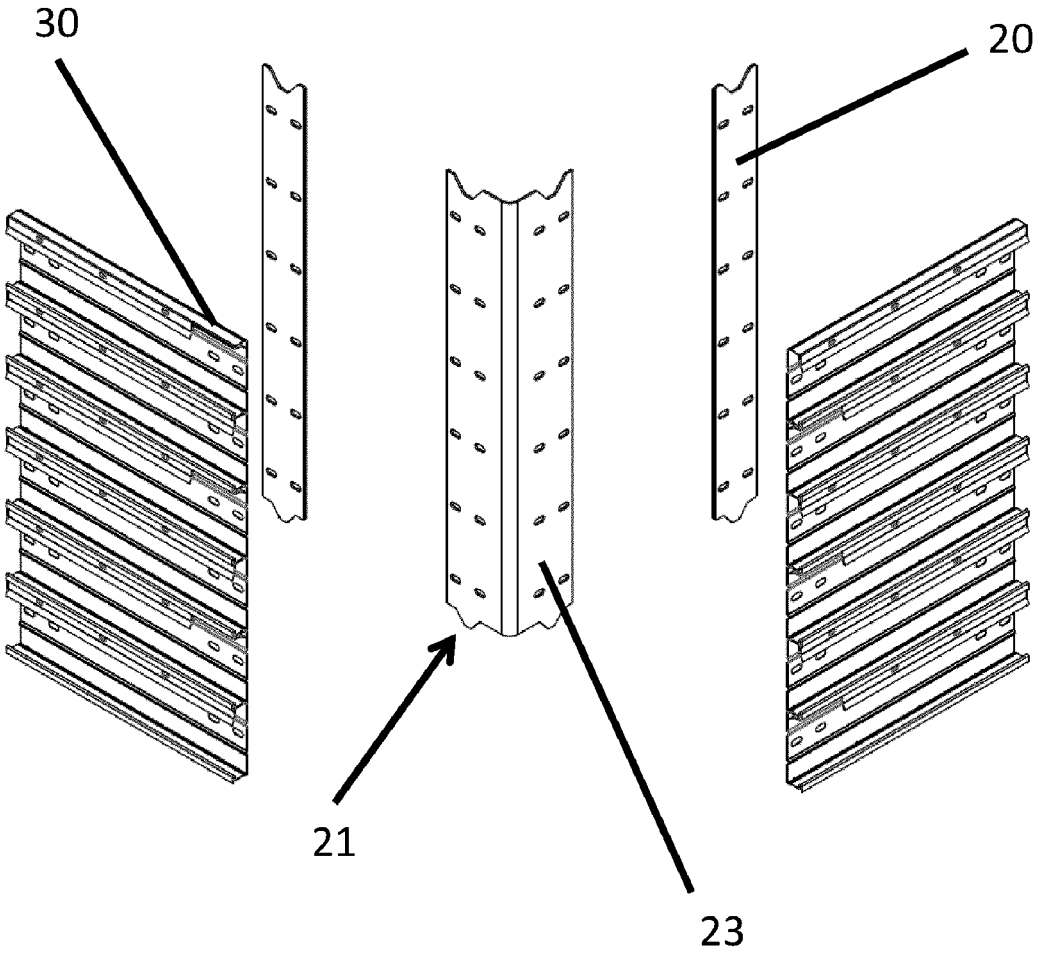
FIG. 9*b* shows the corner framework of FIG. 9*a* in an exploded view

FIGS. 9*a*-9*c* and 10*a*-10*b* show in detail the structure of a corner construction for the façade of a building. With reference to FIGS. 1, 3 and 6, a pre-fabricated corner structure can be made by combining two masonry frameworks 1, generally according to either FIG. 1 or 6, in appropriate alignment either side of the planned corner for the façade/cladding. FIG. 9*b* shows an exploded view of a corner construction comprising two masonry frameworks 1 with an angle there-between, the two masonry frameworks 1 are shown attached to an appropriate corner jointing plate 23. The corner jointing plate 23 is shown as having the same general form as a jointing plate 20, in particular with regard to the alignment means 21, and is for attachment to one end of the related masonry frameworks 1. The corner jointing plate 23 can be understood as being essentially two jointing plates 20 connected together with an angle there-between so as to fit round the corner. In FIG. 9*b*, the angle between the two parts of the corner joining plate 23 is shown as being approximately 90°. This is by way of example only, and it will be appreciated that any desired angle between the two horizontally adjacent masonry frameworks 1 can be achieved by changing the angle between the two parts making up the corner jointing plate 23.

The corner jointing plate 23 may be an integrally formed unit comprising two structures very similar or identical to the jointing plate 20 described above, a central bent portion of the corner jointing plate 23 connecting these two jointing plates 20 together. Alternatively, the corner jointing plate 23 may be fabricated from two separate jointing plates 20 which are connected or held together my means of a third bridging piece which bridges the gap between the adjacent mounting plates 20, thus forming the desired angle between said two jointing plates 20. Two horizontally adjacent masonry frameworks 1 can be properly attached to each other via the corner jointing plate 23 to form a corner, wherein the corner pointing plate 23 defines the desired angle between the two adjacent masonry frameworks 1. In the same manner as for the jointing plate 20, the corner jointing plate 23 is provided with appropriate fixing means to allow connection to the frames 10 making up the masonry framework 1.

Figure 10A:
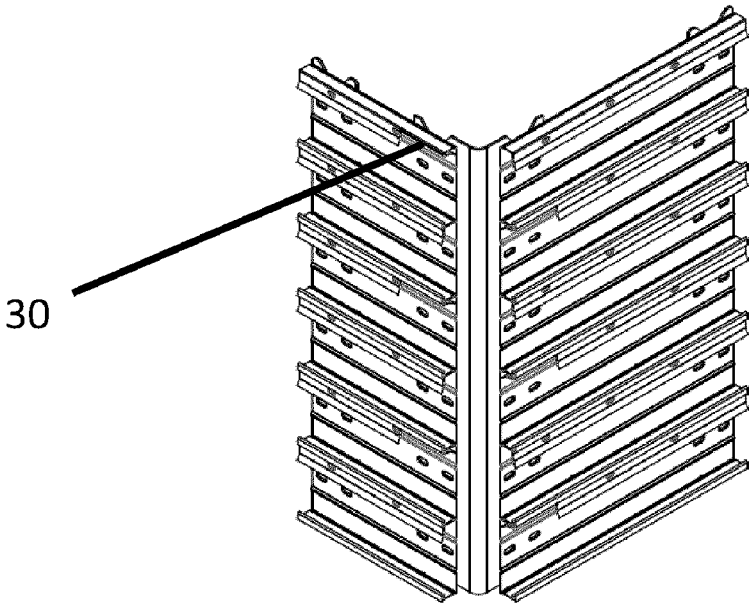
FIG. 10*a* shows a corner reveal framework
Figure 10B:
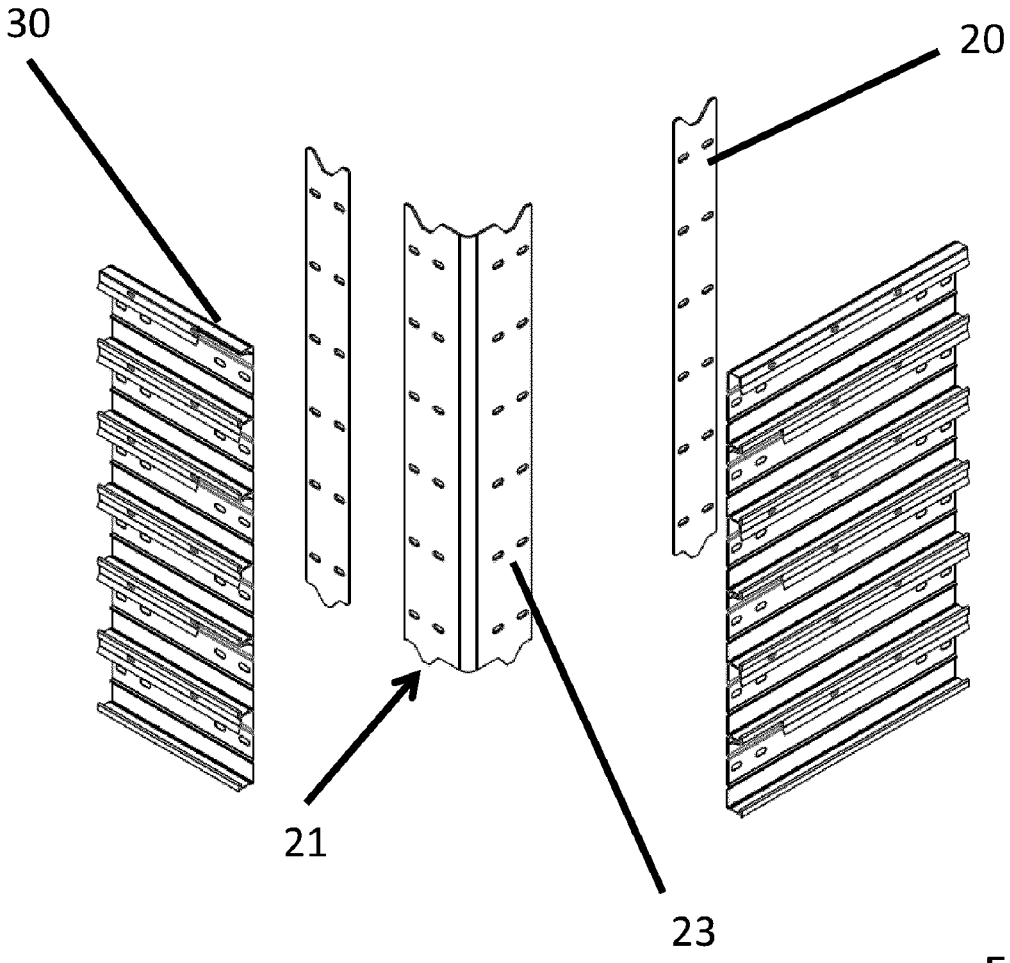
FIG. 10*b* shows the corner reveal framework of FIG. 9*a* in an exploded view

The exploded views of FIGS. 9*b* and 10*b*, show the corner jointing plate 23 taking the position of one of the jointing plates 20 forming the normal masonry framework 1 as shown in FIGS. 6 and 7. It is also conceivable that a masonry framework 1 which is to positioned at a corner point of the final construction, is provided with two jointing plates 20: one of the jointing plates 20 is positioned at the edge of the frames 10, the second jointing plate 20 is positioned part-way along the frames 10 to hold the frames 10 in appropriate alignment and make the masonry framework 1, this construction leaves the second edge of the masonry framework 1 free for attachment to the corner jointing plate 23. This structure allows for a complete masonry framework 10 to be delivered to the work site, and then readily integrated with the corner jointing plate 23 to form a corner. The corner jointing plate 23 may be provided as a flat "corner" jointing plate, being utilised to connect together masonry frameworks 1 in the horizontal direction along a flat wall. By providing the dual jointing plate 20 with no angle between each portion, the two ends of horizontally adjacent masonry frameworks 1 can be properly connected together to ensure exact alignment which leads to an improved final structure of the façade. By providing this dual jointing plate 20, the horizontal and vertical alignment of the frames 10 making up the masonry framework 1 of each adjacent masonry framework 1 can be properly aligned with each other to ensure complete and regular structure to improve the final façade.

Figure 9C:
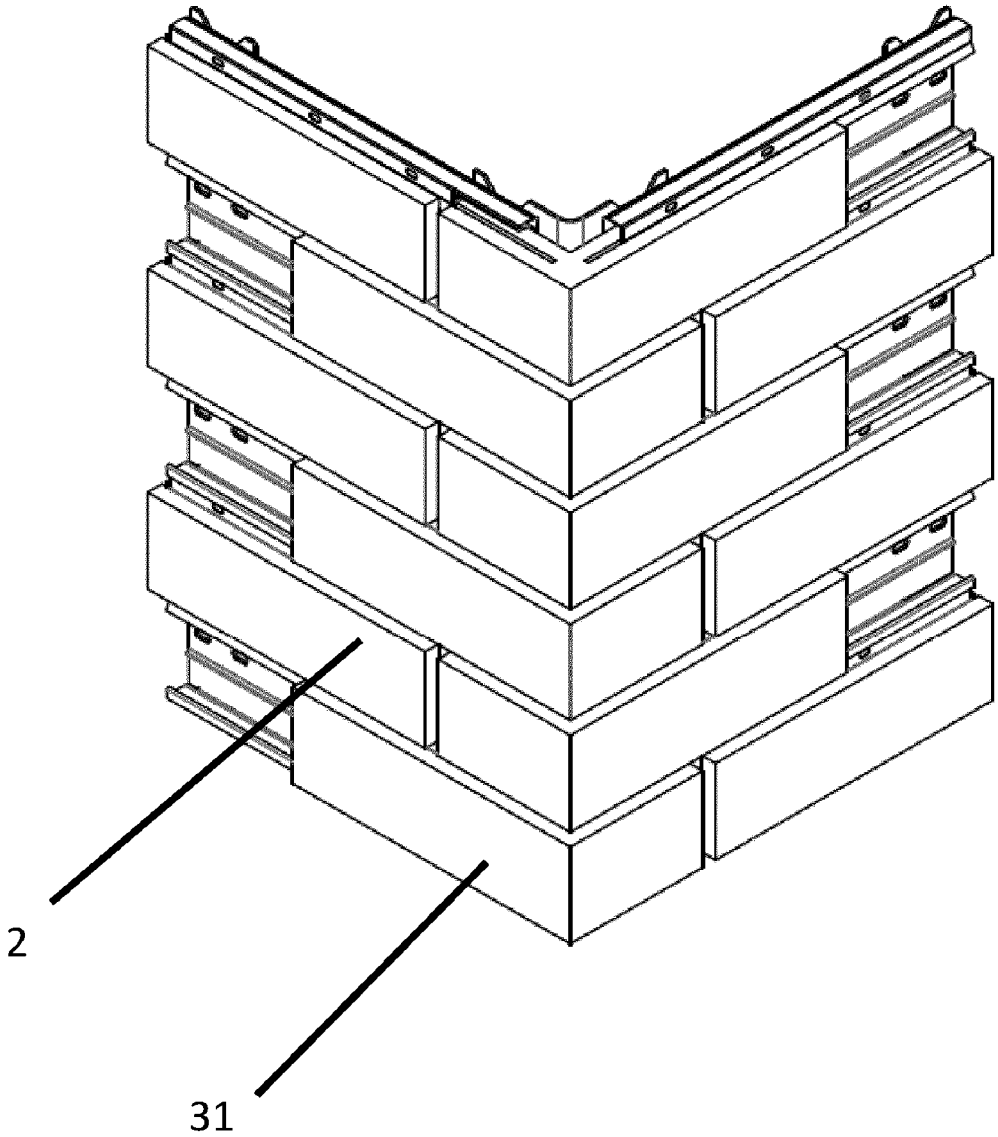
FIG. 9*c* shows the corner framework of FIG. 9*a* with associated slips therein

Whilst the structure shown in FIG. 9 is that of a normal corner between two extending walls of the façade, FIGS. 10*a* and 10*b* show a corner reveal panel. A reveal panel is one in which the façade made up of masonry slips 2 on one side of the corner does not fully extend into a complete wall structure, and is instead shorter. The reveal panel may form a side of an archway or porch of a house, and therefore need only have the width of one (or a few) masonry slip(s) 2, thus meaning that the second metal framework 1 is shorter than the first. In FIG. 10*a*, the right-hand metal framework 1 will form part of an extended wall structure. The left-hand metal framework 1 in FIG. 10*a* provides the front facia of a single wall or column structure, and would not extend into a complete wall. As mentioned above, this may be as a result of providing a different section of the building and perhaps to the left of the left-hand metal framework in FIG. 10*b* the building is designed with an archway or doorway, or any other structure which requires no complete brick facia. All other aspects of the reveal panel shown is FIGS. 10*a* and 10*b* are the same as the corner panel shown in FIGS. 9*a* to 9*c*.

FIG. 9*c* shows the corner unit as shown in 9*a* with a number of masonry slips 2 therein. As will be clear when considering a normal brick wall, the corner section of any brick wall allows not only the long side face of a brick to be visible, as in a normal flat straight wall section, but also the shorter end piece of each brick becomes visible. In order to ensure that the completed corner masonry panel presents an appropriate brick-line façade, the corner section as seen in FIG. 9*a* must be populated with appropriate masonry slips 2. As can be seen in FIG. 9*c*, the actual corner section of the corner framework comprises an angled masonry slip 31. The angled masonry slip 31 is structured so as to appear like a normal brick when located in the corner masonry framework 1 of FIG. 9*a*, and consequently has two extending sections. As seen in FIGS. 9*c* and 16*b*, a first section extends with a length matching that of the standard flat masonry slips 2 described above; a second section is provided at an angle to this first section and presents a face which has the normal structure of the end of a brick. In particular, the second section will have a length which is half that of the longer section. Normal bricks have a 2:1 ratio of side length to end length, and consequentially (at least ideally) the angled masonry slips 31 conform to this standard and provide a generally L-shaped angled masonry slip 31 with the two faces of appropriate length to appear like a standard brick when utilised in the corner portion of the corner masonry framework.

As can be seen at the top of the angled masonry slip 31 in FIGS. 9*c* and 16*b*, the two edges are provided with slots therein, in the same manner as the standard flat masonry slips 2 described above. The slots in the angled masonry slips 31 are positioned so as to allow the slots to interact with the respective lips 11, 12 of the respective frame 10. That is, as will be seen in FIG. 9*a*, the upper lip 11 and lower lip 12 extend into the corner region between the two masonry frameworks 1, and the slot provided on the edges of the angled masonry slip 31 will accommodate the upper lip 11 and lower lip 12 and thus hold the angled masonry slip 31 within the construction. Whilst the corner is shown is FIGS. 9 and 10 as being a corner at 90°, such that the angled masonry slip 31 is also provided with an angle of 90° between the first and second sections, this is by way of example only. It will be clear that if the two masonry frameworks 1 are provided at a different angle with respect to each other, the two sections of the angled masonry slip 31 will also be provided with an appropriate angle therebetween. This will ensure that the system being described can be used for any structure in a flexible manner.

Considering the fitting of the angled masonry slips 31 within each of the masonry frameworks 1 as shown in FIG. 9*c*, it is not possible to accommodate the angled masonry slips 31 if both the upper lip 11 and lower lip 12 on each of the frames 10 extends completely into the corner region. When considering the method of attaching the masonry slips 2 into the masonry framework 1, as best seen in FIG. 5, it would not be possible to appropriately angle both the first section and second section of the angled masonry slip 31 to allow a proper engagement of both slots within the appropriate frames 10 on each of the masonry frameworks 1. In order to overcome this problem, the frames 10 which are to be used in the corner structure shown in FIGS. 9 and 10 are modified slightly so as to appropriately accommodate the angled masonry slips 31. As shown FIG. 9*a*: the upper lip 11 of one of the frames 10 adjacent the corner, that is at one end of the frame 10, is shorter by at least the length of the second, shorter, section of the angled masonry slip 31 and provides a gap 30. By removing the upper lip 11 to provide the gap 30, it becomes possible to position the angled masonry slip 31 within each of the relevant frames 10 either side of the corner: each of the slots engages with the relevant upper lip 11 or lower lip 12, except for the upper slot of the second, shorter, section of the angled masonry slip 31, which is located at the gap 30. Whilst the upper slot on the shorter, second section of the angled masonry slip 31 is not held within the frame 10 on one side of the corner region and is located at the gap 30, the other three slots will hold appropriate upper lip 11 or the low lips 12 of respective frames 10, and thus the angled masonry slip 31 will be properly held with the final construction.

As part of the upper lip 11 is missing, thus providing the gap 30 in one of the frames 10 at the corner, the slots on the long part of the angled masonry slip 31 can be slid over the upper lip 11 and lower lip 12 of a first of the frames 10 in order to slidably engage the angled masonry slip 31 into the first frame 10. Once the inside of the shorter, second section of the angled masonry slip 31 abuts the second frame 10 on the other side of the corner, the angled masonry slip 31 can be rotated upward, while still keeping the slots on the longer first section engaged with the relevant lips on the first frame 10, and the lower slot on the second shorter section of the angled masonry slip 31 can then be positioned over the lower lip 12 of the second frame 10. This sliding, angling and repositioning of the angled masonry slips 31 allows for them to be positioned within the first frame 10 on one masonry framework 1 and also the second frame 10 on the second masonry framework 1 to give the structure as shown if FIG. 9*c*. The gap 30 in the upper lip 11 is needed on every other frame 10 of the masonry framework 1, as every other frame 10 will accommodate the shorter, second section of the angled masonry slip 31. As shown in FIGS. 9*a* and 9*c*: to make the complete corner, the gap 30 in the frame 10 of the first masonry framework 1 occurs on a frame 10 which does not align with the gap 30 in the frame 10 in the adjacent, second masonry framework 31. This gives a staggered structure to the gaps 30 in the frames 10, allowing for the angled masonry slips 31 to be positioned appropriately around the corner of the two adjacent masonry frameworks 1. The final structure can be seen in FIG. 9*c*, wherein it is clear that the upper slot in each of the shorter, second, sections of the angled masonry slip 31 is not engaged with the upper lip 11 of the frame 10. Whilst this concept of the shorter upper lip 11 is described in light of the specific upper lip 11 of the frame 10 as seen in FIG. 4*b*, for example, it will be appreciated that this is exemplary only. In some circumstances corner frame units in which there is a differently structured elongate element forming the channel for holding the masonry slips 2, and in particular one with a different upper lip, will be conceivable, wherein the concept of providing the missing end section to this different upper lip will be equally beneficial. If, for example, a simple straight upper lip were provided at the corner region, this would still benefit from the missing section when accepting the angled masonry slip 31. To this end, the specific form of the upper lip of the frames either side of the corner is not relevant for the improvement that this missing section provides when loading slips.

Figure 11:
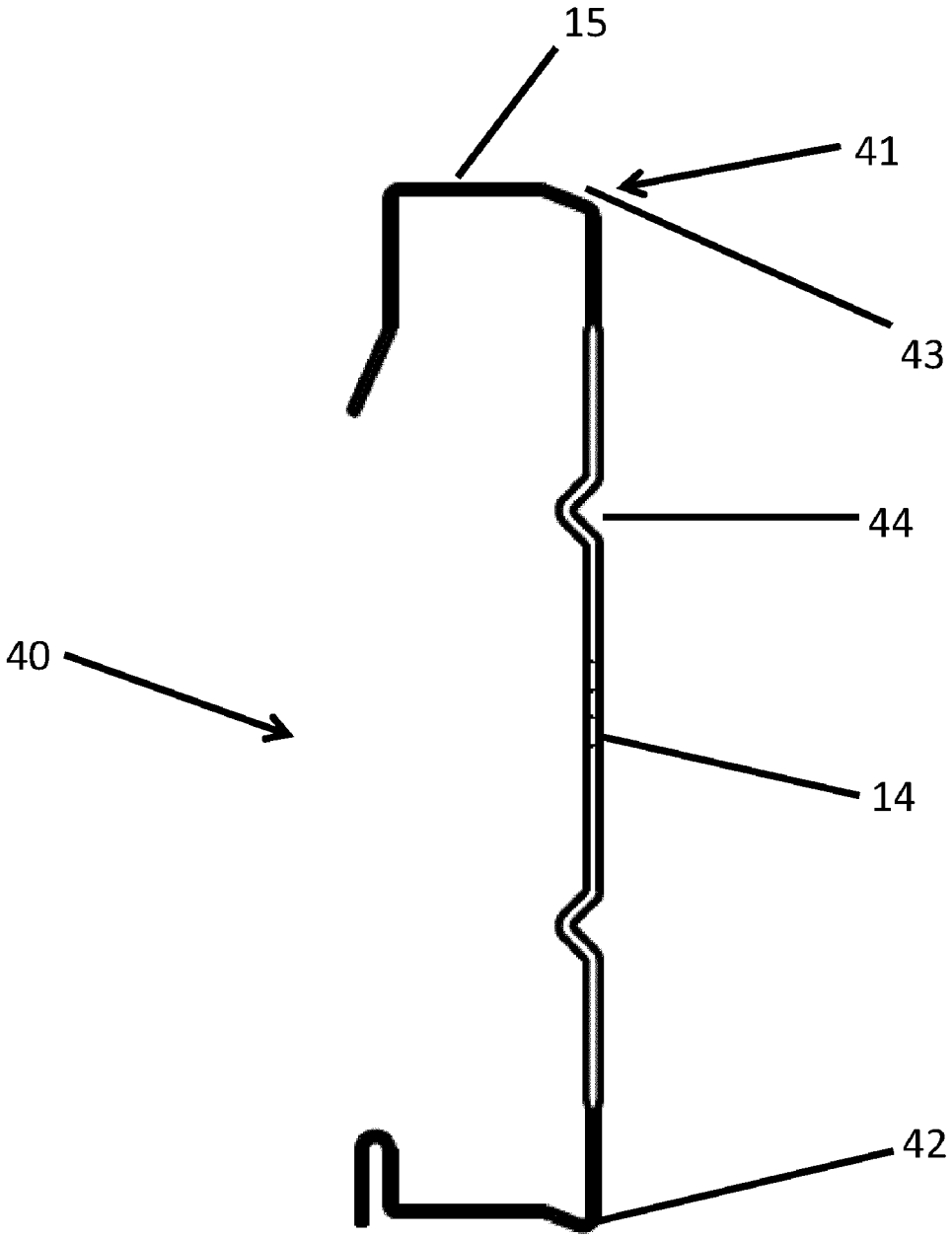
FIG. 11 shows a cross-section of a second frame

Looking at FIG. 11, a modified, second frame 40 is shown. The second frame 40 is very similar to the frame 10 shown in FIGS. 4*a* and 4*b*, and only differs in a few aspects. The above description relating to the uses and combinations of frame 10 into masonry framework 1 and the like, are equally applicable to the second frame 40, wherein second frame 40 only differs with regard to the provision of angled sections 41 between the back plate 14 and the extensions 15. All other aspects related to the frame 10 described in relation to FIGS. 4*a* and 4*b* are the same in the second frame 40. When using the term "second frame 40", it is to be understood that the second frame 40 is interchangeable with the discussion above relating to frame 10. All aspects discussed in relation to frame 10 which do not contradict the following discussion of the second frame 40, are considered to be explicitly included in the second frame 40: the second frame 40 can be integrated into each of the masonry frameworks 1 and pre-fabricated masonry panels 4, as well as the corner structures given if FIGS. 9 and 10.

Figure 12:
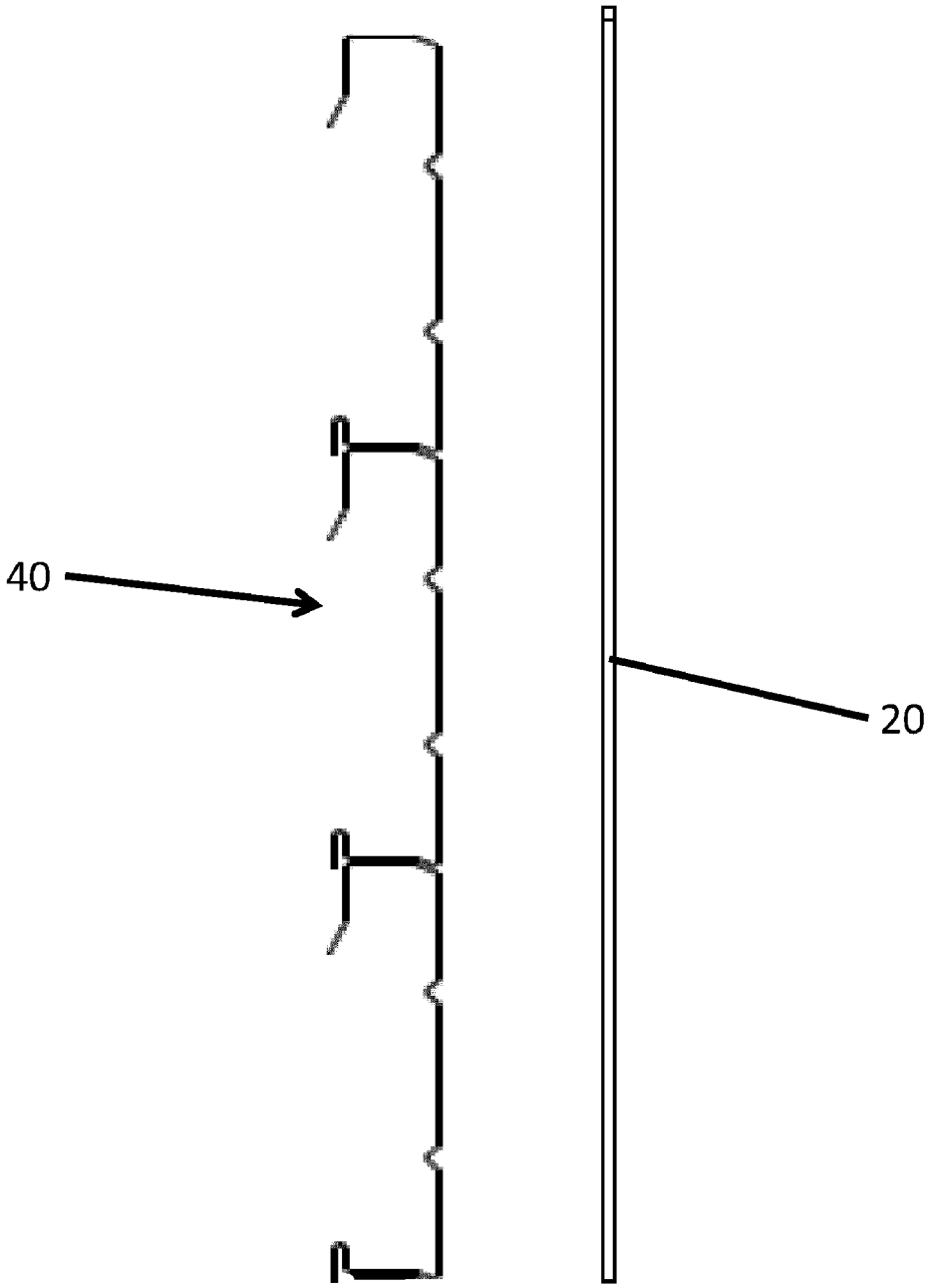
FIG. 12 shows a cross-section of multiple second frames as shown in FIG. 11 with a jointing plate

The primary difference, as highlighted above, between the second frame 40 and frame 10 relates to the provision of angled sections 41 between the back plate 14 and extensions 15, such that the extensions 15 do not align with the ends of the back plate 14. As seen in FIG. 11, the back plate 14 forms the rear side of the second frame 40; angled sections 41 extend away from the back plate 14 in generally the same direction as each other, at the upper and lower edges of the back plate 14. The angled sections 41 extend away from the back plate 14 at an angle which is not 90° with respect to the back plate 14. The first of the angled sections 41 creates at the lower end of the second frame 40 a flange 42, the second of the angled section 41 creates a void 43 at the upper side of the second frame 40. The flange 42 extends to the same extent that the void 43 provides a gap when adjacent second frames 40 are aligned as shown in FIG. 12. FIG. 12 shows three second frames 40 aligned along their lower extensions 15, wherein the flange 42 of the upper second frame 40 slots into the void 43 of the upper extension 15 on the lower, adjacent second frame 40. This interlocking between the flange 42 and void 43 tends to push each of the adjacent second frames 40 backward against the jointing plate 20, as can be seen on the exploded view shown in FIG. 12. The two angled sections 41, defined as the flange 42 and void 43, ensure that the entirety of the back plate 14 lies flush with the jointing plate 20 to improve the final structure of the masonry framework 1. It will be appreciated that the drainage holes 26 as shown in FIG. 8*b* will be positioned in the lower flange 42 of the second frame 40, such that moisture within the second frame 40 can escape out of the second frame 40 in the same manner as described above with respect to frame 10 and as shown in FIG. 8.

The back plate 14 can be provided from a thicker material than the extensions 15 and other features of the frame 40, as shown in FIG. 11. The thicker section of the back plate 14 increases the rigidity of the second frame 40, and thus improves the accuracy of the final masonry framework 1. The thicker section of the back plate 14 is not limited to the second frame 40 and may also form a feature of the frame 10. Stiffening folds 44 can be provided in the thick section of the back plate 14 of the second frame 40. The stiffening folds 44 add additional rigidity to the second frame 40, thus ensuring that this does not bend when being combined into the masonry framework 1, and in particular improves the strength of the second frame 40 in the masonry framework 1 when pre-loaded with appropriate masonry slips 2. Once again, the stiffening fold 44 can be applied to the frame 10 without the angled sections 41.

Figure 13A:
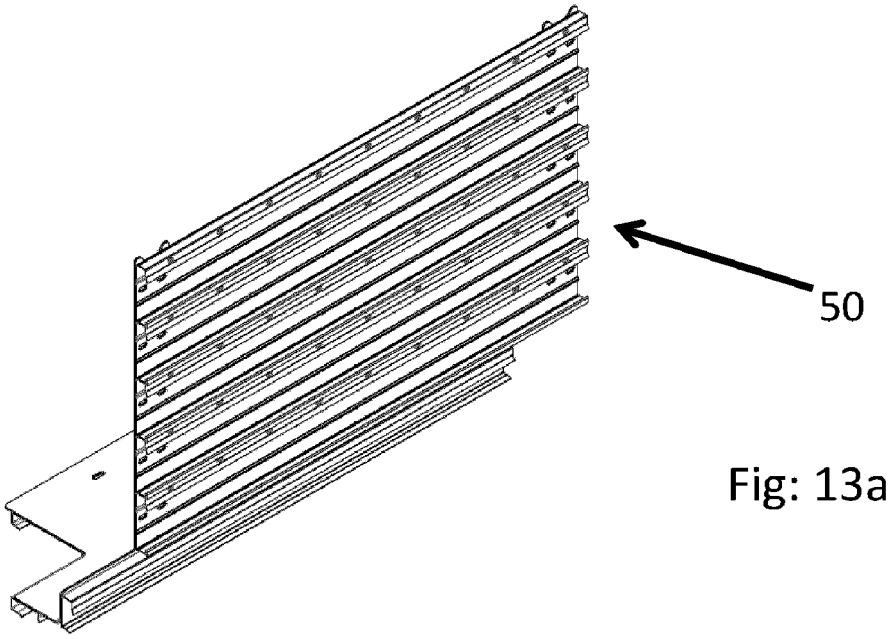
FIG. 13*a* shows a soffit framework
Figure 13B:
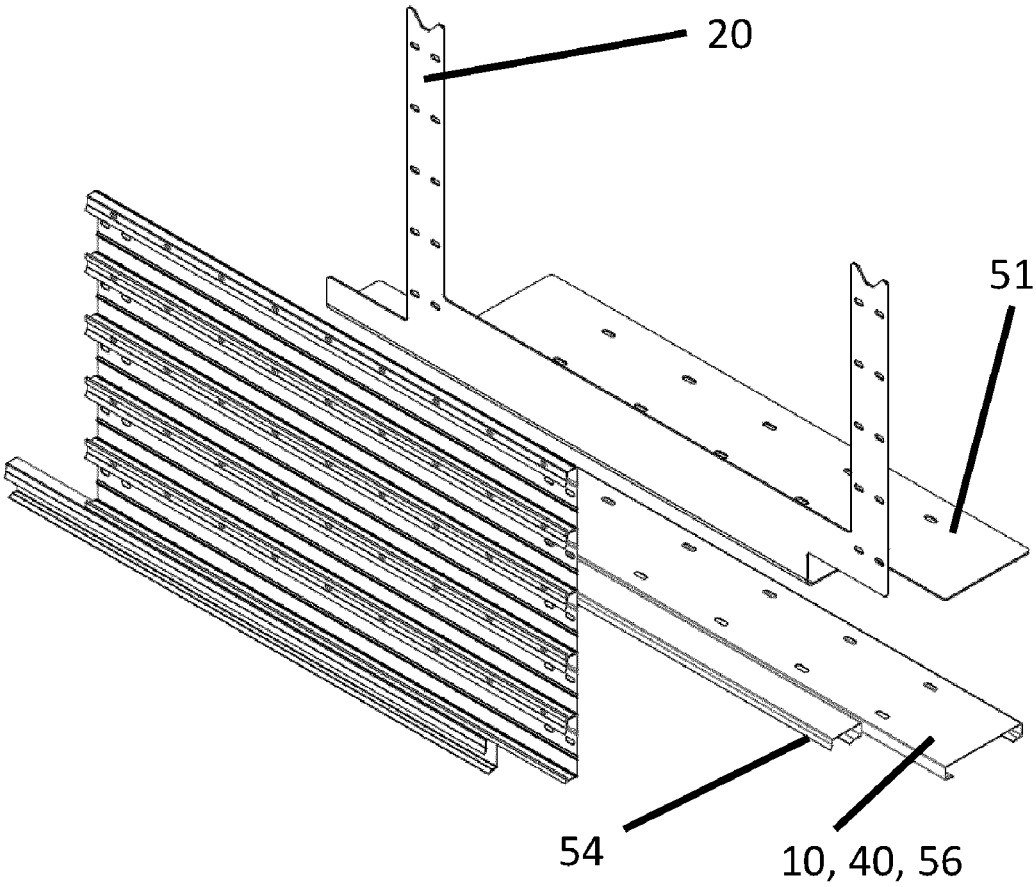
FIG. 13*b* shows the soffit framework of FIG. 13*a* in an exploded view
Figure 13C:
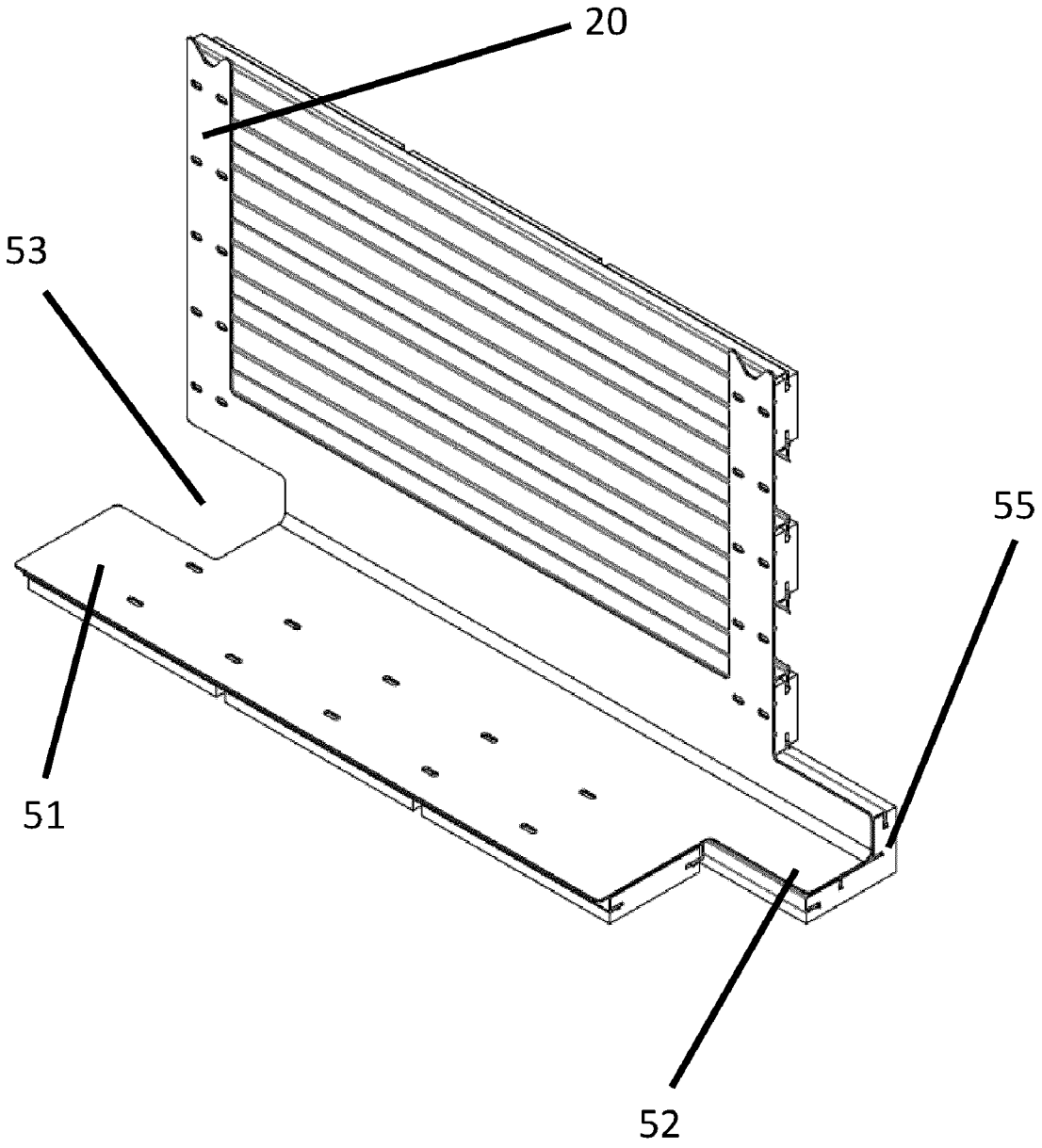
FIG. 13*c* shows the rear of the soffit framework shown in FIG. 13*a* with slips therein

In certain housing designs it will also be desirable to provide a soffit out of brickwork as an overhang or, perhaps, within a porch or atrium of a building. In normal brickwork, this is achieved by cementing or mortaring in bricks, perhaps also by attaching said bricks to an underlying structure which ensures that the bricks cannot fall out into the space underneath the soffit. The present disclosure also incorporates the structure appropriate for making a soffit, and a soffit panel 50 can be seen in FIGS. 13*a* to 13*c*. The soffit panel 50 is provided with a masonry framework 1 as described above forming a vertical structure; as can be seen in FIG. 13*c*, adjacent frames 10 or second frames 40 are held in side-by-side alignment in the masonry framework 1 by means of the jointing plates 20. In the following description, it is clear that either the frames 10 or second frames 40 can be used interchangeably, and whilst the discussion will focus for simplicity on the frames 10—no limitation should be inferred from this choice of wording and the second frames 40 are equally usable.

As is seen in FIG. 13*c*, the jointing plates 20 are attached to, or form part of, a soffit panel 50 framework. The jointing plates 20 are provided with a soffit extension 51 which extends from the lower portion of the jointing plates 20 in a direction out of the plane of the masonry framework 1 attached to the jointing plates 20, generally in the rearward direction of the masonry framework 1. In the description of the soffit panel 50 in FIG. 13*a*-13*c*, the soffit extension 51 extends approximately 90° away from the jointing plates 20. The soffit extension 51 provides the associated structure to which frames 10, or as described in more detail below bed channel frame 56, can be attached, in order that appropriate slips can be held within said frames 10 to provide the soffit. Whilst the choice of frame 10, second frame 40 or bed channel frame 56 for forming the soffit is open, for simplicity the following discussion will use frame 10; no limitation should be inferred from this. Further, as will be discussed at least with respect to FIG. 16*c*, a bed face slip 59 can be used to form the soffit underside, in particular in combination with a bed channel frame 56. Frame 10 will fit on the underside of the soffit extension 51 as shown in FIG. 13*b*, and can thus hold masonry slips 2 therein to generate the final soffit facia. The soffit extension 51 is provided with fixing means which will attach to the frame 10, holding this is in appropriate alignment and position on the soffit extension 51 to allow for safe connection and integration with the masonry slips 2. Whilst FIG. 13*b* shows a separate frame 10 attached to the soffit extension 51, it is also possible for the soffit extension 51 to be structured to provide the relevant features of the frame 10, thus providing an integrally formed soffit extension 1 with appropriate fitments for the masonry slips 2. In FIG. 13*b*, instead of having the separate frame 10 attached to the soffit extension 51, the soffit extension 51 would simply provide the necessary structure into which the masonry slips 2 can be located.

Figure 15:
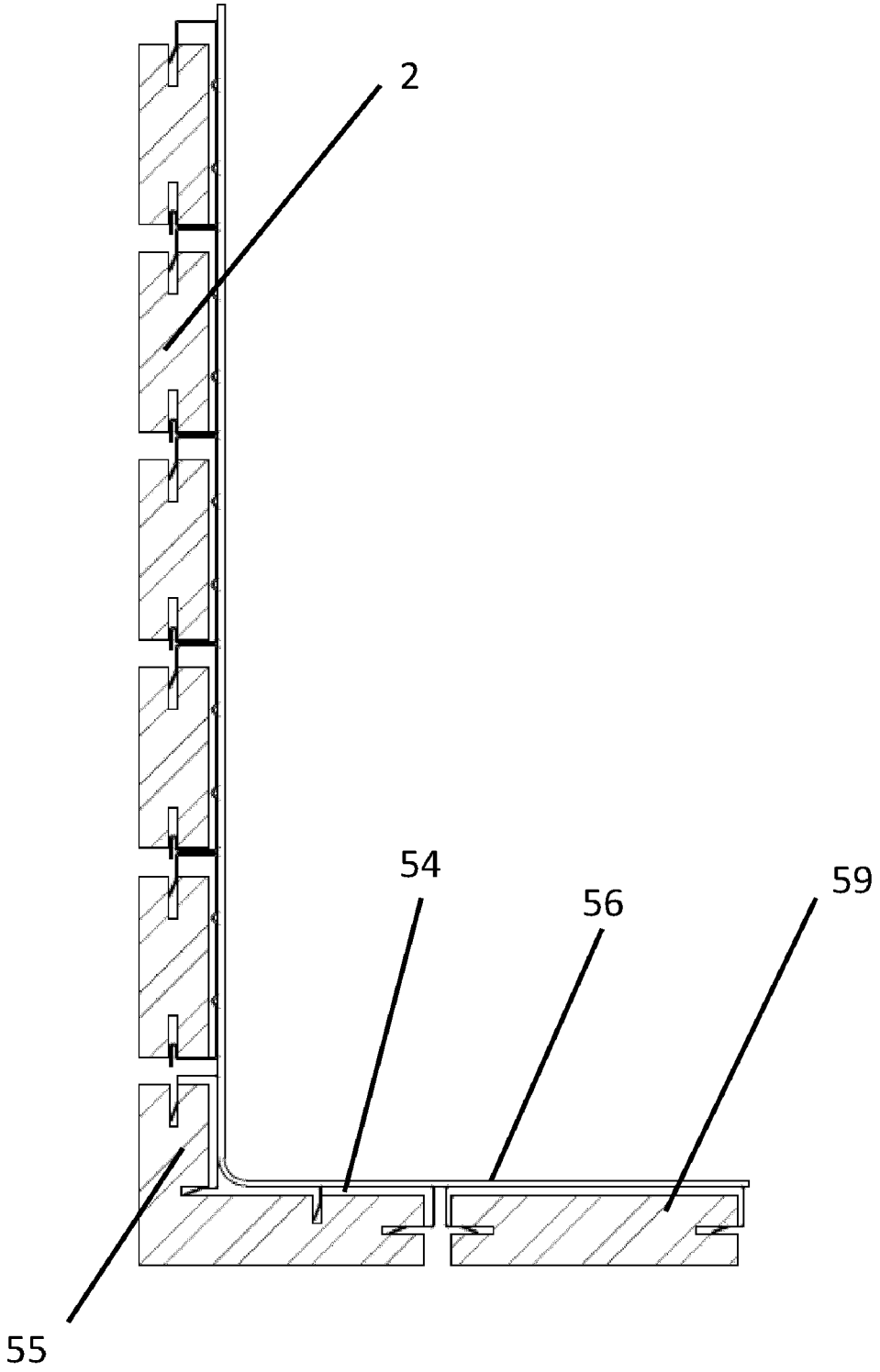
FIG. 15 shows a cross-sectional view of the soffit framework shown in FIG. 13*c*

As a brick which would be seen in a normal brick wall soffit structure will show both its front and lower face bridging from the vertical to horizontal section of the soffit, it is also necessary to provide an appropriate soffit transition slip 55. The soffit transition slip 55 can be seen in FIGS. 13*c*, 15 and 16*d*. FIG. 15 shows a cross-section through a soffit panel 50 which is loaded with masonry slips 2, a soffit transition slip 55 and a bed face slip 59; FIG. 15 clearly shows the structure of both the frames 10, jointing plate 20, extension 51 and appropriate masonry slips 2 and soffit transition slip 55. In order to securely hold the soffit transition slip 55 into the soffit panel 50, the soffit panel 50 comprises one or more soffit rails 54. FIGS. 13*b* and 15 clearly show the positioning of the soffit rails 54. It is anticipated that a first soffit rail is located at the lower edge of the vertical masonry framework 1, with a second soffit rail 54 being positioned on the underside of the soffit extension 51. The soffit rails 54 provide appropriate extensions and lips which provide enough interaction with appropriate slots on the soffit transition slip 55, to hold the soffit transition slip 55 within the soffit panel 50. As can be seen from the cross-section of the soffit rail in FIG. 15, the soffit rail 54 comprises a structure similar to that of the frame 10, however the soffit rail only comprises the same structure for the upper lip 11 comprising the straight section 16 at the end of the extension 15 with the angled end portion 17, as seen in frame 10. This combination of features provides the same advantage of firmly holding the soffit transition slip 55 in place, as described above for the frame 10 and masonry slip 2. The second extension of the soffit rail 54, is provided with a straight section and a further angled portion which extends in the direction away from the above-described straight portion 16 and angled end portion 17; in this manner, the soffit rail 54 differs from the frame 10. As will be seen in FIG. 15, the soffit rail 54 is also generally narrower that the frame 10, and has a height which will be approximately half that of the frame 10.

In order to properly hold the soffit transition slip 55 around the edge between the vertical and horizontal sections of the soffit, a first soffit rail 54 is positioned at the lower edge of the masonry framework 1, with the upper lip abutting the lower extension of the adjacent frame 10. As shown in FIG. 15, it is also possible for a small gap to be positioned between the first soffit rail 54 and the adjacent frame 10, thereby ensuring a proper alignment between each of the masonry slips 2 and the soffit transition slip 55. The lower extension of the soffit rail 54 thus extends outward away from the soffit extension 51 at approximately the same height thereof, such that this may fit with a slot of the soffit transition slip 55. A second soffit rail 54 can be used on the underside of the soffit extension 51, and this will be located such that the upper extension 15 is located at the relevant position to hold the soffit transition slip 55 on the underside of the soffit. Once again, the soffit transition slip 55 is provided with appropriate slots, as best seen in FIG. 16*d*, into which the relevant structure, primarily lips, of each soffit rail 54 may be locate to hold the soffit transition slip 55 firmly in place. In will be appreciated that the angled end portion of the upper lip and the angled section of lower extension will firmly grip each of the slots of the soffit transition slip 55, holding the soffit transition slip 55 in the desired position with the soffit panel 50. On the underside of the soffit extension 51, the frame 10 aligns appropriately with the top edge of the soffit rail 54 to allow continuation of the soffit.

The bed channel frame 56 as mentioned above, is detailed in FIG. 15; the bed channel frame 56 comprises a back plate for attaching to the underside of the soffit extension 51 with two extensions at either side thereof, each extension having a lip extending at an angle from the end of the extension toward each other so as to fit within the slots of a bed face slip 59. The width of the bed frame will be chosen to accommodate the bed face slip 59, so as to hold the bed face slip 59 properly in position by means of the two extensions and extending lips. The extending lips may also be provided with angled sections in the same manner as the upper lip 11 of frame 10, thus firmly holding the bed face slips 59 in position. Use of the bed channel frames 56 with the bed face slips 59 is a little different from that described above with regard to masonry slips 2 and the frames 10 as seen in FIG. 5. The bed channel frames 56 allow for the bed face slips 59 to be slidably engaged therewith, wherein the bed face slip 59 is positioned and slid along the interior side of the back plate of the bed channel frame 56 with the two lips held within each of the slots of the bed face slip 59.

As the soffit transition slip 55 and bed face slips 59 must be slidably engaged with the soffit rails 54 and bed channel frames 56, the soffit panel 50 is provided with an offset flange 52 and offset void 53. The offset flange 52 and offset void 53 can most clearly be seen in FIG. 13*c*, wherein when multiple soffit panels 50 are located in side-by-side arrangement, the offset flange 52 fits within the offset void 54 to make a complete facia with soffit. In this manner, it is possible for a pre-loaded soffit panel 50 to be provided, wherein the soffit transition slip 55 of one soffit panel 50 is located on the offset flange 52 and fits within the offset void 53 of the adjacent soffit panel 50 to make the complete facia panel with soffit. Without the offset flange 52 and offset void 53, it would be necessary to affix each of the soffit transition slips 55 in a slidable manner within the complete run of the soffit after fixing each of the soffit panels 50 into the final building facia. Multiple soffit panels 50 can be attached to the building fully loaded with masonry slips 2, soffit transition slips 55 and bed face slips 59, thus dramatically increasing the speed of construction on the work site itself.

Figure 14A:
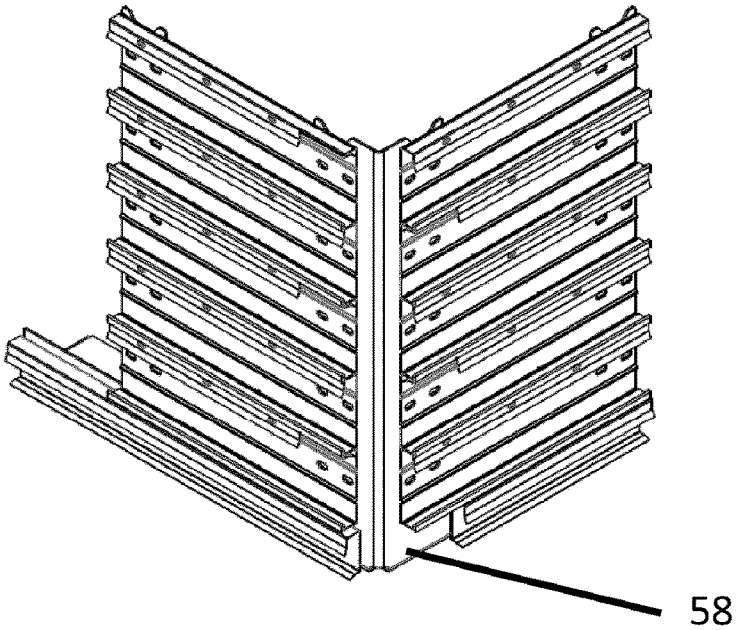
FIG. 14*a* shows a corner soffit framework

In the same manner as shown in FIG. 9, it is also possible to provide a soffit framework in a corner region. FIG. 14 shows a corner soffit panel which comprises many elements similar to the soffit panel 50 described with reference to FIG. 13. The corner soffit panel comprises the corner jointing plates 23 and the jointing plates 20 as seen in FIG. 9*b*, wherein these are also provided with a corner extension 57 in the same manner as the soffit panel extension 51 described in FIG. 13*c*. The corner soffit extension 57, best seen in FIG. 14*c*, provides the same function as the soffit extension 51 described above, however this fits on the rear side of the corner jointing plate 23 and the two jointing plates 20. FIG. 14*c* shows that the two jointing plates 20 may be integrally formed with the corner jointing plate 23, with the corner soffit extension 57 extending outwards from the jointing plates 20 and corner jointing plate 23 to provide the soffit. Alternatively, each of the elements can be individually provided and attached to each other to provide the corner soffit panel. FIG. 14*c* further shows that at least one of the sides of the corner soffit panel is provided with the offset flange 52, so that this section of the corner soffit panel can integrate with a neighbouring soffit panel 50 as shown in FIG. 13*c*. Whilst not shown in FIG. 14*c*, the left-hand side of the corner soffit may also be provided with the appropriate soffit offset void 53, so that the offset flange 52 of the neighbouring soffit panel 50 may appropriately abut and make a complete corner soffit.

Figure 14B:
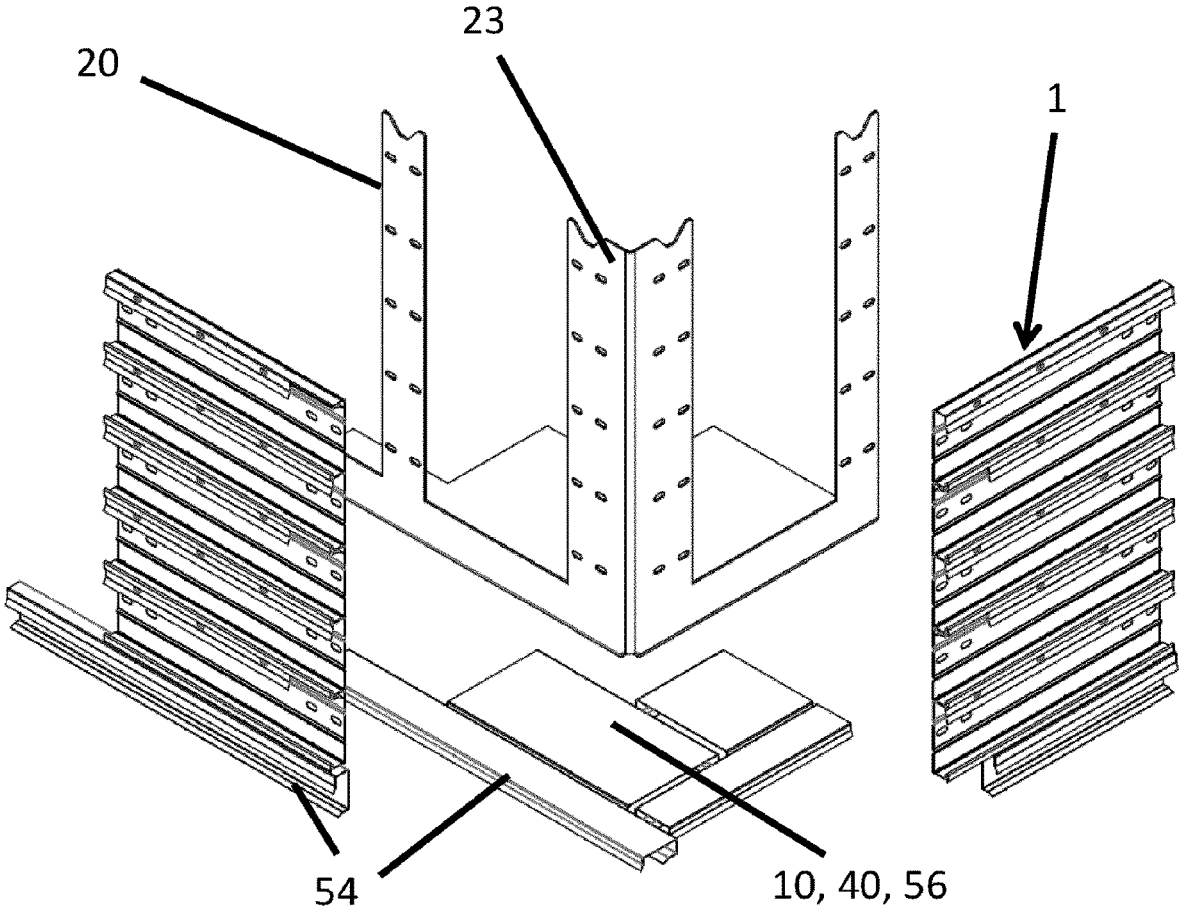
FIG. 14*b* shows the corner soffit framework of FIG. 14*a* in an exploded view
Figure 14C:
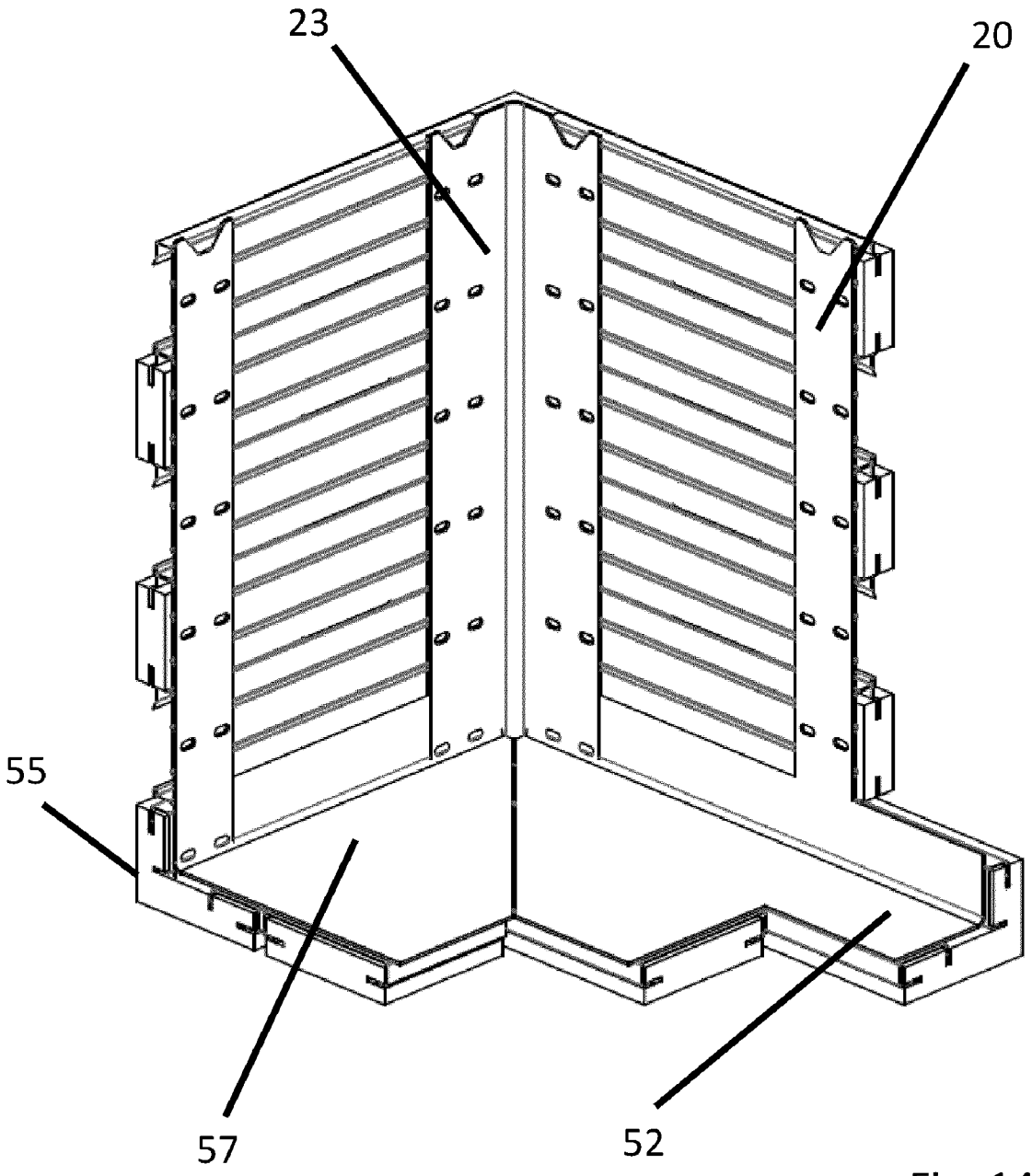
FIG. 14*c* shows the rear of the corner soffit framework shown in FIG. 14 a with slips therein

FIG. 14*b* shows the placement of the soffit rails 54 on both facias of the masonry frameworks 1 either side of the corner, and further on respective undersides of the corner soffit extension 57 either side of the corner. It will be noted in FIGS. 14*a* and 14*b* that one of the soffit rails 54 does not extend all the way to the end of the masonry framework 1 on one side of the corner. The corner soffit panel thus comprises a soffit gap 58, into which a section of a corner soffit transition slip 61 can be positioned, these are seen in detail in FIGS. 16*h* and 16*i*. The soffit gap 58 allows for the corner soffit transition slip 61 to make slidable engagement with the two soffit rails 54 on one side of the corner, whilst allowing the corner soffit transition slip 61 to also lie flush with the remaining masonry slip and soffit transitions slips 55 in the second masonry framework 1 on the other side of the corner.

In other aspects, the corner soffit panel is primarily two soffit panels 50 according to FIG. 13 positioned next to each other around a desired corner of the building. In the same manner as described above, the corner need not be a 90-degree corner with soffit, but could be any angle as required. The length of the relevant frames 10, soffit rails 54, bed channel frames 56 and the angle which the corner jointing plate 23 makes will be appropriately chosen to accommodate any angle as required. The corner soffit extension 57 as shown in FIG. 14*c* will thus make an appropriate structure bridging the interior between the two masonry frameworks 1, as seen in FIG. 14*c*.

As will be apparent from the above discussion relating to each of the options for the simple masonry framework 1 in FIG. 1, the corner frameworks as shown in FIG. 9, the soffit panel shown in FIG. 13 and the corner soffit shown in FIG. 14, the framework provides a highly versatile system for generating different façades of buildings which mimic the appearance of a brick construction. A number of different slips can be integrated with the relevant frames 10, 40, soffit rails 54 and bed channel frames 56. Each of these slips is intended to mimic the shape of a brick's outer appearance, and given the flexibility available when making brick constructions, a number of different slips must be conceived. The basic principle behind each of the slips is that the resultant façade, when the slips are integrated within the relevant pieces of the framework, will appear like a brick construction. Unlike a brick, however, each of the slips will not be a complete solid form and will be provided with relevant slots for interacting with the lips and other structures present in any of the different frames structures.

Figure 16A:
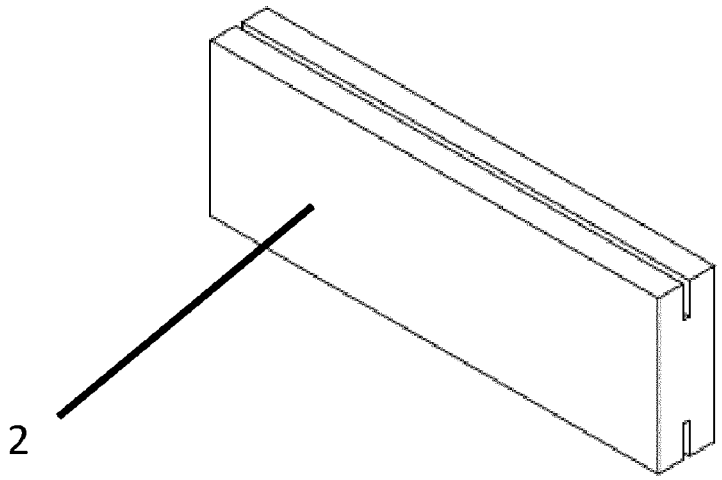
FIG. 16*a* shows a masonry slip
Figure 16B:
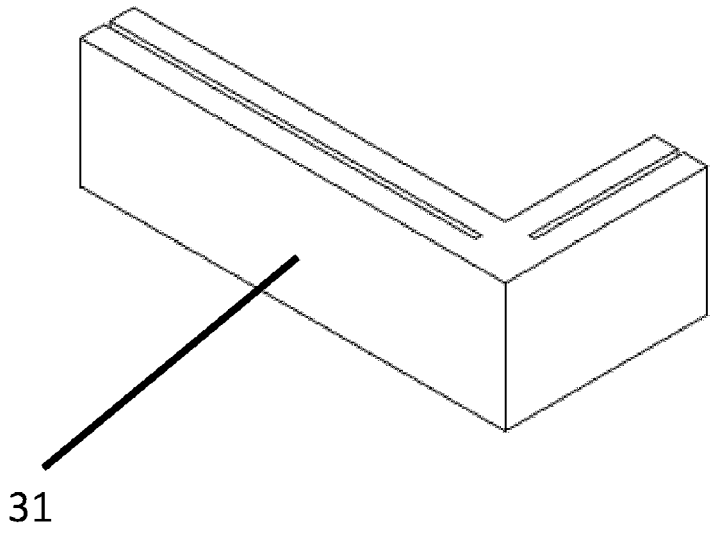
FIG. 16*b* shows an angled masonry slip
Figure 16C:
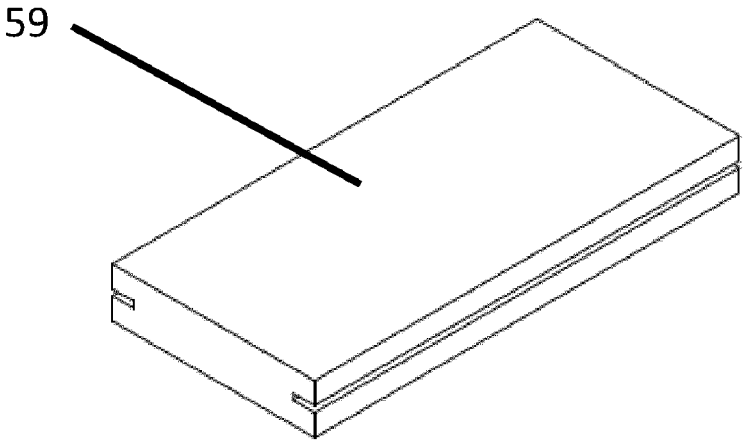
FIG. 16*c* shows a bed face slip
Figure 16D:
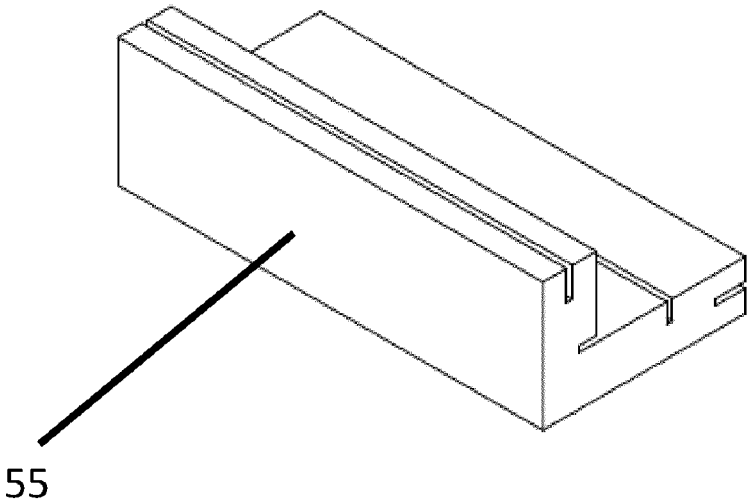
FIG. 16*d* shows a soffit transition slip

FIGS. 16*a*-16*i* provide a number of different designs for slips which can be integrated at different points of the framework options described above. Each of the slips shown, is provided with appropriate slots therein to interact with lips, and the like, which are provided on the relevant framework pieces. FIG. 16*a* presents a simple masonry slip 2 which is intended to form a flat wall type structure and is primarily integrated with the masonry framework 1, as shown in at least FIG. 1. The masonry slip 2 is a side brick structure, with two slots in the upper and lower long edges which will then be held within the upper lip 11 and lower lip 12 of either frame 10 or second frame 40. FIG. 16*b* shows the angled masonry slip 31, wherein this is intended to fit in the corner frameworks as shown in FIGS. 9 and 10. The angled masonry slip 31 can also be integrated with the corner soffit as shown in FIGS. 14*a*-14*c*. As discussed above, the angled masonry slip 31 comprises a longer first section which has generally the same form as the masonry slip 2, however it has a shorter second section which will appear like the end face of a brick when the angled masonry slip 31 is held within the corner framework. The upper edges of the longer and shorter sections of the L-shaped angled masonry slip 31 are provided with slots for integrating with the lips at appropriate portions of the corner masonry panel. It will be appreciated that the upper slot on the shorter section of the angled masonry slip 31 will not engage with the upper lip in the frame 10 or second frame 40, as the frame 10 or second frame 40 will be provided with the gap 30 in order to allow the angled masonry slip 31 to be integrated into the corner. As has been discussed above, whilst the angle shown in FIG. 16*b* between the long and short sections of the angled masonry slip 31 is 90°, this is for example only. The angle may be any chosen angle in order to allow for the final façade to be produced as desired.

With regards to the soffit panel as shown in FIGS. 14 and 15, the positioning of the bed face slip 59 within the bed channel frame 56 provides an appropriate brick structure which looks like the lower portion of a standard brick. The bed face slip 59, shown in FIG. 16*c*, is provided with a larger face than the masonry slip 2; the bed face slip 59 comprises a long side with the same as the length of the masonry slip 2, but has a width which would match the size of a normal brick when in use. The two slots along the longitudinal edges of the bed face slip 59, are structured to fit with the lips shown in the bed channel frame 56 as detailed in FIG. 15.

FIG. 16*d* shows the soffit transition slip 55. This is an angled brick which has a front face which will mimic the size of the side of a brick, and may therefore have the same size as the face of the masonry slip 2. The lower extension making the soffit, as seen in FIG. 16*d*, will have the size of the bed face slip 59 shown in FIG. 16*c*. In this regard, the two elongate structures of the soffit transition slip 55 will match the relevant faces of a normal brick, which the soffit transition slip 55 is designed to replace. The two elongate edges on the soffit transition slip 55 are provided with slots, wherein these will interact with the angled upper lips of the soffit rail 54 as can be seen in the cross-section of FIG. 15. The two slots along the edges of the L-shaped soffit transition slip 55, will allow positioning of the soffit transition slip 55 to match the front face of the masonry panel 4 comprising the masonry slips 2. In order to provide further positional accuracy and to ensure that the soffit transition slip 55 is properly held within the soffit panel, two additional slots are seen which will interact with the angled extensions of the soffit rail 54. The first of these two slots is shown in the inner face of the longer side of the soffit transition slip 55, a second slot extends into the corner region on the interior of the soffit transition slip 55. These two slots will hold the relevant extensions of the soffit rails 54, as shown in FIG. 15. The additional slots provide careful positioning and stability of the soffit transition slip 55, as this is exposed on two sides and is not gripped by any framework at both edges and is thus open to the forces of gravity trying to remove the soffit transition slip 55 from the soffit panel.

Figure 16E:
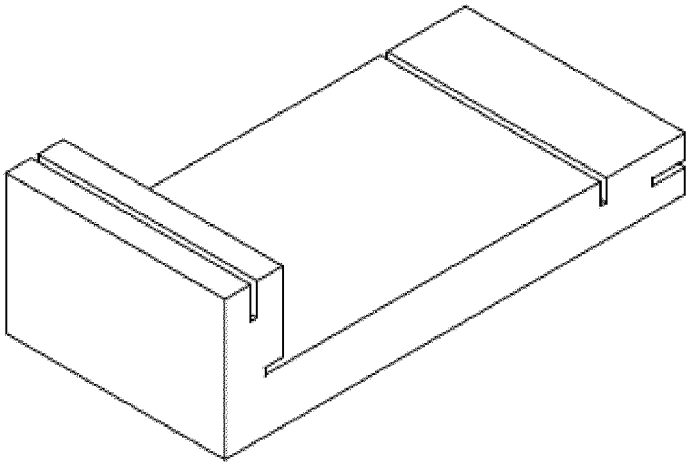
FIG. 16*e* shows a first variant of a soffit transition slip
Figure 16F:
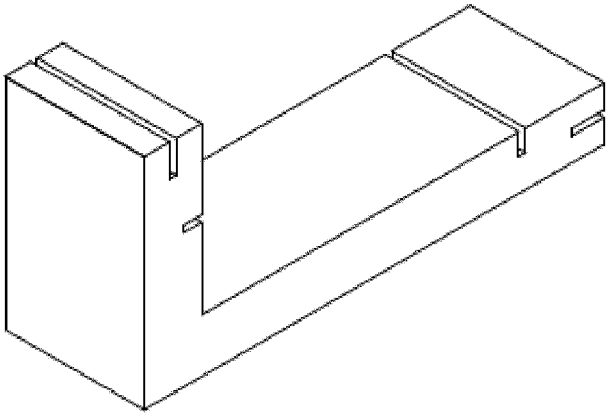
FIG. 16*f* shows a second variant of a soffit transition slip
Figure 16G:
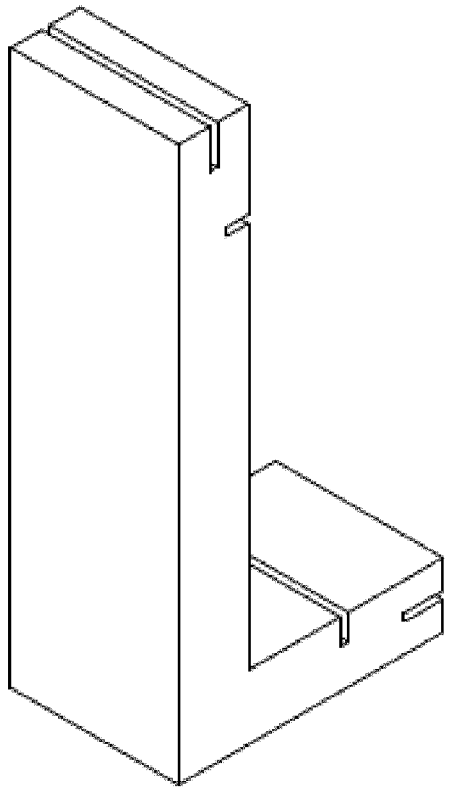
FIG. 16*g* shows a third variant of a soffit transition slip

FIGS. 16*e*, 16*f* and 16*g* show different options for a transition brick structure from a vertical masonry panel to the horizontal masonry panel of a soffit. The specific design of the brickwork may call for the final slips to appear in different orientations than the soffit transition slip 55 shown in FIG. 16*d*. It will be apparent when viewing FIGS. 16*e*, 16*f* and 16*g*, that each of these provides two different faces of an eventual brick in an L-shaped form in order to transition from the vertical panel to the horizontal panel of a soffit. In FIG. 16*e*, the end face of a brick and the lower face of a brick are mimicked by means of this particular slip. The slip in FIG. 16*f* again shows the end face of a brick as well as the side face of the brick, as is seen in the masonry slip 2 shown in FIG. 16*a*. The slip of FIG. 16*f* mimics a brick being positioned in a soffit in a vertical orientation, such that the long side of the brick forms the soffit surface. Finally, the slip shown in FIG. 16*g* shows the side face of a brick and the end face of a brick, quite similar to that in FIG. 16*f*; in FIG. 16*g*, the long side of the brick will be positioned vertically in the vertical masonry panel, and the shorter end face of the brick will form a portion of the soffit. In the same manner as for the soffit transition slip 55, the upper and back edges of the surfaces in the slips of FIGS. 16*e*-16*g* are provided with slots for integrating with the soffit rail 54, as is generally seen in FIG. 15. The additional slots in the inside faces of each of the options shown in FIGS. 16*e*, 16*f* and 16*g*, will interact with the angled extensions shown on the soffit rail 54. In order to produce the different designs on the final wall, the soffit rails 54 either side of the vertical and horizontal portions of the soffit panel will be offset in order to allow attachment of one of the slips from any of FIGS. 16*e*, 16*f* and 16*g*.

Figure 16H:
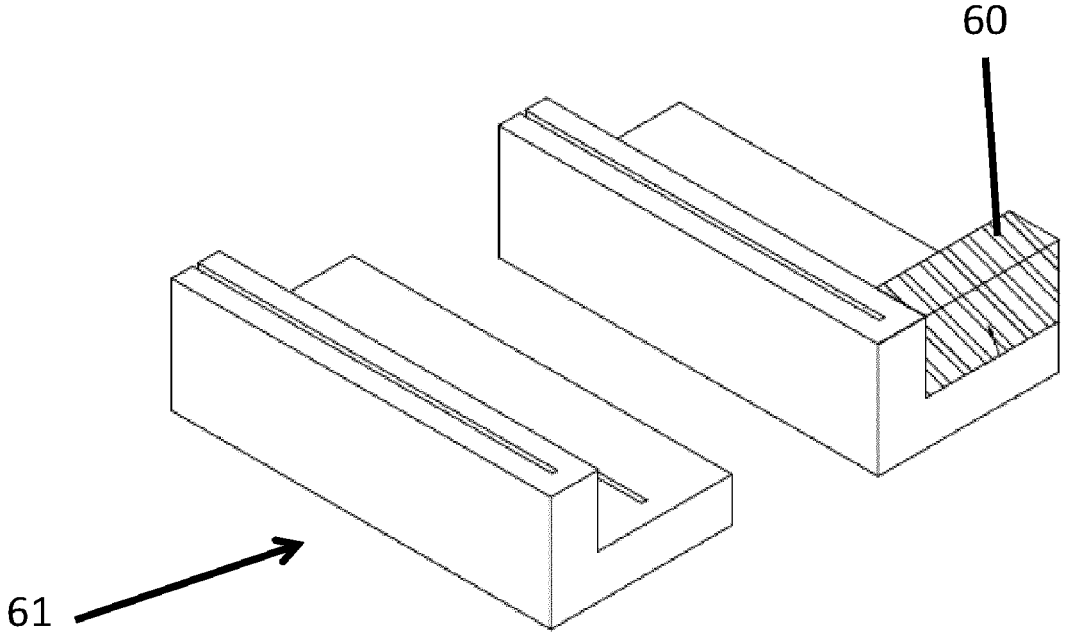
FIG. 16*h* shows a first corner soffit transition slip
Figure 16I:
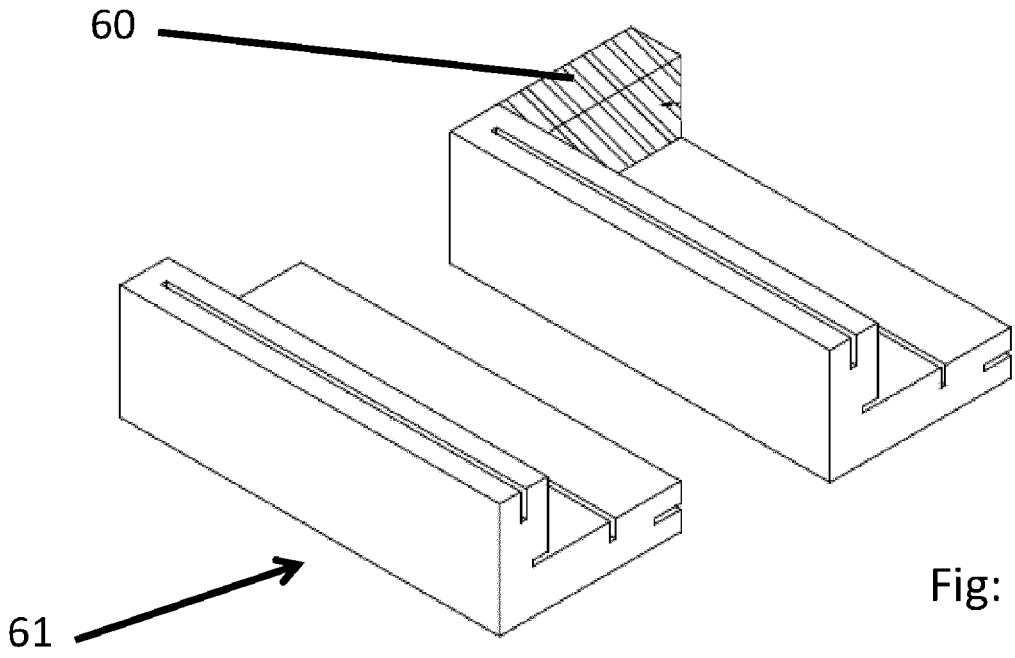
FIG. 16*i* shows a second corner soffit transition slip for attachment in a different orientation to the first corner soffit transition slip of FIG. 16*h*

FIGS. 16*h* and 16*i* show a corner soffit transition slip 61 which is similar to that of the soffit transition slip 55 shown in FIG. 16*d*, however this is intended to be positioned at the corner point of a soffit corner framework. The corner slips shown in FIGS. 16*h* and 16*i* would be located at the corner point as highlighted by reference numeral line 58 in FIG. 14*a*. The corner unit soffit transition slips 61 shown in FIGS. 16*h* and 16*i* can be used with either a right hand or left hand corner, as the brickwork pattern demands. The gap 58 in the corner soffit panel as shown in FIG. 14*a* will coincide with the hashed brick segment 60 which will make up the final third face of the corner soffit transition slip 61, so as to appear like a brick when in use. The slots provided on the corner soffit transition slip 61 coincide with the slots shown on the soffit transition slip 55, however the slots do not extend to the very end of the edges of the corner soffit transition slip 61, so as to not appear in the corner region of a soffit corner panel. Each of the corner soffit transition slips 61 will be slid into the soffit rails 54 as shown in FIG. 14*b*, to make the lower corner point of the soffit complete. The brick segment 60 can then be bonded to the corner soffit transition skip 61 to make a complete looking brick in the corner point of the corner soffit panel. In this way, the end result will appear as though a complete brick is present, rather than the slips of the present disclosure.

The soffit panelling as shown in FIGS. 13 to 15 shows a system of utilising brick slips 2, soffit transition slips 55 and bed face slips 59 integrated with a series of frames 10, 54, 56 to produce prefabricated soffit panelling formed entirely of brick slips 2, 55, 59. There are further circumstances, however, wherein integrating soffit brick skip systems within a building without utilising prefabricated masonry panels 4 is desirable. In certain building constructions, the building is provided with a masonry construction 72 at the interior of the structure, which essentially provides the building, and an exterior masonry or brick work course is provided as the outer wall or façade. In these circumstances, the masonry construction 72 is generally hidden by the outer wall of a normal brick construction typically in the form of a single width brick wall type construction or a single width brick cladding layer which is pinned to the masonry construction 72. In the following this outer brick construction will be termed the external brick cladding 79, although it is to be understood that this is not a limiting term and also covers normal brick walls, perhaps even of multiple brick width, typically being connected or pinned at various points to the underlying masonry construction 72 for stability. When designing a building with an outer brick exterior, there are occasions when an archway or open span is desired in the final construction. Such archways or open spans, may form the entrance to a porch in a building, or the span across the top of a garage door or a window, or other desired opening, in the final outer wall. It will be appreciated that in order to bear the weight of the building above the open span, it is necessary for an underlying structure to be present which carries this weight and distributes it to the wall either side of the span. This distribution of weight means that the side supports carry the weight of the wall above the span, avoiding collapse of the span or undue weight being placed on window constructions, and the like. It is well-known to use lintels, perhaps from wood, concrete, metal or other appropriate load-bearing materials, as support bearing elements which are positioned across the top of the span or opening and are integrated within the side walls. In building constructions where there is an underlying masonry construction 72 and an external brick cladding 79, it is possible to locate a support brace underneath the lowest course of bricks of the external brick cladding 79. This support brace will provide a supporting surface for the lowest course of bricks, and will typically be pinned to the underlying masonry construction 72 to support the external brick cladding 79.

Figure 17:
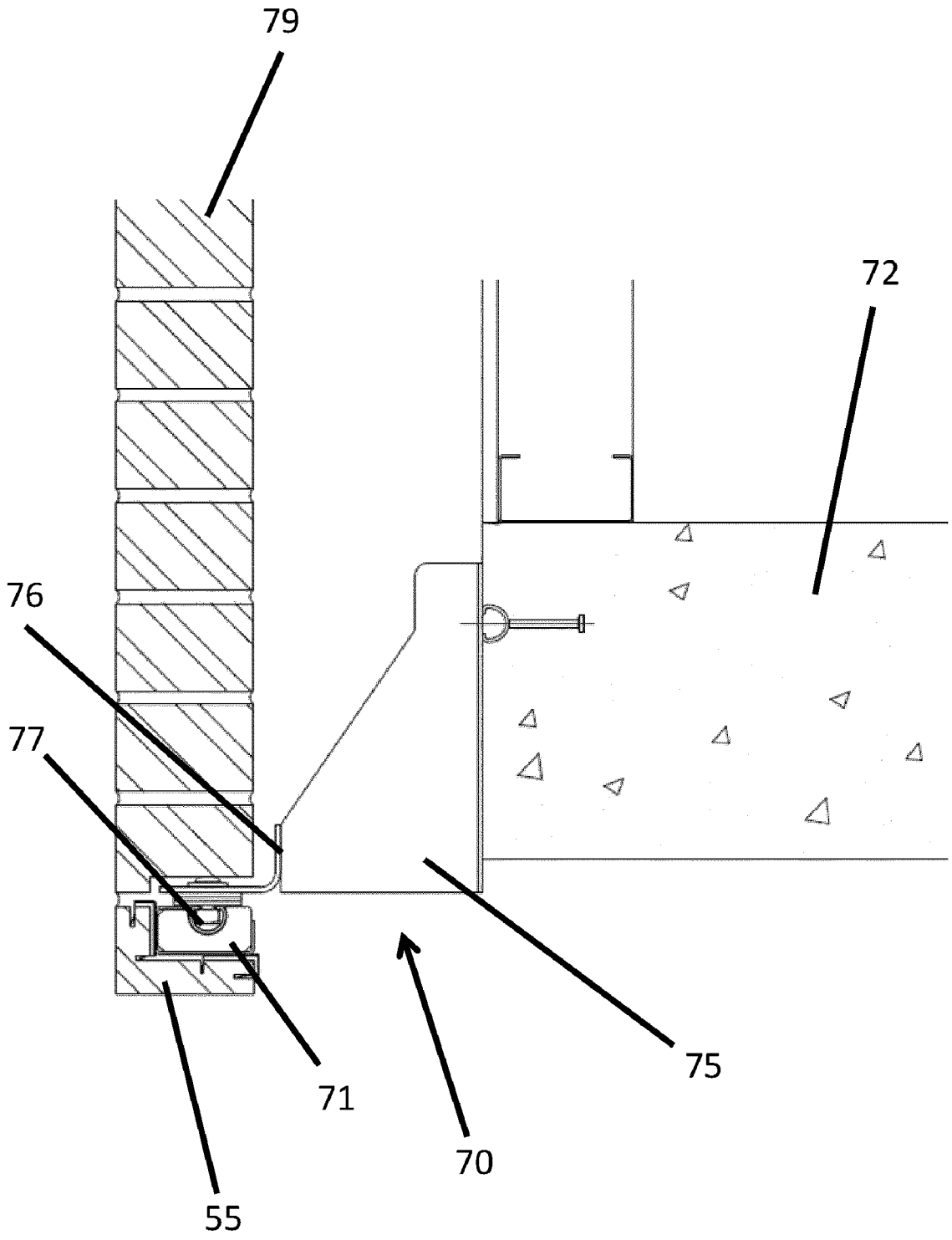
FIG. 17 shows a first design of a masonry support system
Figure 21:
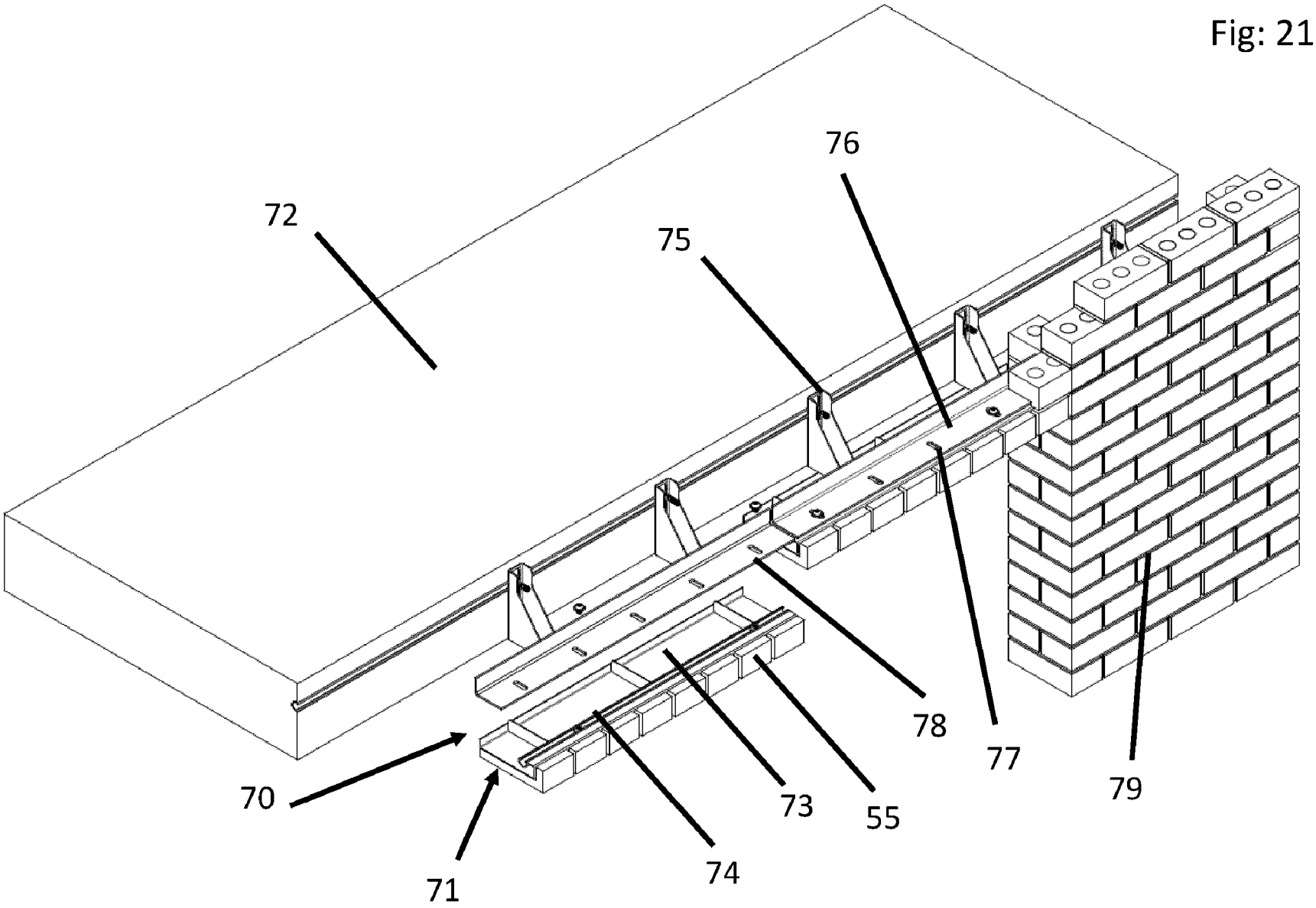
FIG. 21 shows the masonry support panel of FIG. 17 in situ with a building structure

FIGS. 17 and 21 show a masonry support system 70 integrated into a building. FIG. 21 shows a masonry support system 70 of the present disclosure integrated with a course of soffit transition slips 55 making up the lowest brick course above the opening in the external brick cladding 79. FIG. 17 shows the masonry support system 70 in cross-section and how this is connected through to the underlying masonry construction 72. FIG. 17 further shows that the lowest course of bricks which is visible, comprises a row of soffit transition slips 55 integrated with the masonry support system 70.

The masonry support system 70, as seen in FIG. 17 for example, comprises a masonry support bracket 75 which is shaped and adapted to fixably connect to the underlying masonry construction 72. The masonry support bracket 75 provides the appropriate support and pinning of the external brick cladding 79 above an opening or span in said external brick cladding 79. The external brick cladding 79 is spaced apart from the underlying masonry construction 72, the masonry support bracket 75 bridging the gap there-between and terminating with a shelf angle 76. The shelf angle 76 extends away from the outer side, as viewed with respect to the building, of the masonry support bracket 75 and forms a shelf which is positioned underneath the lowest course of standard bricks making up the external brick cladding 79. The shelf angle 76 has a generally L-shaped cross-section, with a 90° angle, or approximately 90° angle, between the shelf portion and a fixing portion used to connect the shelf angle 76 with the masonry support bracket 75. The fixing portion is adapted for attachment to the external side of the masonry support bracket 75, thus suitably fixing the shelf angle 76 to the masonry support bracket 75 and consequently to the underlying masonry construction 72.

The method of connection between the shelf angle 76 and masonry support bracket 75 is not limited, needing only to be sufficiently robust to ensure that upon completion of the external brick cladding 79, the weight of external brick cladding 79 can rest on the shelf angle 76 and be transferred through the masonry support bracket 75 to the masonry construction 72, thus providing appropriate pinning and support of the external brick cladding 79. The shelf angle 76 may be connected to the masonry support bracket 75 by means of nuts and bolts, rivets or by being welded to the masonry support bracket 75. Alternatively, the fixing portion of the shelf angle 76 may be angled or have an angled flange which fits within associated slots on the masonry support bracket 75. In order to properly transfer the weight and forces of the external brick cladding 79 through the shelf angle 76 and the masonry support bracket 75 to the masonry construction 72, the masonry support bracket 75 is designed to be fitted to the masonry construction 72 by means of appropriate load bearing fitments, these may be but are not limited to masonry screws, bolts or rivets, and the like. The primary requirement for attachment to the masonry construction 72, is that the masonry support bracket 75 is firmly connected to the underlying masonry construction 72 and will not readily be disconnected and will thus support the weight of the external brick cladding 79, as required.

As can be seen from FIGS. 17 and 21, each masonry support bracket 75 is generally provided by a backplate which will be positioned next to the masonry construction 72. The backplate is provided with appropriate fitments therein for connection of the masonry support bracket 75 to the underlying masonry construction 72, this perhaps being by means of holes through the backplate to allow connection by means of the masonry screws and the like. In some designs, a further metal channel will be cast into the masonry construction 72 and held firmly within, this providing an appropriate means of fixing the masonry support bracket 75 to the masonry construction 72. The masonry support bracket 75 typically comprises 2 arms extending forward from the backplate which, when in use, extend from the masonry construction 72 toward the external brick cladding 79. The dimensions of these arms are such that the masonry support bracket 75 bridges most of the gap between the underlying masonry construction 72 and the external brick cladding 79. At the outer edge of the lower plane of the masonry support bracket 75, or arms thereof, as viewed with respect to the building, the shelf angle 76 may be connected by welding, removable fixings, by means of the flange and slot or any other suitably load-bearing connection, as described above. The precise spacing and number of masonry support brackets 75 is non-limiting and will be chosen on the basis of the final design: ensuring that the weight of the shelf angle 76 and attached further elements will be properly pinned back to the masonry construction 72. The specific form of the arms of the masonry support brackets 75 is also not limited to those shown in the Figures. It will be clear that an appropriate trade-off of material costs, weight and load-bearing whist bridging the gap from the masonry construction to the external brick cladding 79 will play a part in the final shape and design.

It will be appreciated that the masonry support system 70 as described above properly supports the external brick cladding 79 above the opening, and provides a proper connection of this external brick cladding 79 to the underlying masonry construction 72. If the external construction of the building were to be left as such, the shelf angle 76 would be visible under the lowest row of bricks making up the external brick cladding 79: at the very least this would spoil the aesthetic of the exterior of the building, it may also be undesirable to allow access to the masonry support system 70 from the exterior of the building, and therefore a solution is required to both protect the masonry support system 70 and to improve the final look of the building. To address these issues, the present disclosure provides the bolt-up unit 71 as can be clearly seen in FIGS. 17 and 18. The bolt-up unit 71 provides a generalised framework which can interact with any of the soffit transition slips 55 shown above in FIGS. 16A to 16G. As can be seen clearly in FIG. 18, the bolt-up unit 71 provides an elongate frame with which one or more soffit transition slips 55, of appropriate design and form for the final appearance of the building, can be slidably engaged. The end result of slidably engaging the soffit transition slips 55 with the bolt-up unit 71 is a row of soffit transition slips 55 integrated with the bolt-up unit 71; the bolt-up unit 71 can then be appropriately attached to the underside of the shelf angle 76, to provide the lowest brick course.

FIG. 17 shows the bolt-up unit 71 being provided with a row of soffit transition slips 55 engaged therein, this being connected to the lower portion of the shelf angle 76 to form the final external brick course thereby completing the final look of the external brick cladding 79. It will be appreciated that the bolt-up unit 71 and soffit transition slips 55 positioned therein essentially hang from the underside of the shelf angle 76, thus forming the lowest brick course of the final external brick cladding 79. Once the individual soffit transition slips 55 have been appropriately mortared in place, the final external brick cladding 79 will appear to be a complete brick construction, and the nature of the soffit transition slips 55 will be hidden from external view. This further ensures that the masonry support system 70 will be appropriately hidden from view, thus improving the final aesthetic to the external brick cladding 79 and building in general, as well as appropriately protecting elements of the shelf angle 76 and masonry support bracket 75.

Figure 19:
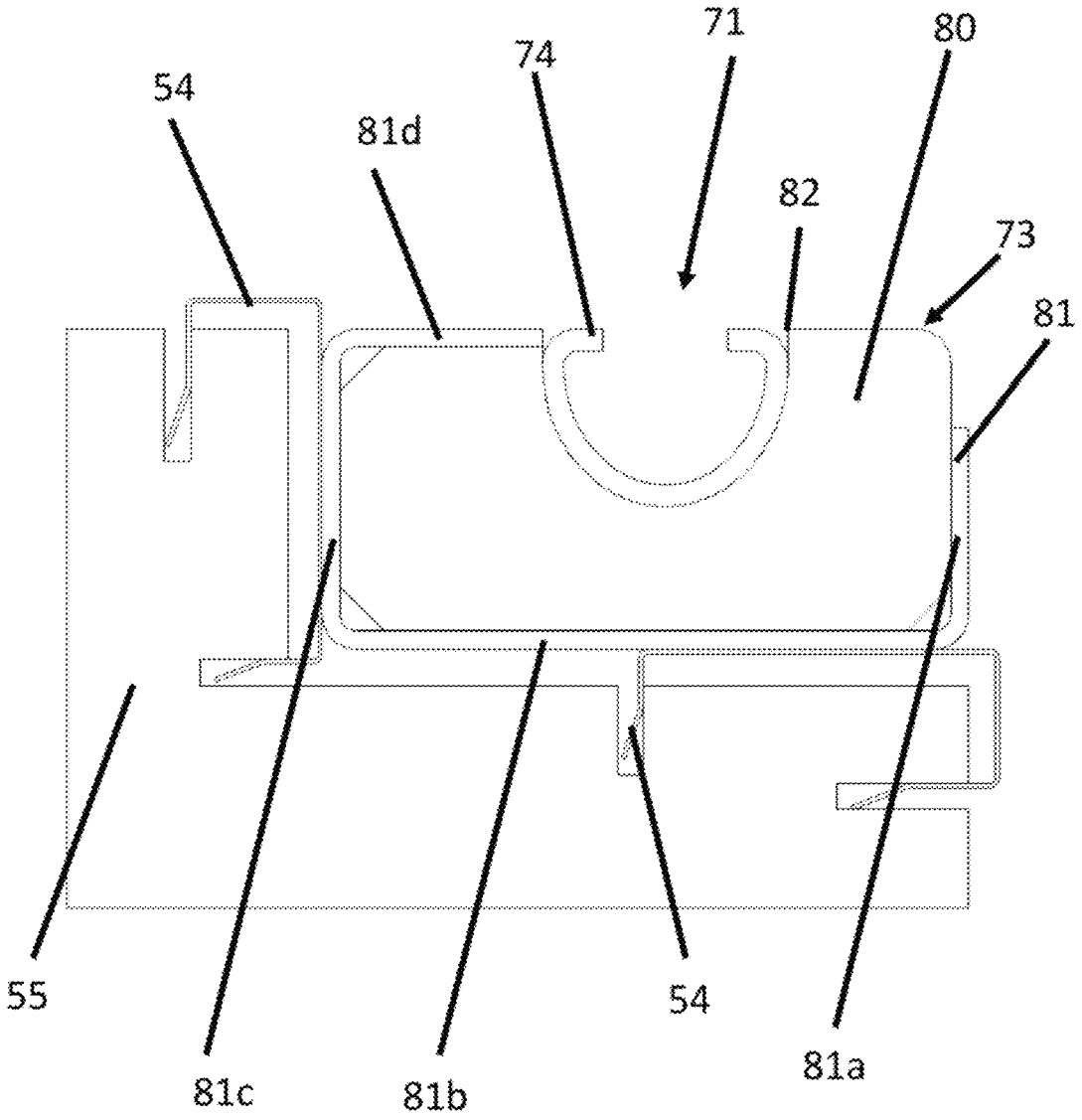
FIG. 19 shows the carrier support of FIG. 18 with a masonry slip engaged therewith

FIG. 19 shows a cross-sectional view of the bolt-up unit 71 shown in FIG. 17. The bolt-up unit 71 comprises a masonry support carrier 73 which has a generally rectangular cross-section, although other shapes are envisaged as necessary. The masonry support carrier 73 comprises an external wall 81 forming the outer surface of the masonry support carrier 73, the upper 81*d* of the external walls 81 being provided with a channel rail 74 to facilitate attachment to the shelf angle 76. The design shown in FIG. 19 shows the masonry support carrier 73 having a lower external wall 81*b* which is provided opposite the upper external wall 81*d* comprising the channel rail 74. The external wall 81 is preferably provided by means of a sheet of appropriate load bearing material which is bent into the final desired cross-sectional shape, typically rectangular. The material making up the masonry support carrier 73, and in particular the external wall 81 thereof, is usually metal in order to provide both the strength required for holding the course of soffit transition slips 55, whilst also being a workable material which can be readily formed into the final desired structure. The bolt-up unit 71 as well as the shelf angle 76 and masonry support bracket 75 are usually made from stainless steel, as this material is both readily workable, has good corrosion resistance and an appropriately high melting point should a fire break out in the building.

Figure 20A:
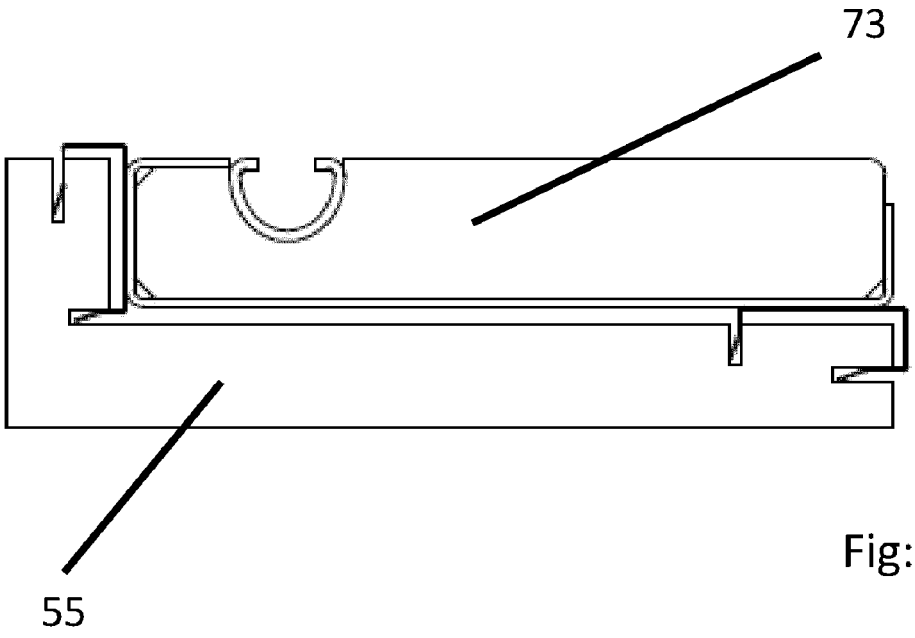
FIG. 20*a* shows a further design of the carrier support of FIG. 18
Figure 20B:
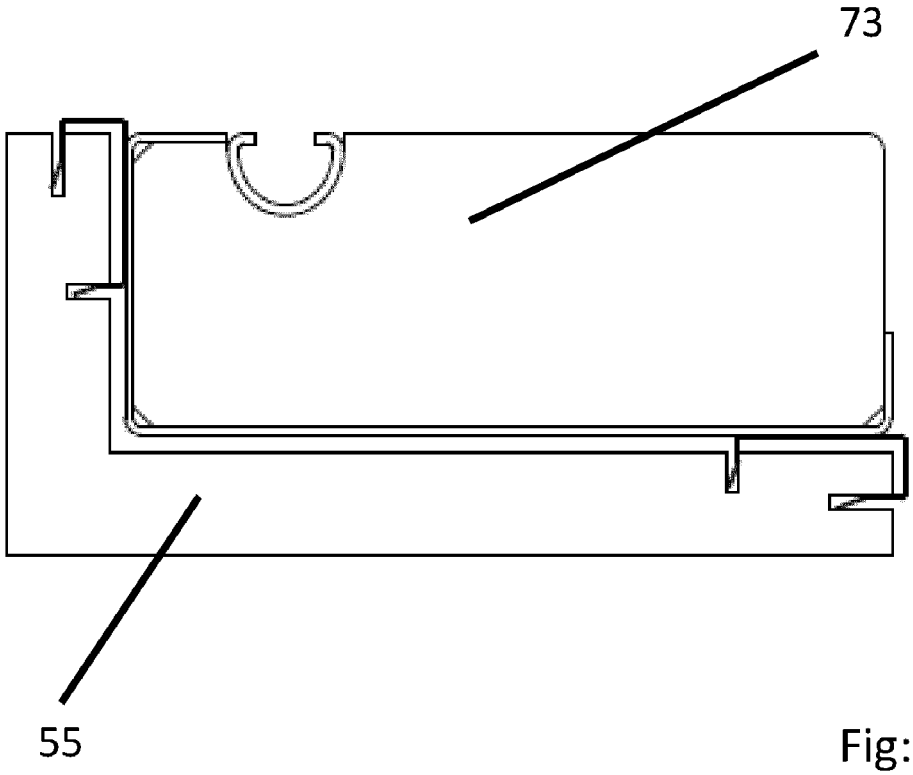
FIG. 20*b* shows a further design of the carrier support of FIG. 18
Figure 20C:
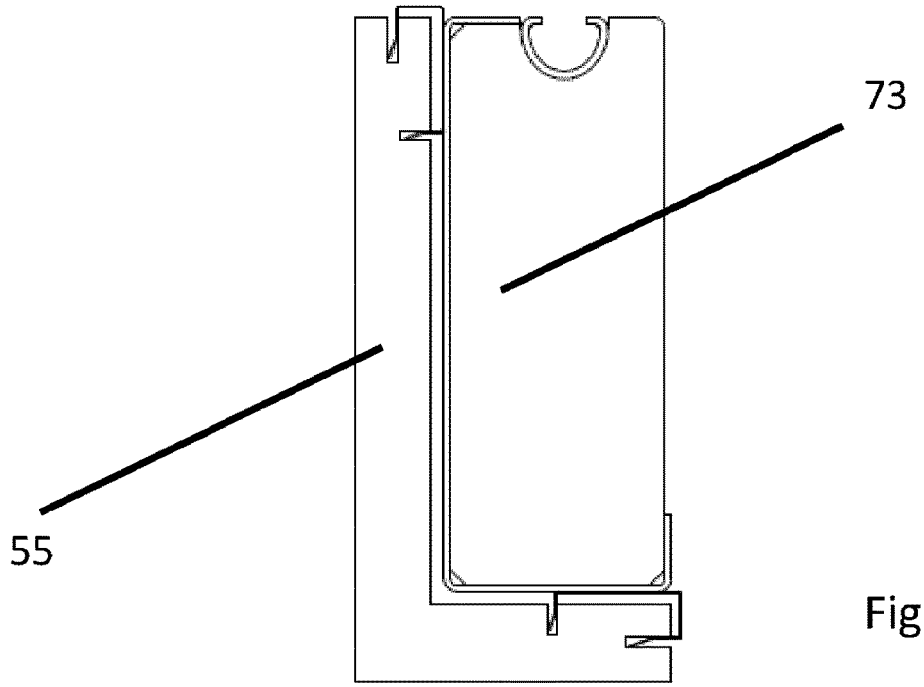
FIG. 20*c* shows a further design of the carrier support of FIG. 18

Looking at the cross-section of the masonry support carrier 73 shown in FIG. 19, the lower external wall 81*b* and front facing external wall 81*c* are each provided with soffit rails 54 as described above. The soffit rails 54 are positioned so as to interact with the slots on the soffit transition slip 55, as described above for the full brick slip façade design, the soffit rails 54 being appropriately connected to the lower external wall 81*b* and forward external wall 81*c*. The soffit rails 54 are connected to the masonry support carrier 73 in any suitable manner, however welding or attachment by means of riveting or bolts is appropriate. The overall external form of the masonry support carrier 73 is chosen so as to position the soffit rails 54 at appropriate locations for integrating with the slots provided on each of the soffit transition slips 55. As will become apparent when viewing FIGS. 20*a*, 20*b* and 20*c*, numerous designs of carriers 73 can be conceived, each exhibiting soffit rails 54 at positions for integrating with the slots provided on the different forms of soffit transition slips 55. The masonry support carrier 73 shown in FIG. 20*a* is suitable for use with the soffit transition slip shown in FIG. 16*c*; the masonry support carrier 73 of FIG. 20*b* is appropriate for the soffit transition slip shown in FIG. 16*f*; the masonry support carrier 73 shown in FIG. 20*c* will integrate by means of the soffit rails 54 with the soffit transition slip shown in FIG. 16*g*.

Figure 18:
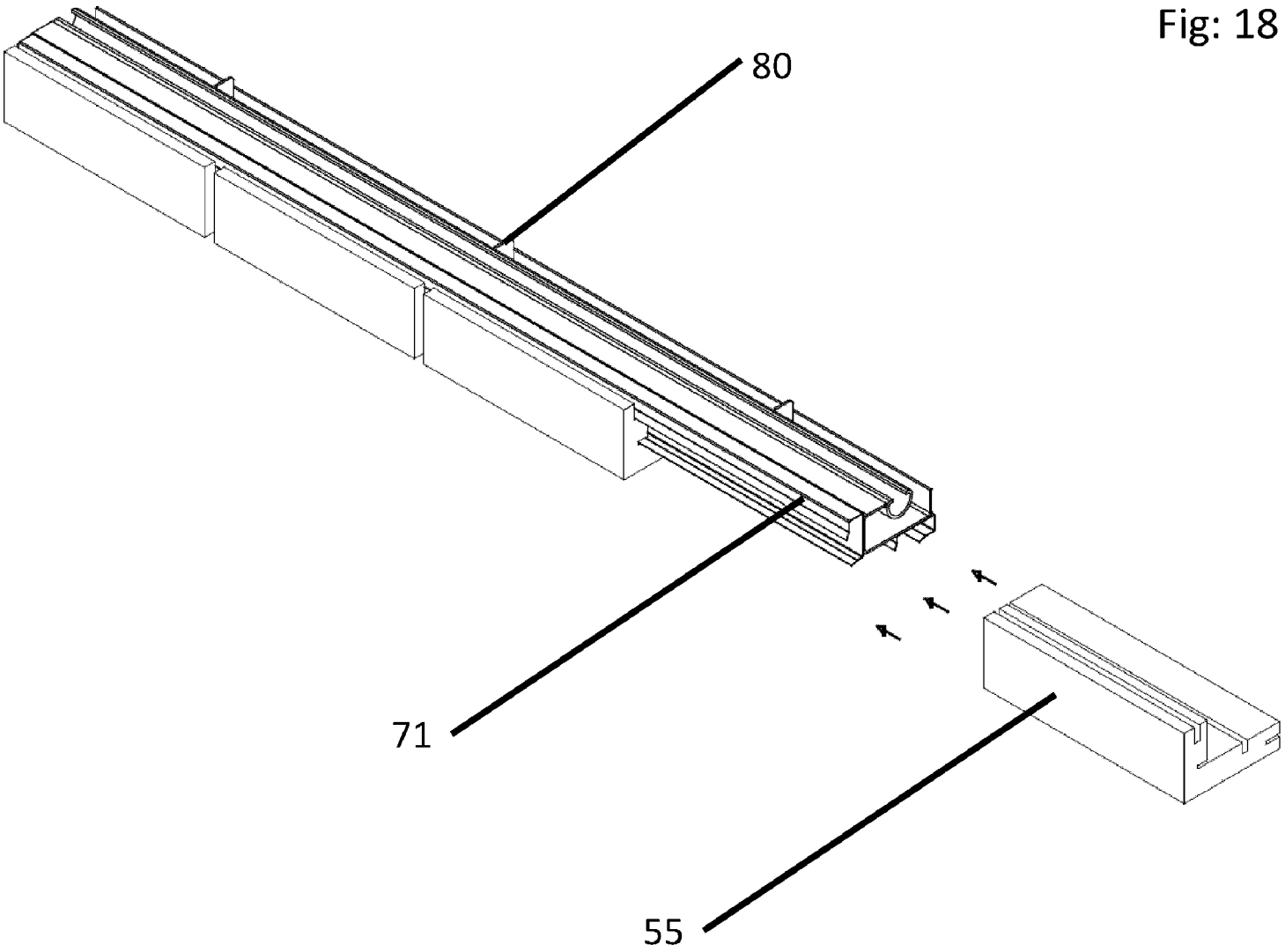
FIG. 18 shows a carrier support for use with the masonry support panel of FIG. 17

When considering the structures of FIGS. 19, 20*a*, 20*b* and 20*c*, the external wall 81 of the masonry support carrier 73 is constructed to match the interior angle of the soffit transition slip 55 and position the channel rail 74 at the upper edge in the upper external wall 81*d* for connection to the shelf angle 76 in the manner shown in FIG. 17. For purposes of reducing the weight and material usage of the masonry support carrier 73, it will be noted that the rear external wall 81*a* need not fully extend away from the soffit rail 54 attached thereto to create a completely enclosed external wall 81 of the masonry support carrier 73. Additionally, the upper external wall 81*d* extends the appropriate distance from the forward external wall 81*c* to the channel rail 74. Having the external wall 81 connect between the channel rail 74 and the rear external wall 81*a* is not necessary, as this adds extra weight but does not necessarily improve the overall strength of the masonry support carrier 73. As can be seen in FIGS. 18 and 19, a series of carrier supports 80 are positioned along the length of the masonry support carrier 73. The carrier supports 80 are connected to the internal side of the external wall 81, assisting in holding the form of the masonry support carrier 73 whilst also providing appropriate connection to the channel rail 74. The channel rail 74 may be provided as a separate rail which is then attached to the upper external wall 81*d* and is within a cut-out 82 of the carrier support 80 to properly hold the channel rail 74 at the desired location on the upper side of the masonry support carrier 73. It is preferable that the channel rail 74 is a separate item which can be welded to the upper external wall 81*d* and to the individual cut-outs 82 of the carrier supports 80.

Providing the masonry support carrier 73 with the appropriate external shape, such that the soffit rails 54 can be attached to the lower external wall 81*b* and forward external wall 81*c*, the channel rail 74 will preferably be positioned so as to properly align with fixing slots 78 provided on the shelf angle 76; this can be seen in FIG. 17. The individual carriers 73 will consequently allow for a mechanical connection to the lower side of the external brick cladding 79 via the shelf angle 76 and a carrier fixing 77 passing through the fixing slots 78, thus always ensuring that the front, forward facing side of the soffit transition slip 55 aligns with the outer side of the external brick cladding 79. As can be seen in FIG. 21, the fixing slots 78 can be provided through the shelf extension of the shelf angle 76, thus allowing for appropriate final adjustment of the position of the front face of the soffit transition slip 55 and to ensure that this aligns properly with the bricks of the external brick cladding 79. The provision of the channel rail 74 also allows for the masonry support carrier 73 to move along the length of the shelf angle 76, ensuring that the ends of the masonry support carrier 73 properly align with the external brick cladding 79 either side of the archway or span, thus properly ensuring that the soffit transition slips 55 are firmly located into the bolt-up unit 71 and can be held in the desired position to complete the external brick cladding 79. The carrier fixings 77 may be nuts and bolts, the bolt fitting within the opening of the channel rail 74 and passing through the fixing slots 78 on the shelf angle 76, to therefore, after application of the nut, appropriately hold the masonry support carrier 73 and soffit transition slips 55 in place. Another, preferred, design for the carrier fixings 77 is that of a T-shaped or T-head bolt, the short cross bar of the "T" being located through the fixing slots 78, into the channel rail 74 in an engaging orientation, such that after rotation of approximately 90° the cross part of the "T" is held within the channel rail 74 and the stem of the "T" protrudes through the fixing slots 78 to allow for a nut, or other securing element, to be positioned thereon and hold the "T" bolt and masonry support carrier 73 in place.

Figure 20D:
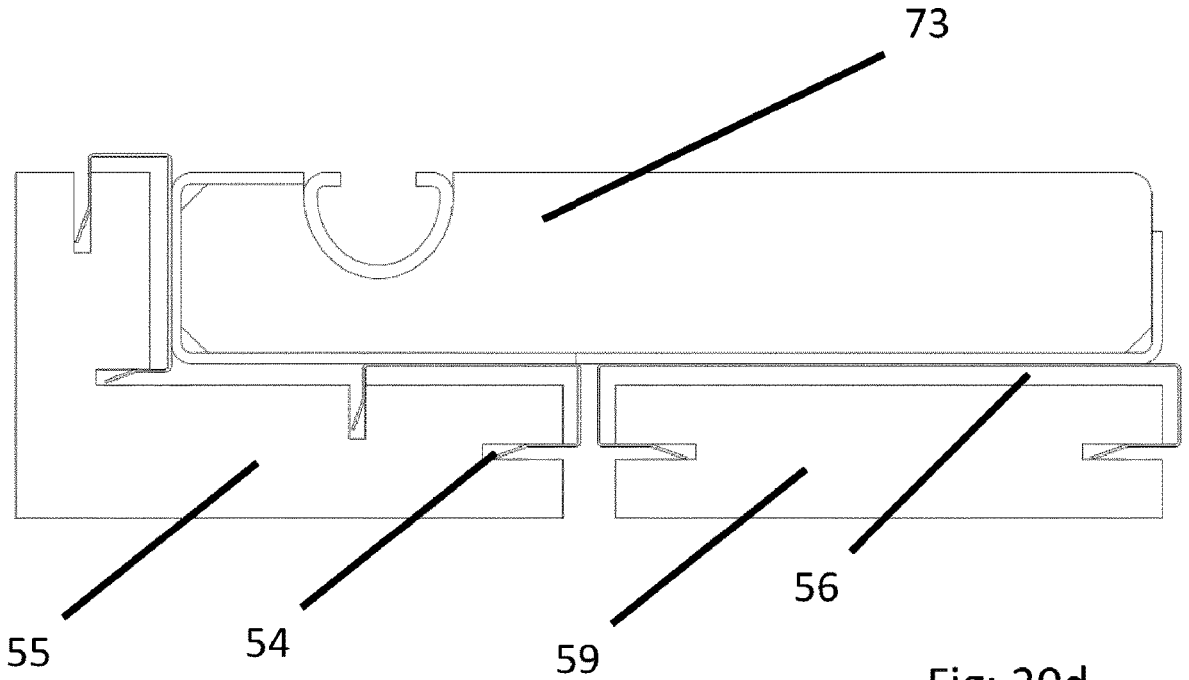
FIG. 20*d* shows a further design of the carrier support of FIG. 18

It may also be desirable to extend the number of brick slips which are visible in the span or archway within the external brick cladding 79. Such a design is shown in FIG. 20*d*, wherein the masonry support carrier 73 is provided with a form to allow two soffit rails 54 at the forward external wall 81*c* and lower external wall 81*b*, thus allowing for the positioning of the appropriate soffit transition slip 55, as well as space for a bed channel frame 56. The masonry support carrier 73 is thus longer, extending beyond the soffit rail 54 attached to the lower external wall 81*b*, and comprises a bed channel frame 56 also attached to the lower external wall 81*b*. The bed channel 56 is the same as described above, and will comprise a bed face slip 59 in the final construction. The design shown in FIG. 20*d* shows a masonry support carrier 73 which can hold a single bed channel frame 56, however it will be appreciated that a masonry support carrier 73 could be designed which could hold multiple bed channel frames 56, as required, extending the soffit panelling underneath the external brick cladding 79 to form an archway, or the like. This would allow for a building construction to comprises an external brick cladding 79 with a deep archway there-through: the external brick cladding 79 perhaps being two brick walls surrounding an internal masonry construction 72, wherein the archway may be deep enough such that two or three (or more as required) bed face slips 59 will bridge the underside of the arch and lead to the two soffit transition slips 55 integrating with the external brick walls 79 either side of the central masonry construction 72. In such a situation, the masonry support carrier 73 may be provided with two or more bed channel frames 56 extending partway across the underside of the archway or hole through the masonry construction 72. On the other side of the masonry construction 72, a separate external brick cladding 79 may be provided with its own masonry support system 70 comprising a masonry support carrier 73 holding multiple bed face slips 59 and aligning with the first such masonry support carrier 73 in the middle of the archway or gap. In this manner, the system shown in FIG. 20*d* allows for deeper archways or gaps in the underlying masonry construction 72 to be bridged and appear to be of a full brick construction. It will also be appreciated that towards the rear external wall 81*a* of the masonry support carrier 73 in FIG. 20*d*, a second channel rail 74 may be provided in order to attach to appropriate fixings on the underside of the masonry construction 72 as above, thus affixing such a single masonry support carrier 73 in two places to bear the weight thereof. This design is not shown in the figures.

Figure 22:
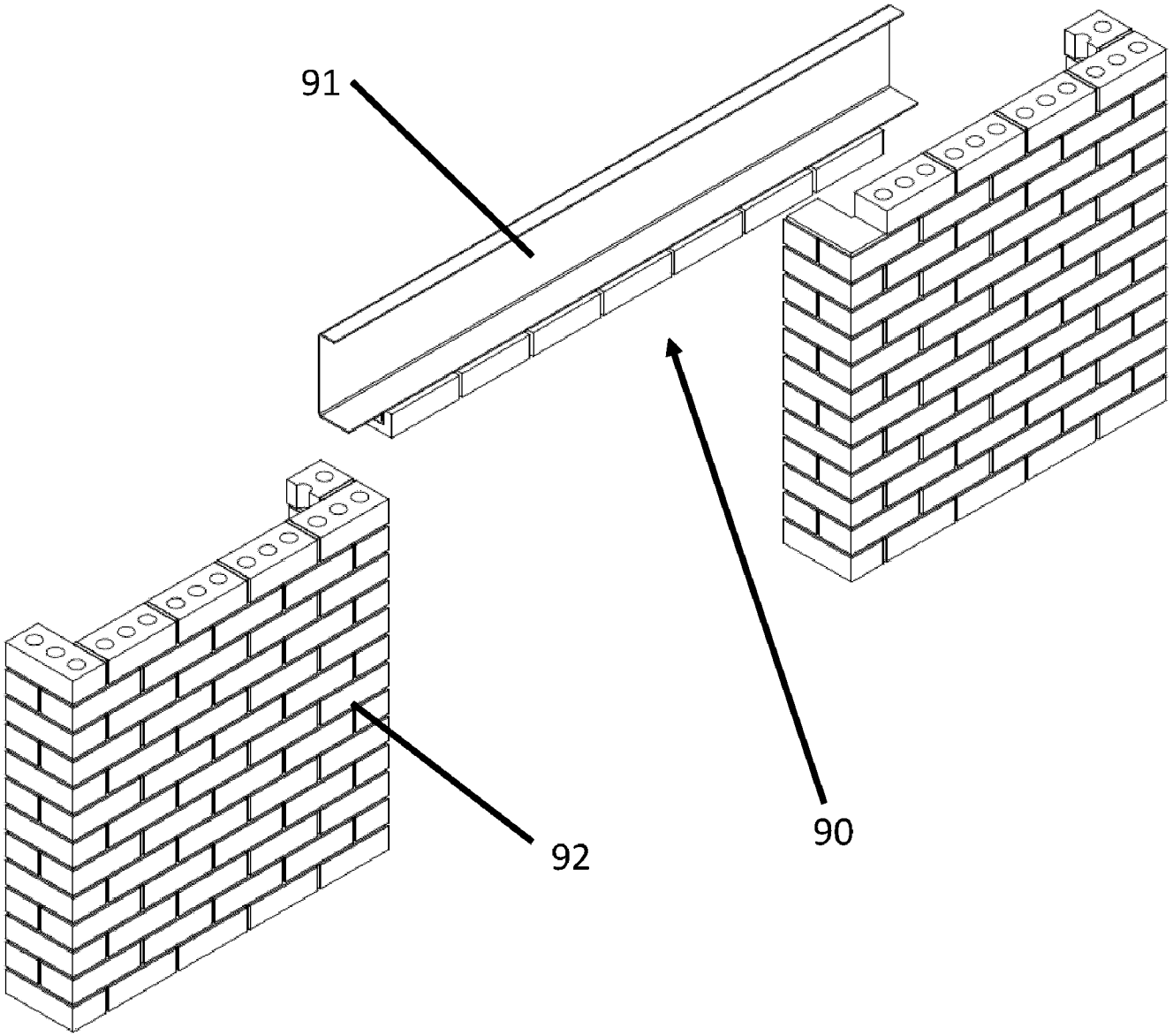
FIG. 22 shows a lintel support system integrating with a building structure

The above combination of the masonry support system 70 is for use when the arch or gap within the external brick cladding 79 is backed by a masonry construction 72. In alternate embodiments, the wall 92 will not have a masonry support construction 72 backing the wall, rather the wall 92 will be a freestanding structure with an opening or archway therein. FIG. 22 shows disclosure relating to a wall 92 in which a gap is provided and the wall 92 will continue unbroken above said gap. As mentioned above, in brick construction comprising an archway or gap in the wall 92, it is necessary to incorporate a strengthening lintel bridging the gap such that the weight of the wall 92 on top of the lintel is transferred via said lintel to the sidewall structures and the weight of the brick work can be borne thereby. Such a structure is shown in the lintel support system 90 of FIG. 22. The lintel support system 90 comprises lintel 91, which will be so shaped and tailored to appropriately bridge the gap between the two sections of wall 92 either side of the arch or gap in said wall 92. The lintel 91 will thus overlap with the sections of wall 92 either side of the gap.

Figure 23A:
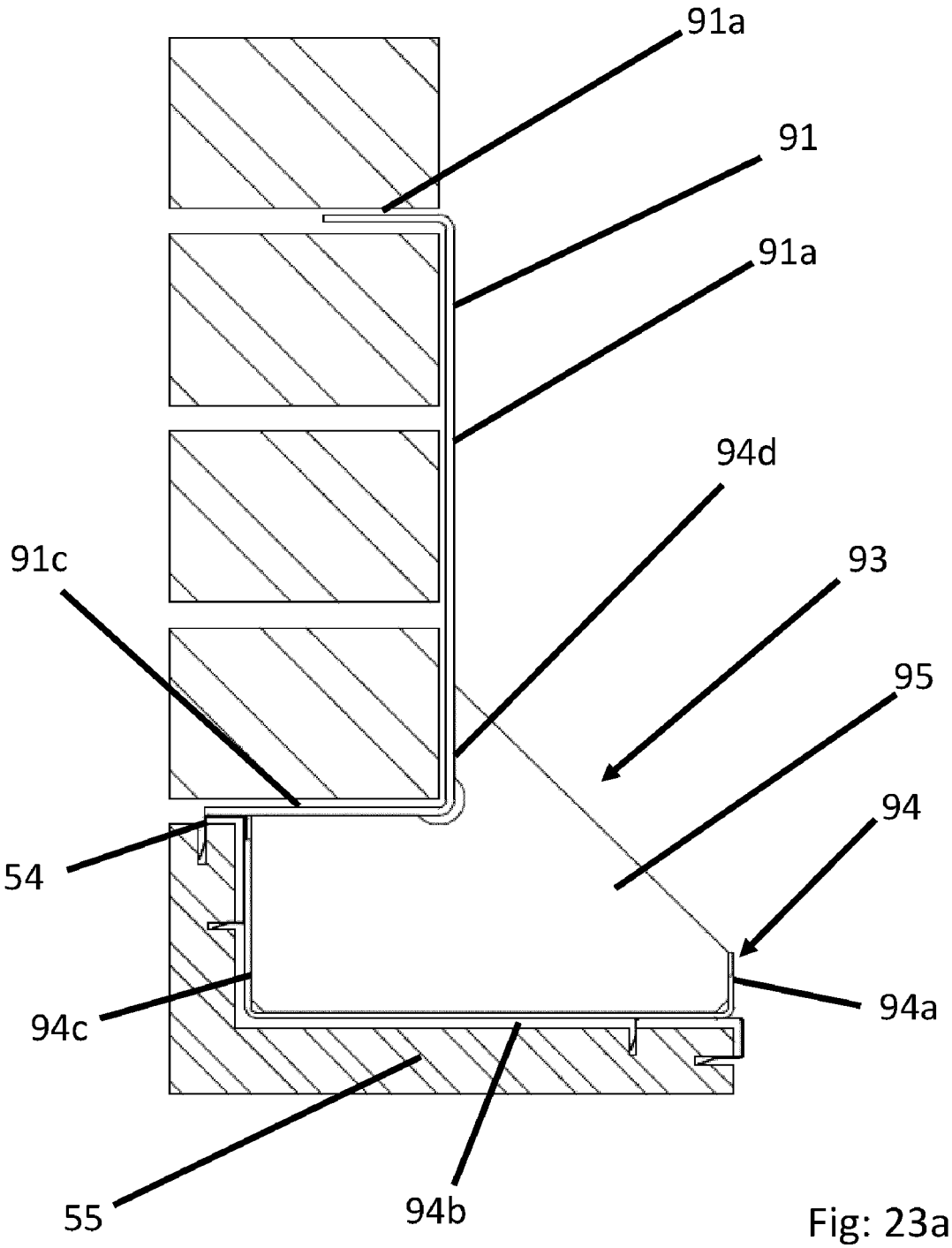
FIG. 23*a* shows the lintel support system of FIG. 22 in cross-section
Figure 23B:
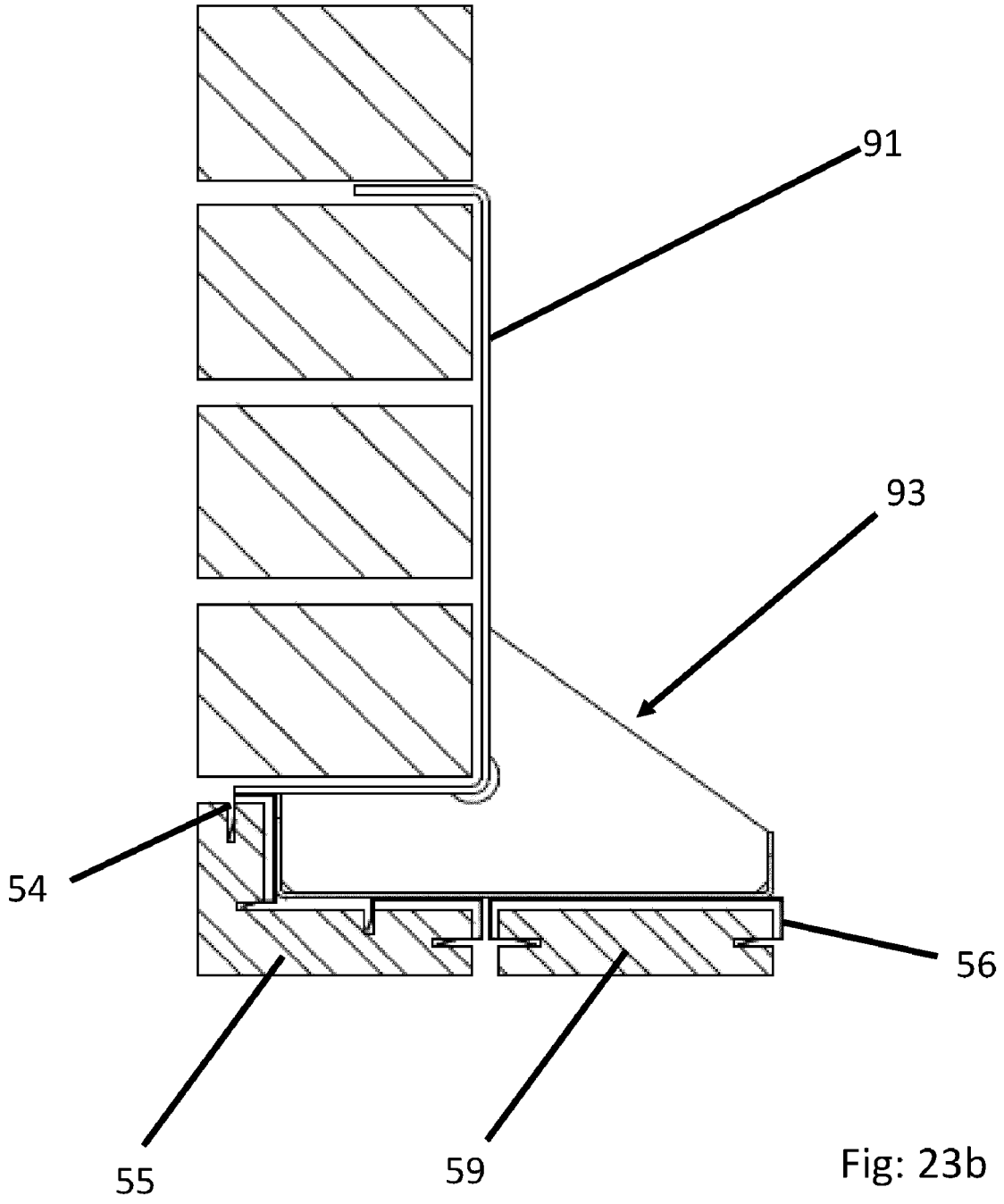
FIG. 23*b* shows another design of the lintel support system of FIG. 22 in cross-section

FIGS. 23*a* and 23*b* show two side views of the lintel 91 as seen in FIG. 22 incorporating a lintel carrier 93. The lintel 91 has a straight sided C cross-sectional structure, with an upper extension 91*a* positioned opposite a lower extension 91*c*, these two upper 91*a* and lower 91*c* extensions being connected by a rear plane 91*b* to form the lintel 91. The angle formed between each of the upper 91*a* and lower 91*c* extensions with respect to the back plane 91*b* is preferably 90°, or approximately 90°. The gap between the upper extension 91*a* and the lower extension 91*c* is appropriate to allow for one or more brick courses to be positioned therein, whilst including mortar courses between said bricks. The lowest row of bricks will be positioned on top of the lower extension 91*c*; the upper surface of the upper brick held within the lintel 91 will be positioned just below the upper extension 91*a*, such that the upper extension 91*a* can be appropriately held within the mortar course between the upper brick in the lintel 91 and the next brick course above the lintel 91. In FIGS. 23*a* and 23*b*, three brick courses are provided within the lintel 91 with a fourth brick course above the upper extension 91*a* being shown. The mortar courses between each of the bricks will appropriately separate the brick courses and will also properly hold the upper extension 91*a* within the next mortar course to hold the bricks properly in the lintel 91. To this end, the bricks within the lintel 91 and the brick course above the upper extension 91*a* will, by means of the mortar course between said brick courses, form a solid unit appropriately fixing the lintel 91 within the wall 92 and allowing for load bearing across to the two sides of wall 92 either side of the gap. Preferably, the lower extension 91*c* extends almost as far forward as the width of the lowest brick, thus providing a stable base upon which the lowest course of bricks can be located and held. In the same manner as described above for the masonry support system 72, the lintel 91 will have an exposed lower surface. The present disclosure incorporates the use of the soffit transition slips 55, in a similar manner to that described above with regard to FIGS. 17 to 21, in order to obscure the lintel 91 and improve the building aesthetics.

Elements of the present disclosure are seen in FIGS. 23*a* and 23*b* below the lintel 91. The concept incorporates the lintel carrier 93 which is attachable and attached to the lower portion of the lintel 91 when in use, in particular to the lower portion of the backplate 91*b* and the lower extension 91*c*. The lintel carrier 93 comprises an extension wall 94 which extends to form either an L-shaped cross-sectional structure (not shown in the Figures) or a generally straight-sided U-shaped cross-sectional channel. In the U-shaped configuration, the extension wall 94 comprises a rear portion 94*a* a lower portion 94*b* and a forward facing portion 94*c*, wherein the rear portion 94*a* and the forward facing portion 94*c* are approximately parallel to each other and are joined by means of the lower portion 94*b*. The angle between each of the rear portion 94*a* and the forward facing portion 94*c* with the lower portion 94*b* is preferably 90°, or approximately 90°. In the L-shaped configuration, the rear portion 94*a* would be missing. The extension wall 94 is constructed from a suitably load bearing material, such as metal, which can be bent or roll-formed into the elongate channel structure with the above L-shaped or U-shaped cross-section, the extension wall 94 extending along the length of the lintel 91. One or more lintel carrier supports 95, which are generally sheet like strengthening structures, are located along the channel within the lintel carrier 93, and extend between the rear portion 94*a* when present, the lower portion 94*b*, the forward facing portion 94*c* and a transition surface 94*d*, the transition surface 94*d* being the interface between the lower extension 91*c* of the lintel 91, and in some embodiments also the lower portion of the backplate 91*b* of the lintel 91 and the lintel carrier supports 95. The transition surface 94*d* provides points of contact between the lintel carrier supports 95 and the lintel 91, thus allowing the lintel carrier 93 to be attached to the lintel 91. The connection can be by any means, however welding is deemed to be a suitable means of connecting the lintel carrier 93 to the lower outer side of the lintel 91. It is also possible for extension wall 94 to have an upper portion extending from the upper side of the forward facing portion 94*c*, and extending along the underside of the lower extension 91*c* of the lintel 91—this is not shown in the Figures. Such an upper portion to the extension wall 94 will provide for a further direct connection between the extension wall 94 of the lintel carrier 93 and the lintel 91, thus allowing more points of contact and further securing of the elements together.

The material choice for the lintel 91, lintel carrier 93 comprising the extension wall 94 and lintel carrier supports 95 is metal, ideally stainless steel. Stainless steel is particularly useful as this allows for welding to be undertaken between all parts, as well as embodying a corrosion resistant and high melting point material. The combination of the lintel 91 and lintel carrier 93 will provide enough structural support to allow the wall 92 to continue above the gap or archway, whilst also transferring the load appropriately.

In a similar manner to the masonry support carrier 73 of the masonry support system 70, the forward facing portion 94*c* and lower portion 94*b* of the extension wall 94 of the lintel carrier 93 are provided with soffit rails 54. In FIG. 23*a*, the forward facing portion 94*c* is provided with a soffit rail 54 at the upper edge, such that this is positioned in line and with the lower surface of the lower extension 91*c* of the lintel 91. The rear end of the lower portion 94*b* of the extension wall 94 is also provided with a soffit rail 54, generally aligned with the rear portion 94*a* of the extension wall 94. The two soffit rails 54 are positioned to properly interact with the slots on a soffit transition slip 55, thus allowing the soffit transition slip 55 to be slid into engagement with each of the soffit rails 54 and be held to the lintel carrier 93. The lintel support system 90 shown in FIG. 22 shows the lintel carrier 93 comprising a number of soffit transition slips 55, these appropriately bridging the gap or archway between the two halves of the wall 92 and appropriately covering the lower extension 91*c* of the lintel 91. It will be appreciated that the length of the lintel carrier 93 will preferably be an integer multiple of soffit transition slips 55 with appropriate mortar courses there-between, such that the final view of the soffit transition slips 55 will give the impression that these are a normal course of bricks above the gap in the wall 92.

Figure 23C:
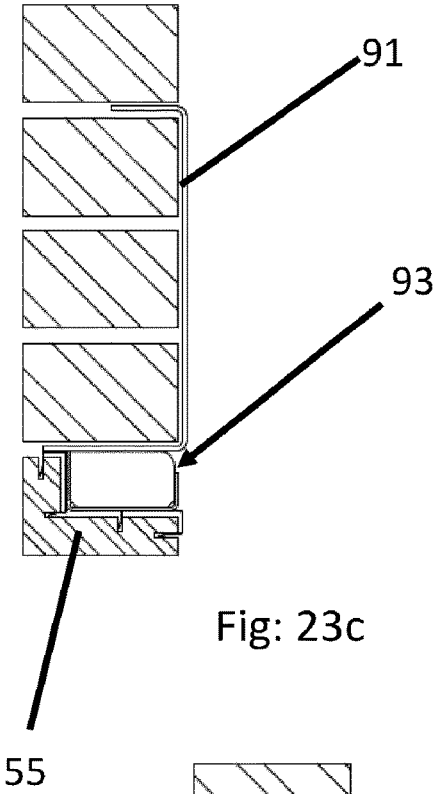
FIG. 23*c* shows another design of a linter support system in cross-section.
Figure 23D:
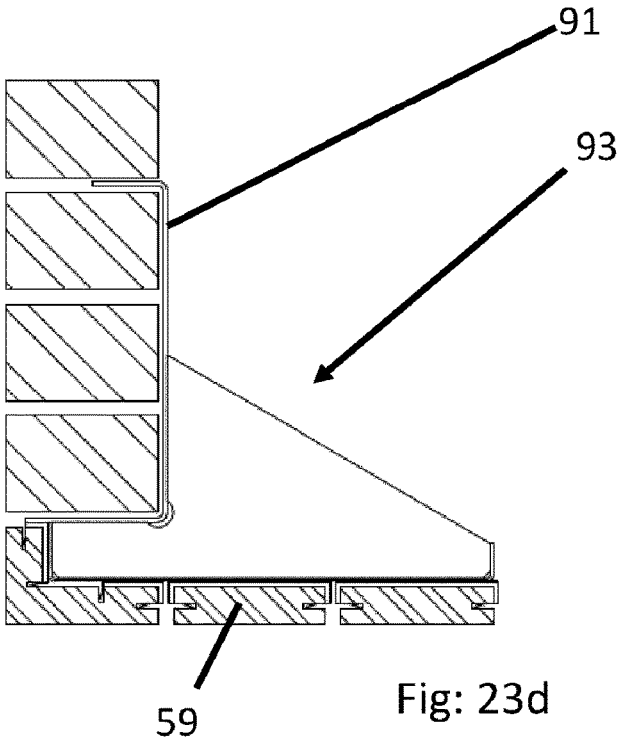
FIG. 23*d* shows another design of a linter support system in cross-section.
Figure 23E:
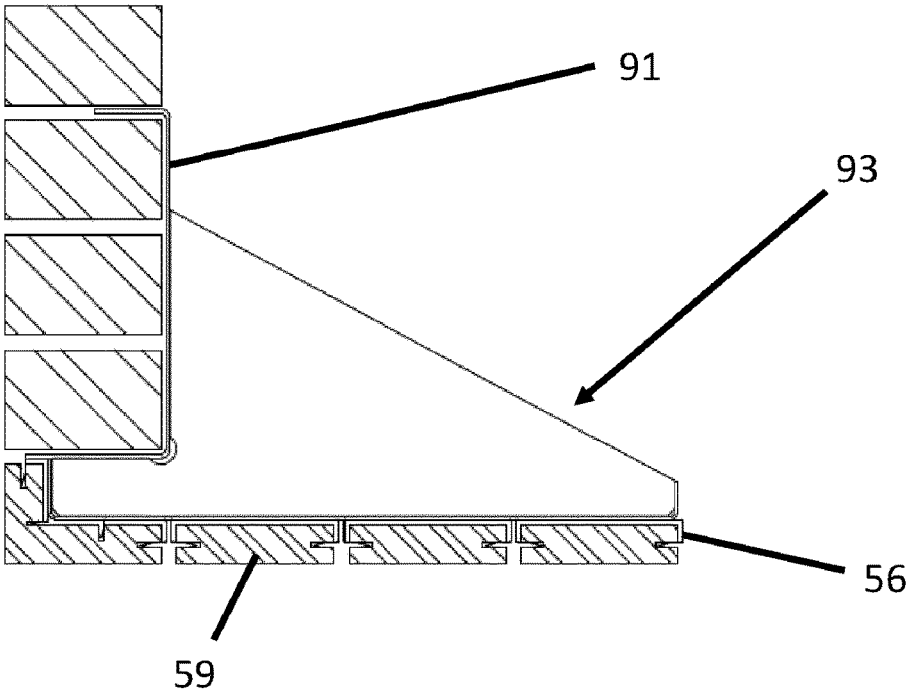
FIG. 23*e* shows another design of a linter support system in cross-section.

The lintel carrier 93 shown in FIG. 23*b* is of a slightly different construction to that shown in FIG. 23*a*; the lintel carrier 93 in FIG. 23*b* incorporates the two soffit rails 54 for slidable engagement with soffit transition slips 55, and also comprises a bed channel frame 56 to allow for a bed face slip 59 to be slidably engaged therewith. In the same manner as discussed above with regard to FIG. 20*d*, there are occasions where the depth of the gap in the wall 92 will be such that multiple rows of bricks will need to be simulated by means of a soffit transition slip 55 and bed face slips 59. The example given in FIG. 23*b* shows a single bed face slip 59 incorporated in a single bed channel frame 56; this is by example only, and it will be appreciated that the lintel carrier 93 may comprise multiple bed channel frames 56 and bed face slips 59 as required for the final design; such designs can be seen in FIGS. 23*d* and 23*e* which show a lintel 91 and lintel carrier 93 comprising two and three, respectively, bed channel frames 56 and bed face slips 59 in cross-section. As can further be seen in FIG. 23*c*, the lintel carrier 93 could be structured such that the soffit transition slip 55 does not extend in a rearward direction behind the lintel 91. The design in FIG. 23*c* uses a narrower soffit transition slip 55 in the wall thickness direction to provide a final structure which looks as though the lowest brick course is of the same dimensions as the remainder of the bricks making up the wall.

Figure 23F:
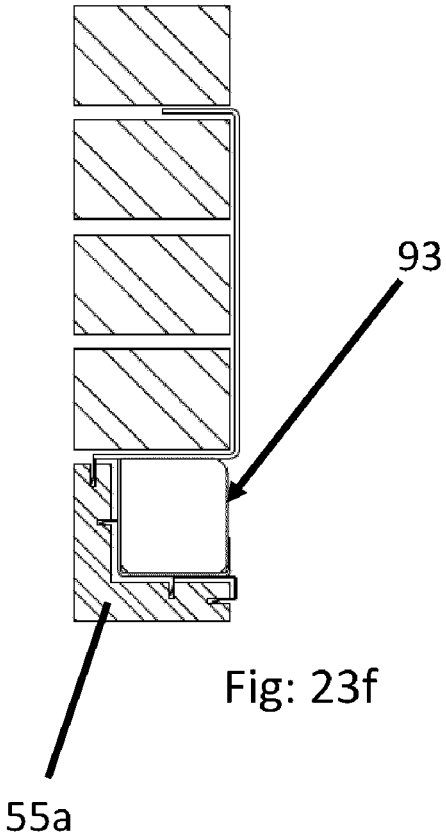
FIG. 23*f* shows another design of a linter support system in cross-section.
Figure 23G:
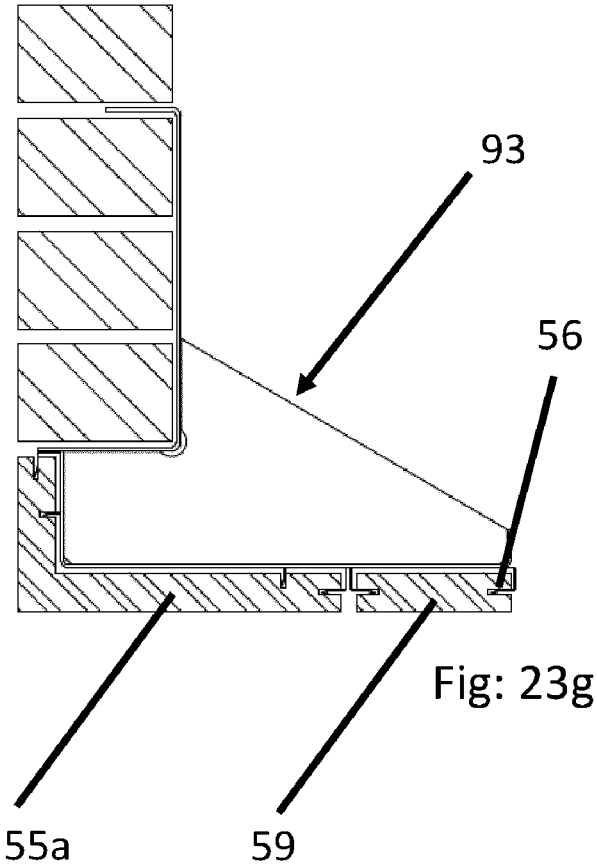
FIG. 23*g* shows another design of a linter support system in cross-section.
Figure 23H:
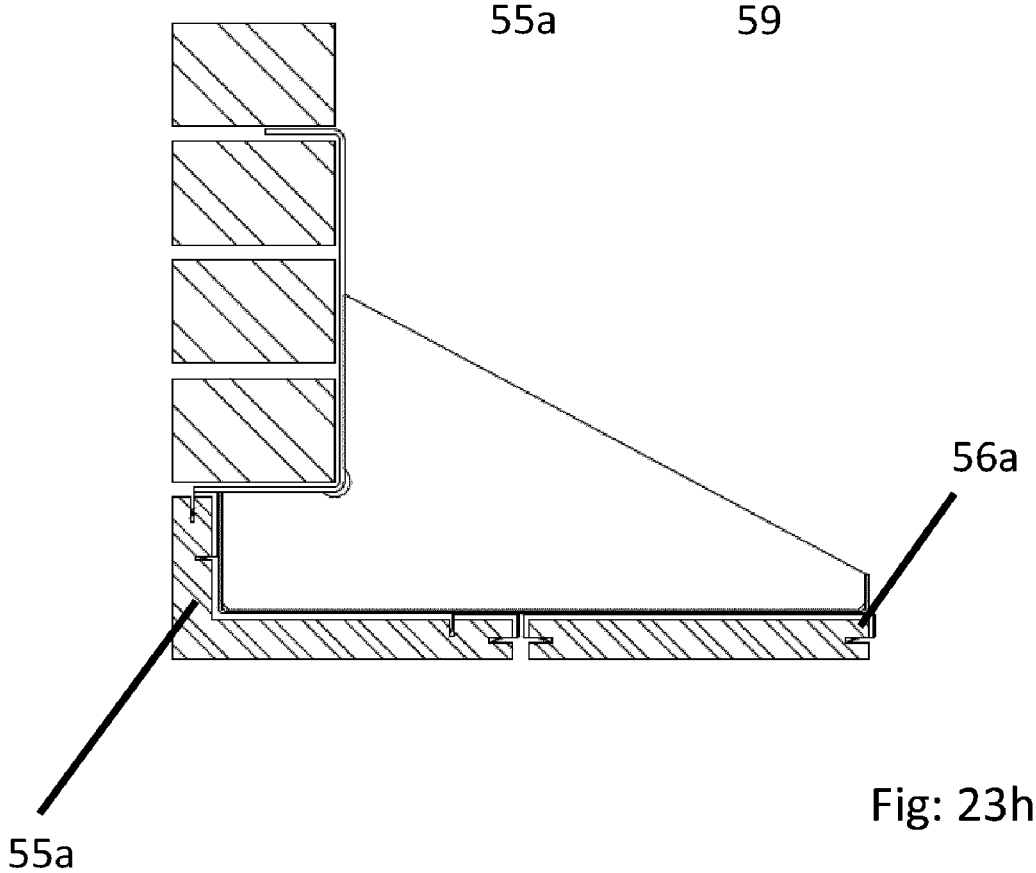
FIG. 23*h* shows another design of a linter support system in cross-section.

In some situations the designer of the building may wish for the lowest row of bricks, which is constituted by the soffit transition slips 55 and not actual bricks, to have a different orientation. For example, instead of the lowest brick course appearing to be the same as the remainder of the bricks in the wall, the soffit transition slips 55 could be taller than the remaining bricks in the wall—as viewed when facing the wall. This would optically appear as though the lowest brick course, that which is made up of the taller soffit transition slips 55*a*, were rotated by 90° to provide the bottom of the brick facing outward. Other heights of the taller soffit transition slip 55*a* could readily be accommodated. FIGS. 23*f* to 23*h* show three such designs for the taller soffit transition slips 55*a* of greater height that the bricks of the wall, thus completing the wall above the arch, or the like, with a different optic. FIG. 23*f* provides the taller soffit transition slip 55*a* alone, in a similar manner to FIG. 23*c*. FIG. 23*g* has a taller soffit transition slip 55*a* which extends underneath and beyond the rear side of the wall above the lintel carrier 93 as shown in FIG. 23*a*; unlike in FIG. 23*a*, the taller soffit transition slip 55*a* is taller and provides a different optic to the finished wall in FIG. 23*g*. FIG. 23*g* also incorporates a bed channel frame 56 and bed face slip 59 behind the soffit rail 54, thus meaning that the soffit continues beyond the back of the wall. It will be appreciated that multiple bed channel frames 56 and bed face slips 59 may be incorporated, as required. FIG. 23*h* comprises the same, or similar, taller soffit transition slip 55*a* as shown in FIG. 23*g*; a modified bed channel frame 56*a* is, however, shown which is of a different dimension in the depth direction than the bed channel frames 56 shown in FIGS. 23*b*, 23*d*, 23*e* and 23*g*. It will be appreciated that the bed face slips 59 could be oriented such that their long sides extend in the depth direction behind the wall and along the soffit. Alternatively, the masonry slips 2 could be used to make the final pattern of the soffit brickwork. In this case, the slots as shown in the masonry slips 2 of FIG. 16*h* and the slots as shown in the bed face slips 59 in FIG. 16*c* would be provided on the shorter ends to allow integration with the modified bed channel frame 56*a* of FIG. 23*h*.

Figure 23I:
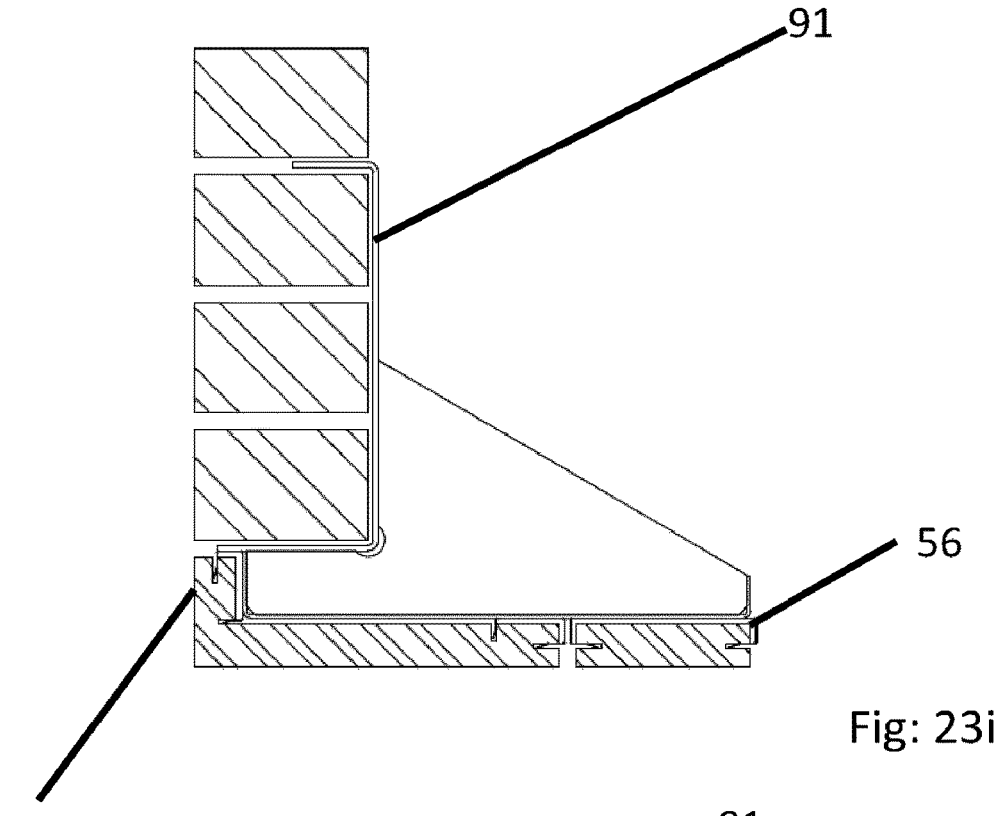
FIG. 23*i* shows another design of a linter support system in cross-section.
Figure 23J:
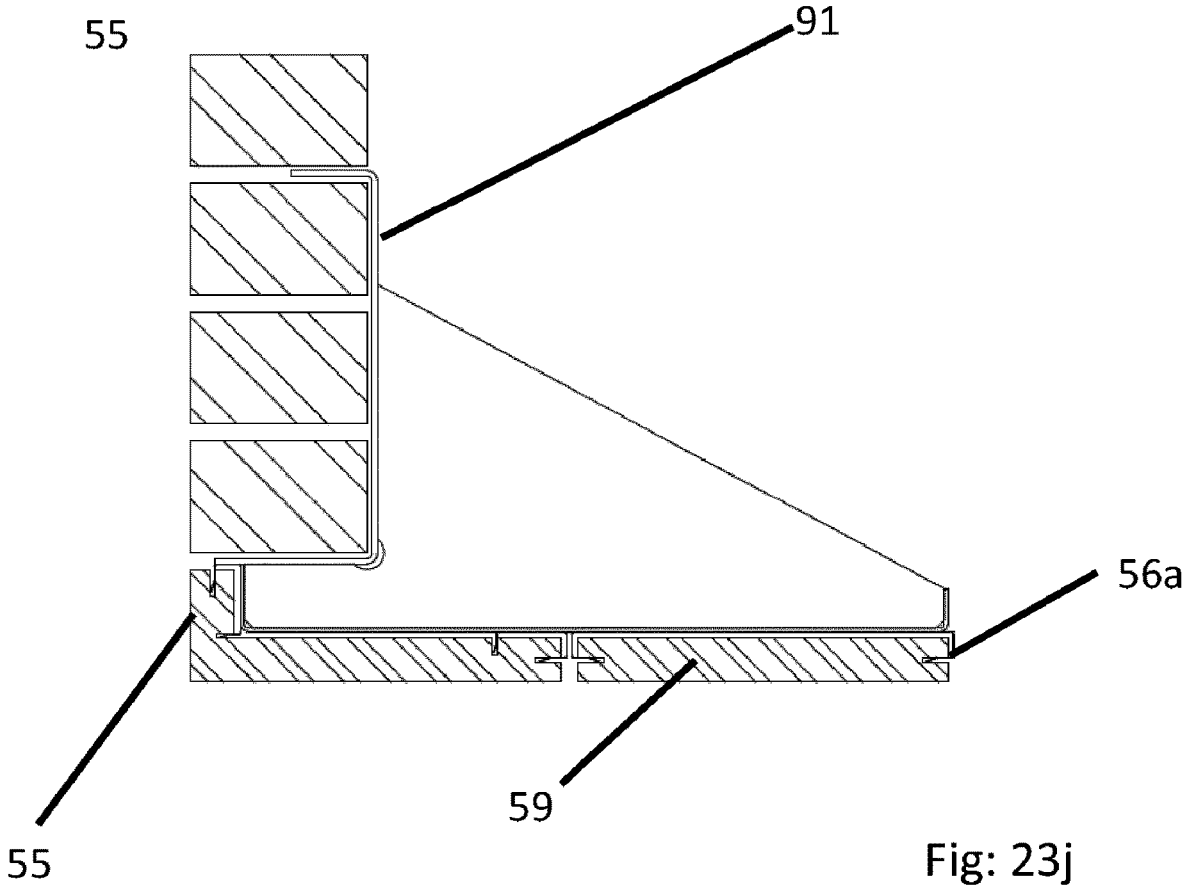
FIG. 23*j* shows another design of a linter support system in cross-section.

FIG. 23*j* shows a design in which the soffit transition slip 55 extends beyond the back of the wall and lintel 91. A modified bed channel frame 56*a* is also provided behind the soffit transition slip 55 to extend the soffit with the longitudinally oriented bed face slips 59 or masonry slips 2 as discussed with regard to FIG. 23*h*. A further design incorporating the soffit transition slip 55 which extends beyond the back of the lintel 91 and which incorporates a bed channel frame 56 and bed face slip 59 is seen in FIG. 23*i*. In this form, the bed face slips 59 will have their longitudinal axis extending into the page of FIG. 23*i*.

As will be understood, the use of the soffit rails 54 and the bed channel frames 56 and modified bed channel frames 56*a* need only be located at the required location of the lintel carrier 93 in order to accommodate the desired masonry slip 2, soffit transition slip 55, taller soffit transition slip 55*a* and bed face slip 59 in the desired orientation. The location of the soffit rail 54 in each of the designs above will be chosen in combination with an appropriately sized lintel carrier 93, so as to provide the underlying support for the desired finished look to the wall. The same choice, and location, of the bed channel frames 56 and modified bed channel frames 56*a* will allow the final, desired patterning of the soffit to be achieved.

Figure 24A:
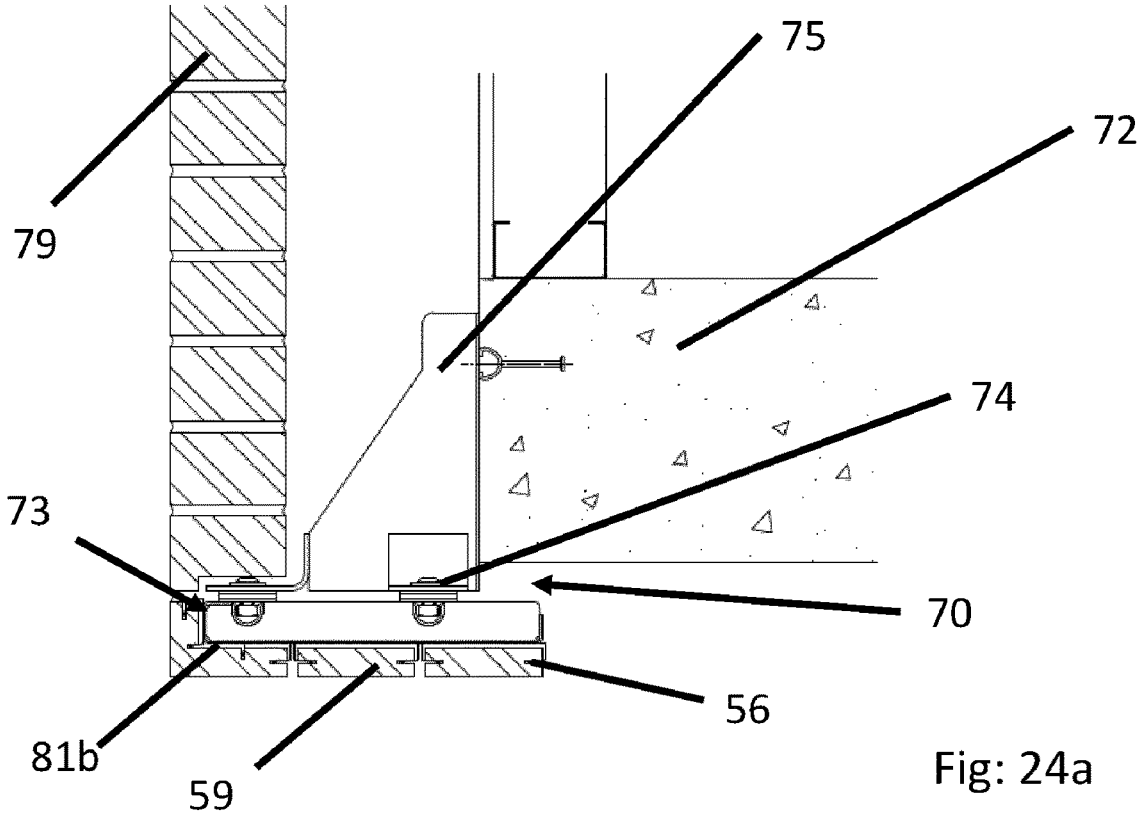
FIG. 24*a* shows another design of a masonry support system

FIG. 24*a* shows a masonry support system 70 comprising a masonry support carrier 73 sized to allow attachment of multiple bed channel frames 56 and bed face slips 59. The masonry support carrier 73 in FIG. 24*a* extends behind the external brick cladding 79 and underneath the masonry support bracket 75 to provide a deeper lower external wall 81*b* than that seen in FIG. 17. The lower external wall 81*b* of the masonry support carrier 73 in FIG. 24*a* comprises two bed channel frames 56 and two bed face slips 59 behind the soffit transition slip 55. In order to hold the masonry support carrier 73 within the masonry support system 70, the masonry support carrier comprises a second channel rail 74 which, by means of further carrier fixings 77, can be used to attach the masonry support carrier 73 to the masonry support bracket 75. Again, the second channel rail 74 and carrier fixings 77 allow for the masonry support carrier 73 to be located in the desired location with respect to the external brick cladding 79 and underlying masonry construction 72.

Figure 24B:
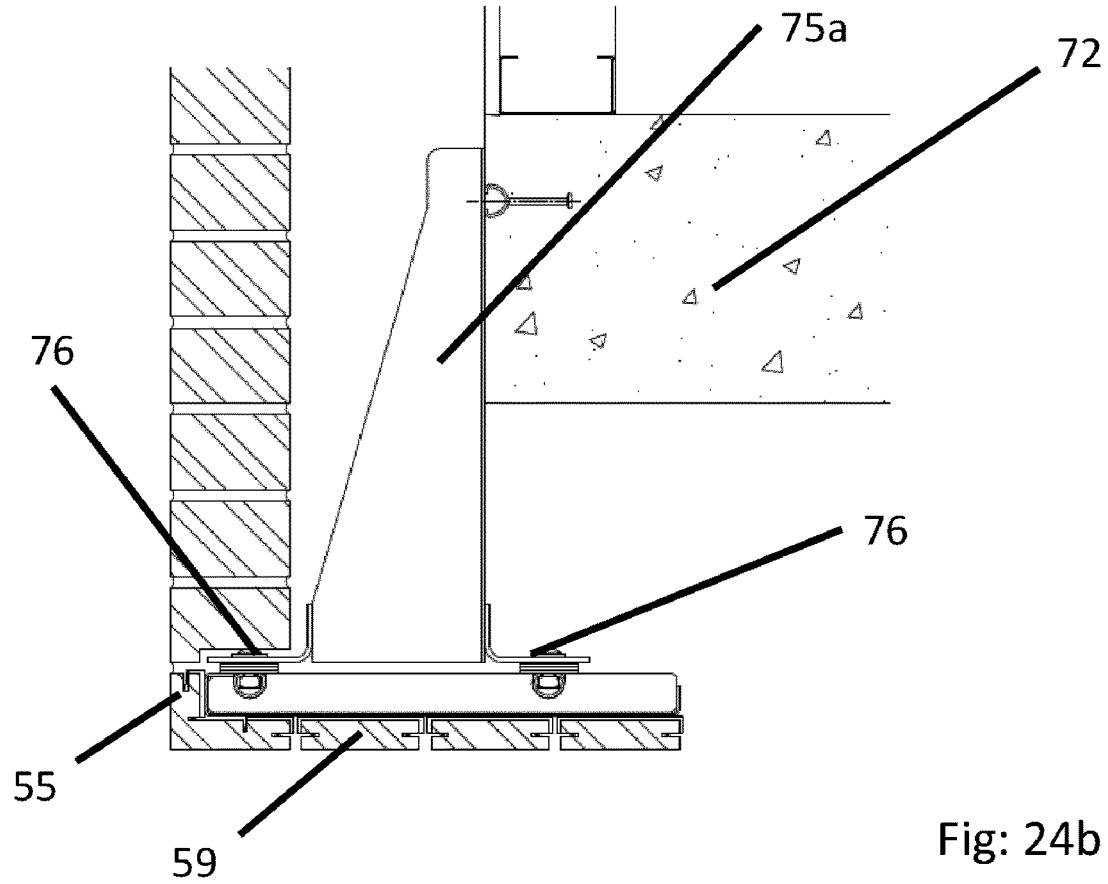
FIG. 24*b* shows another design of a masonry support system
Figure 25A:
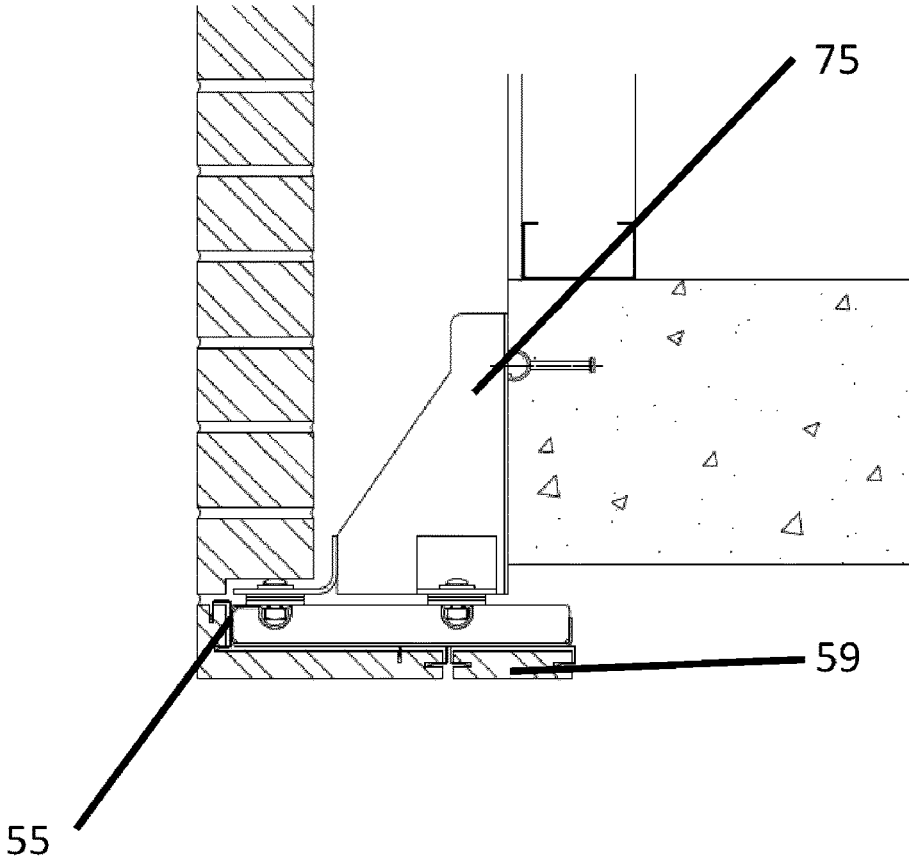
FIG. 25*a* shows another design of a masonry support system
Figure 25B:
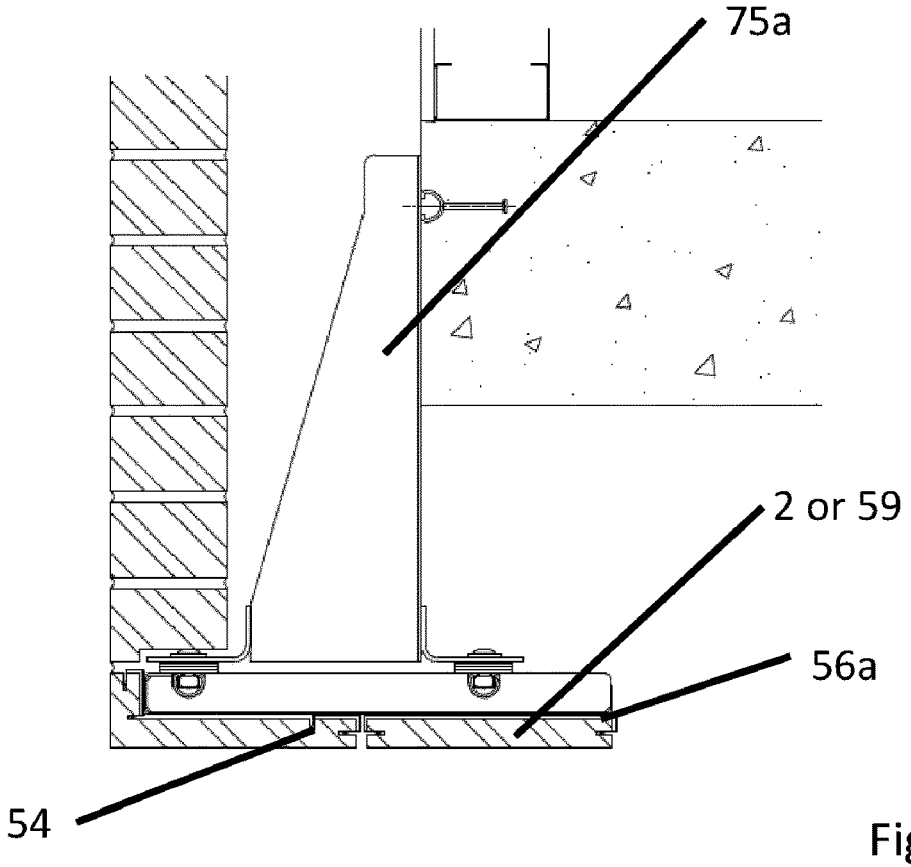
FIG. 25*b* shows another design of a masonry support system

A further modification of the masonry support system 70 is seen in FIG. 24*b*, wherein a taller masonry support bracket 75*a* is shown. This taller masonry support bracket 75*a* can be used in place of the masonry support bracket 75 as shown in FIG. 17, and allows for the external brick cladding 79 to extend to a point lower than the masonry construction 72. As is also shown in FIG. 24*b*, the taller masonry support bracket 75*a* can integrate with, and have affixed thereto, a second shelf angle 76. This second shelf angle 76 is positioned behind the taller masonry support bracket 75*a* for connection to the second channel rail 74, allowing for an even deeper masonry support carrier 73 to be integrated with the masonry support system 70. FIG. 24*b* shows the masonry support carrier 73 supporting three rows of bed face slips 59 behind the soffit transition slip 55. As can be understood from FIG. 25*b*, the soffit transition slip 55 could be of the deeper form, extending beyond the rear side of the external brick cladding 79 with the modified bed channel frame 56*a* located behind the rear soffit rail 54. Either the masonry slip 2 or bed face slip 59 modified for longitudinally integrating with the modified bed channel frame 56*a* can be accommodated in this design. FIG. 25*a* shows the masonry support system 70 for FIG. 24*a* with the deeper soffit transition slip 55 extending beyond the back of the external brick cladding 79 with a bed channel frame 56 and bed face slip 59 behind and extending underneath the masonry support bracket 75.

Figure 26A:
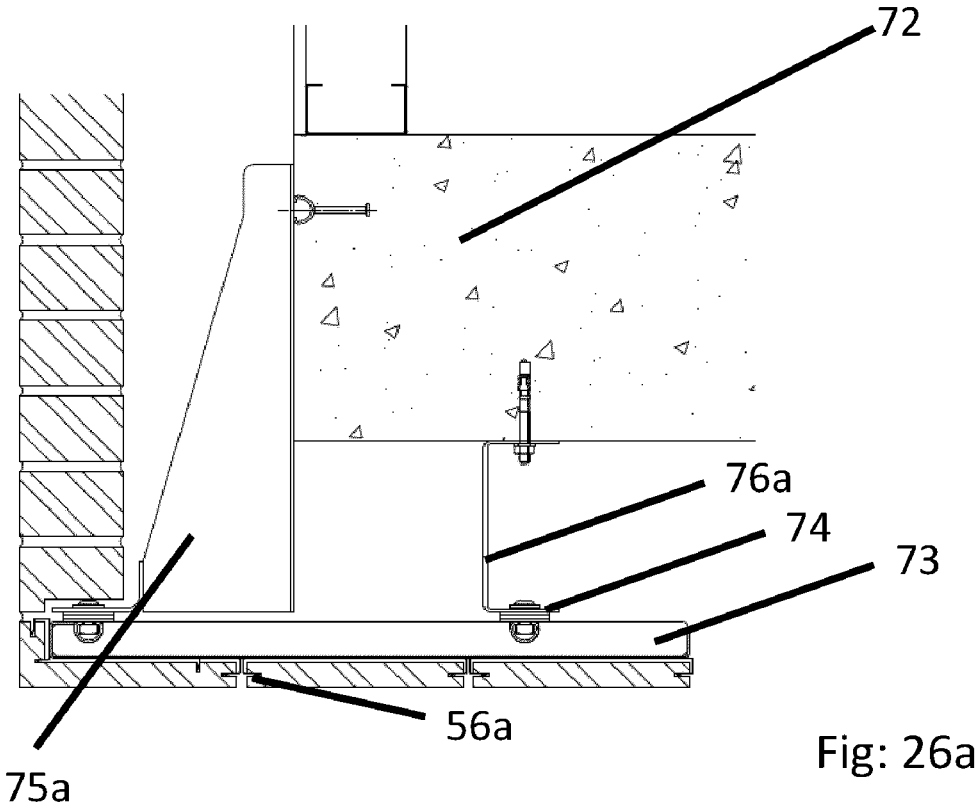
FIG. 26*a* shows another design of a masonry support system
Figure 29A:
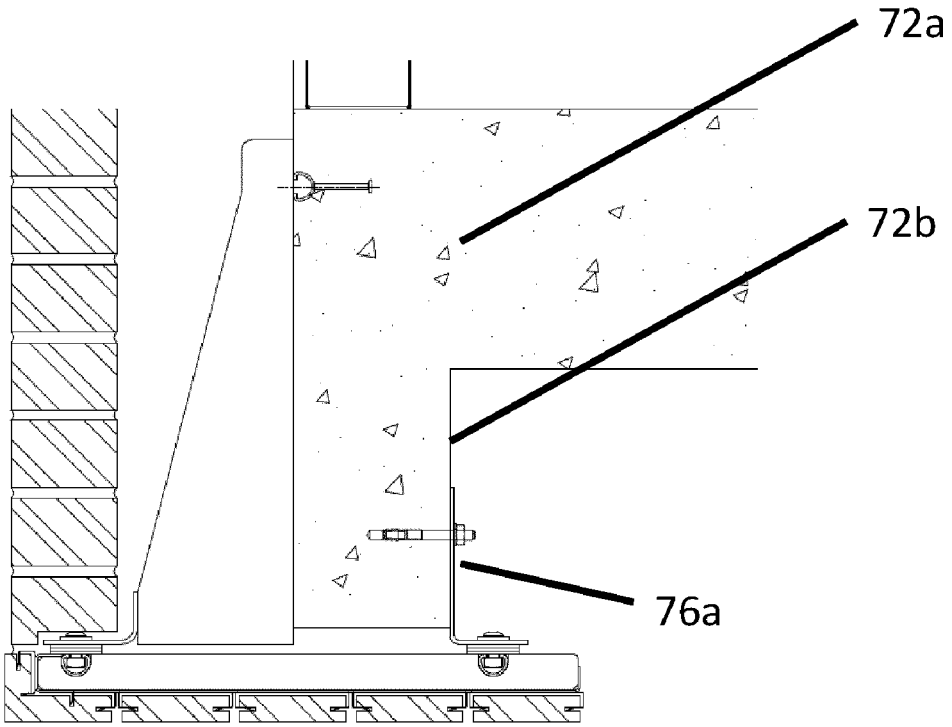
FIG. 29*a* shows another design of a masonry support system
Figure 29B:
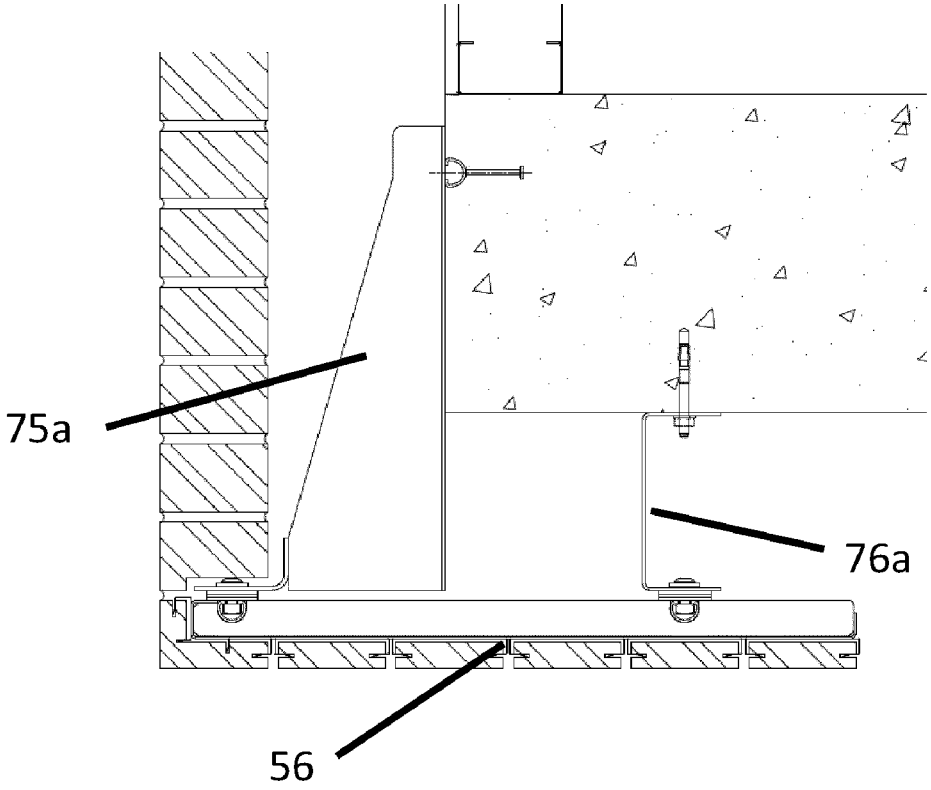
FIG. 29*b* shows another design of a masonry support system

In some soffit designs, the designer may require an even deeper masonry support carrier 73 so as to support multiple modified bed channel frames 56*a*. Such a design for a masonry support system is given in FIG. 26*a*. As can be seen, the masonry support carrier 73 extends a long way under the masonry construction 72 and away from the taller masonry support bracket 75*a* thus allowing space for two modified bed channel frames 56*a*; this is exemplary only and the system would also function with more than two modified bed channel frames 56*a* or multiple bed channel frames 56 as seen in FIG. 29*b*. In order to properly hold the masonry support carrier 73 and support the soffit, the masonry support system 70 of FIG. 26*a* also incorporates a modified shelf angle 76*a* extending between the second channel rail 74, located toward the rear side of the masonry support carrier 73, and the underside of the masonry construction 72. Whilst a straight extension for the modified shelf angle 76*a* is shown, this will readily be tailored depending upon the nature of the masonry construction 72. The modified shelf angle 76*a* of FIG. 26*a* is attached to the underside of the masonry construction 72 and extends toward the masonry support carrier 73 and is located so that carrier fixings 77 can connect the modified shelf angle 76*a* to the second channel rail 74 and support the masonry support carrier 73. FIG. 29*a* shows a different masonry construction 72*a* and indicates how the modified shelf angle 76*a* can fix to a rear side of a flange 72*b* of the different masonry construction 72*a* and hold the masonry support carrier 73. In addition to, or instead of, the modified shelf angle 76*a*, a series of brackets (not shown in the Figures) may extend between the masonry construction 72 or different masonry constructions 72*a* and the second (or more) channel rails 74 of the masonry support carrier 73 to provide the necessary support to hold the soffit and multiple rows of bed face slips 59 or masonry slips 2.

Figure 24C:
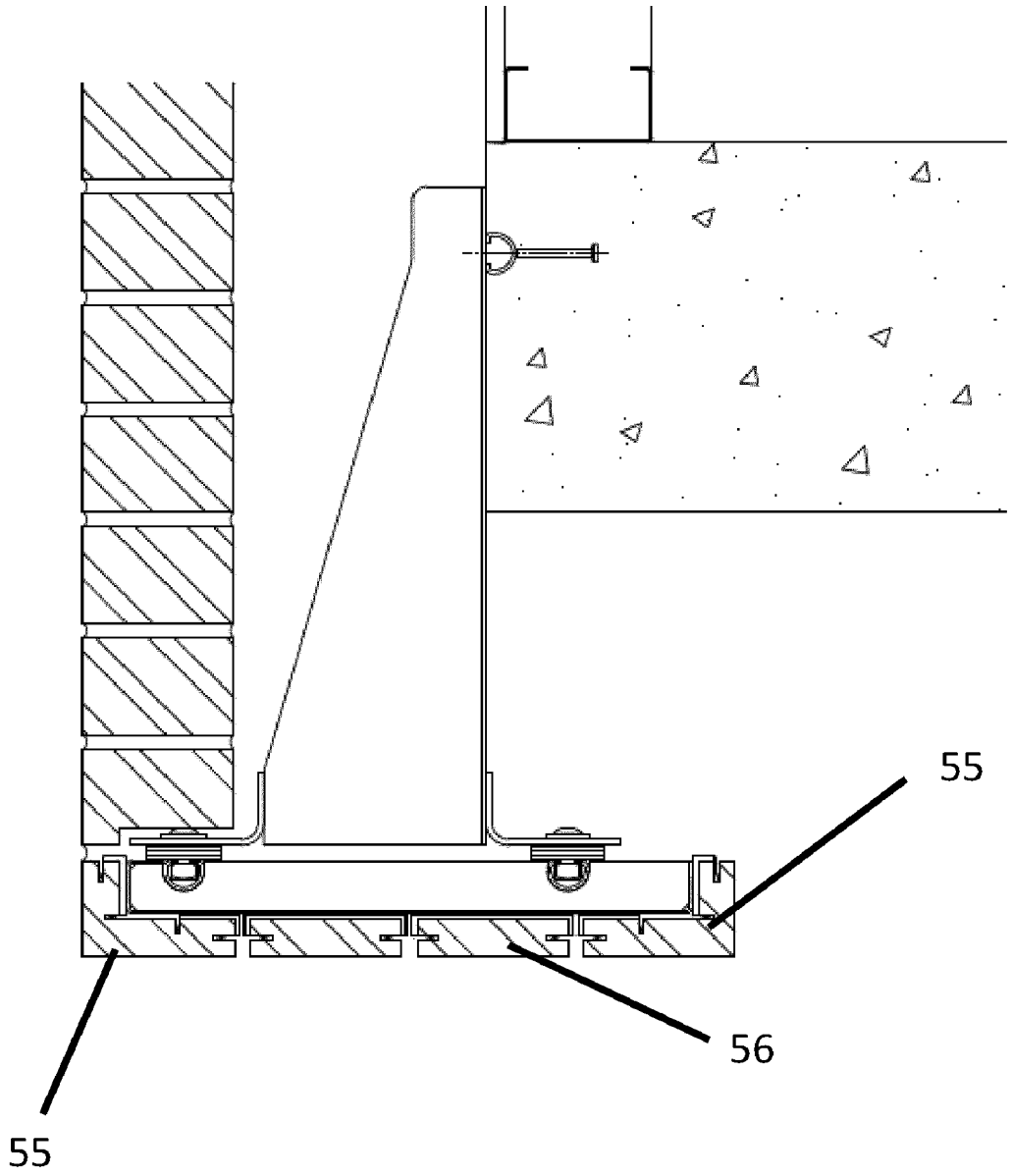
FIG. 24*c* shows another design of a masonry support system
Figure 25C:
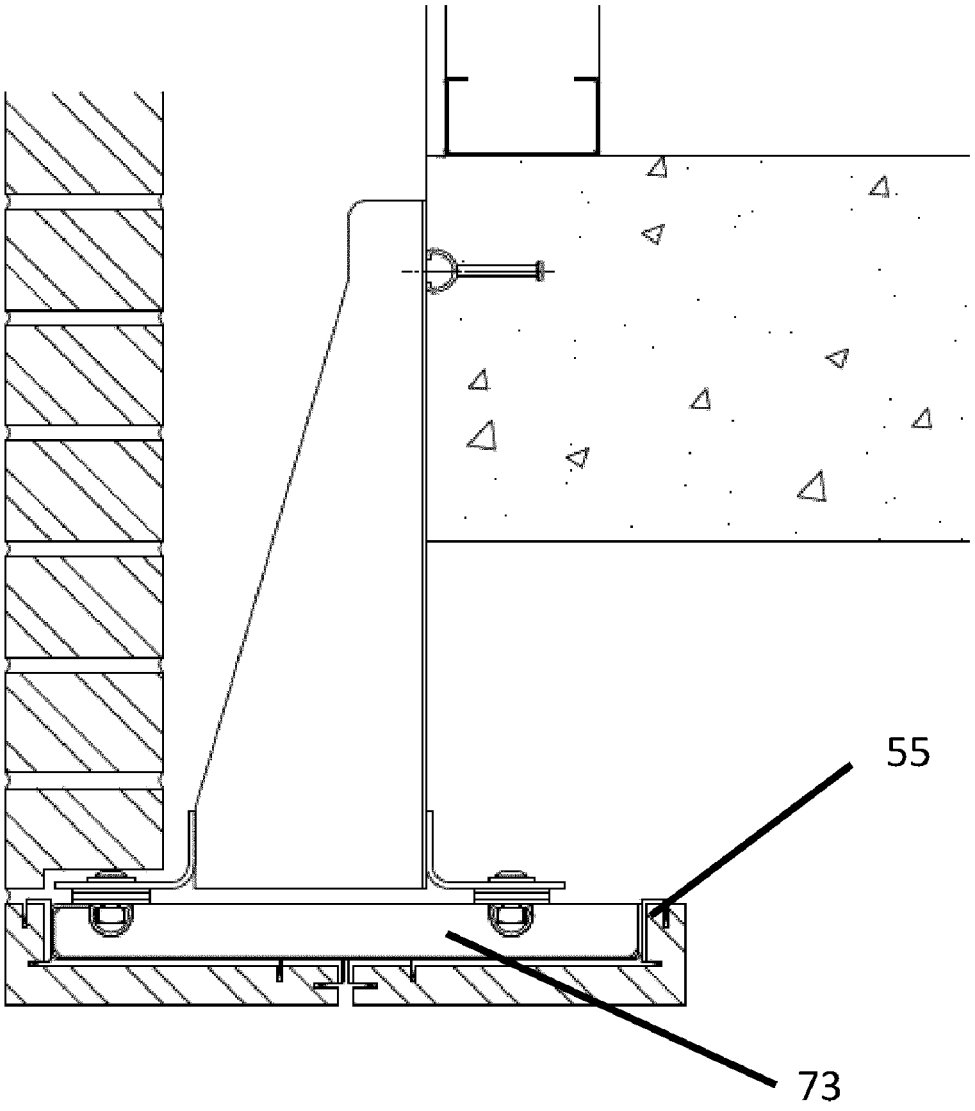
FIG. 25*c* shows another design of a masonry support system
Figure 26B:
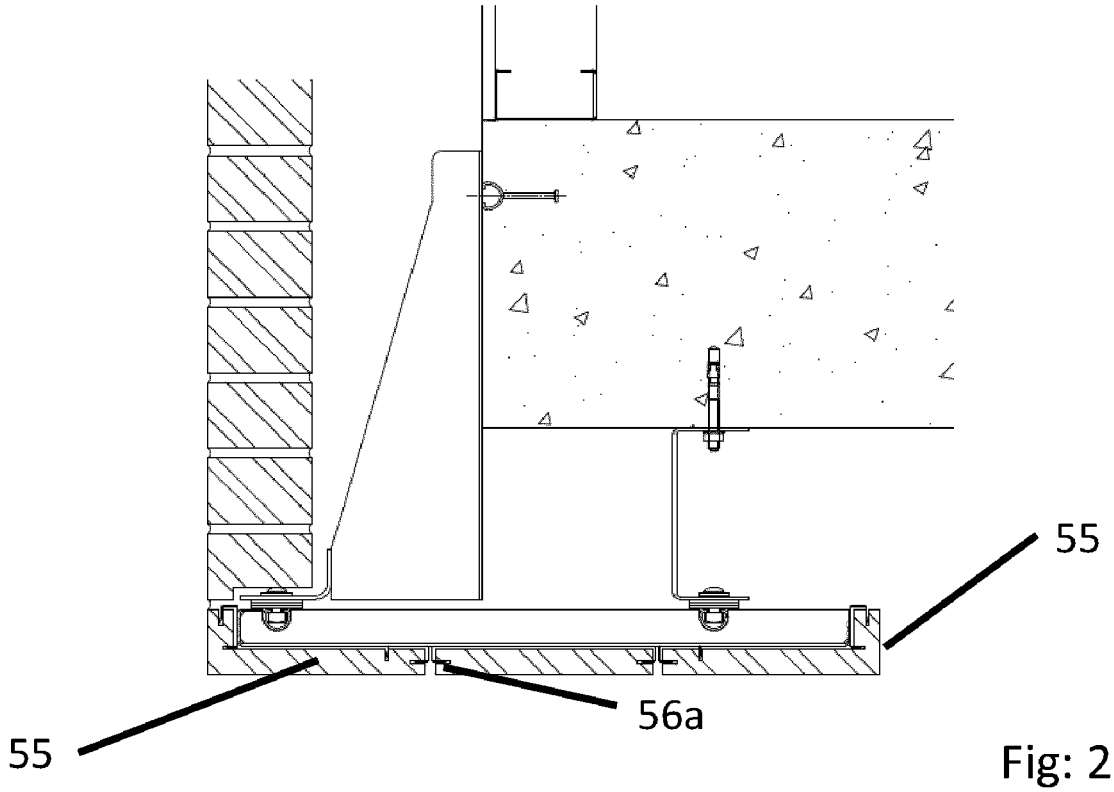
FIG. 26*b* shows another design of a masonry support system

FIGS. 24*c*, 25*c* and 26*b* show variations of the deeper masonry support carriers 73 in which a second soffit transition slip 55 is located at the back of the masonry support carrier 73. In some designs the soffit may include a second soffit transition slip 55 obscuring the rear side of the masonry support carrier 73, and would thus have appropriately located soffit rails 54 to accommodate the same. FIG. 24*a* shows the front soffit transition slip 55 and second soffit transition slip 55 sandwiching two bed face slips 59. FIG. 25*c* shows two soffit transition slips 55 making the complete soffit and obscuring the underlying masonry support carrier 73. A modification of this design is seen in FIG. 26*b* which has a further modified bed channel frame 56*a* and associated slip between the two soffit transition slips 55. It will further be appreciated that each of the above, and following, designs for the masonry support system 70 could incorporate the taller soffit transition slips 55*a*, as required.

Figure 27A:
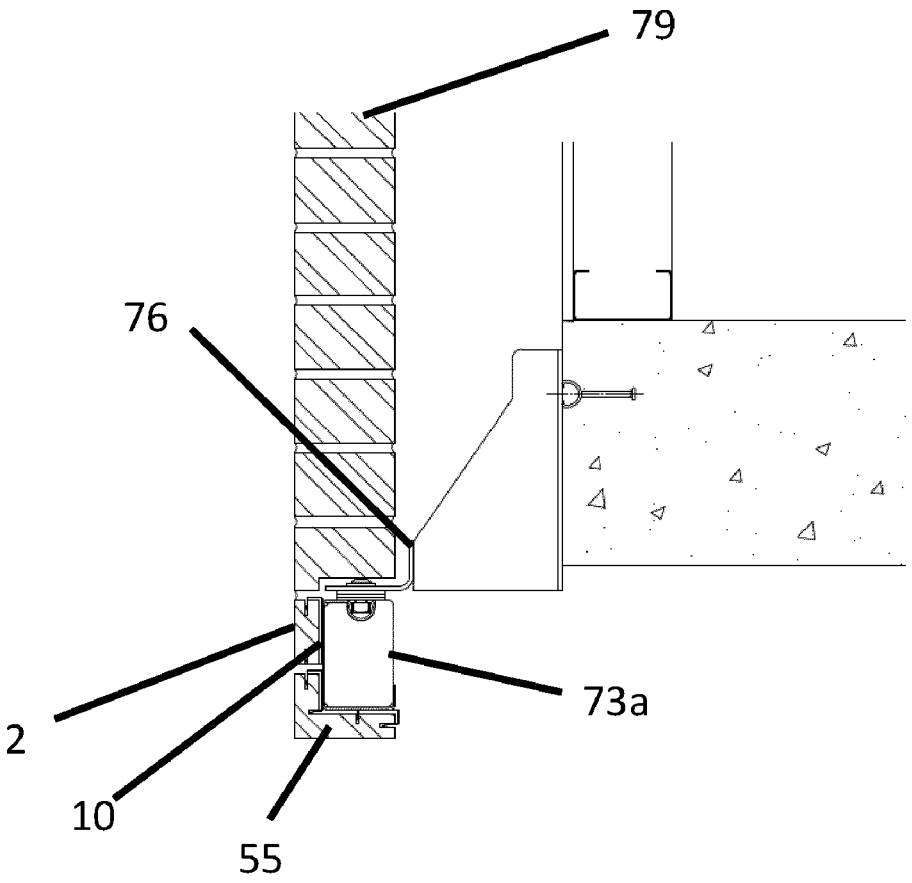
FIG. 27*a* shows another design of a masonry support system
Figure 27B:
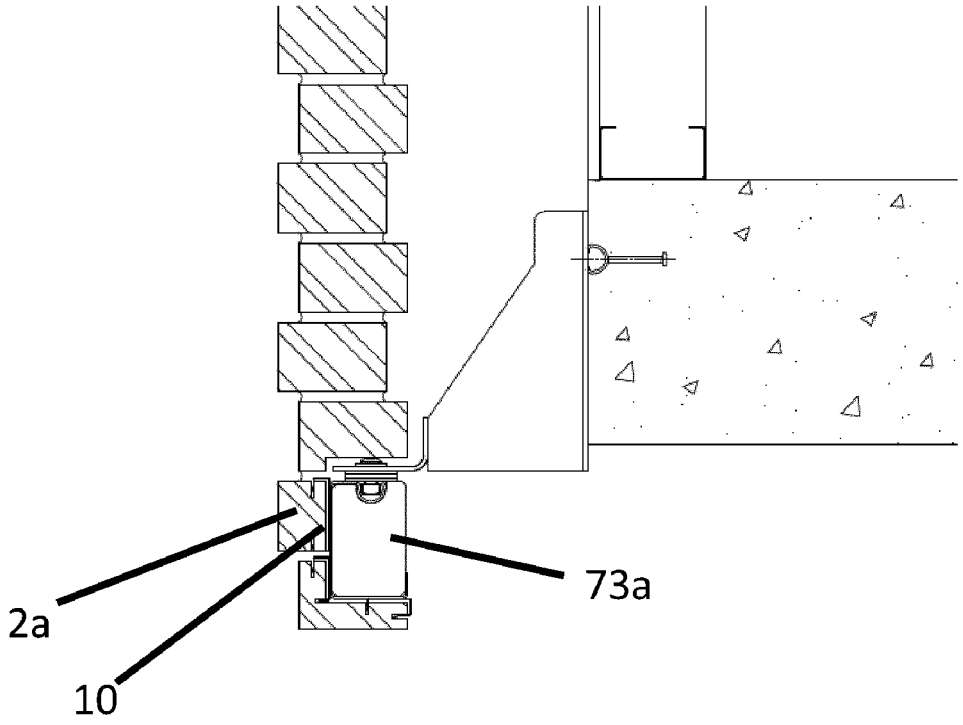
FIG. 27*b* shows another design of a masonry support system
Figure 28A:
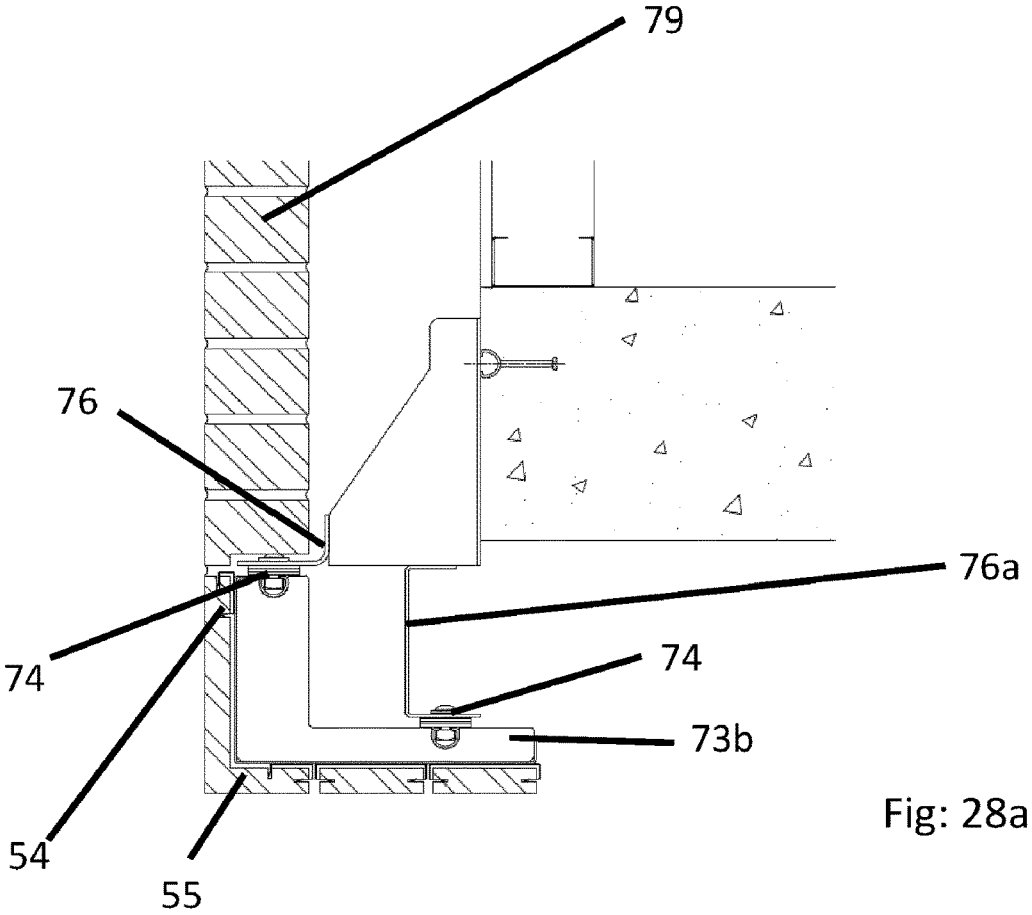
FIG. 28*a* shows another design of a masonry support system
Figure 28B:
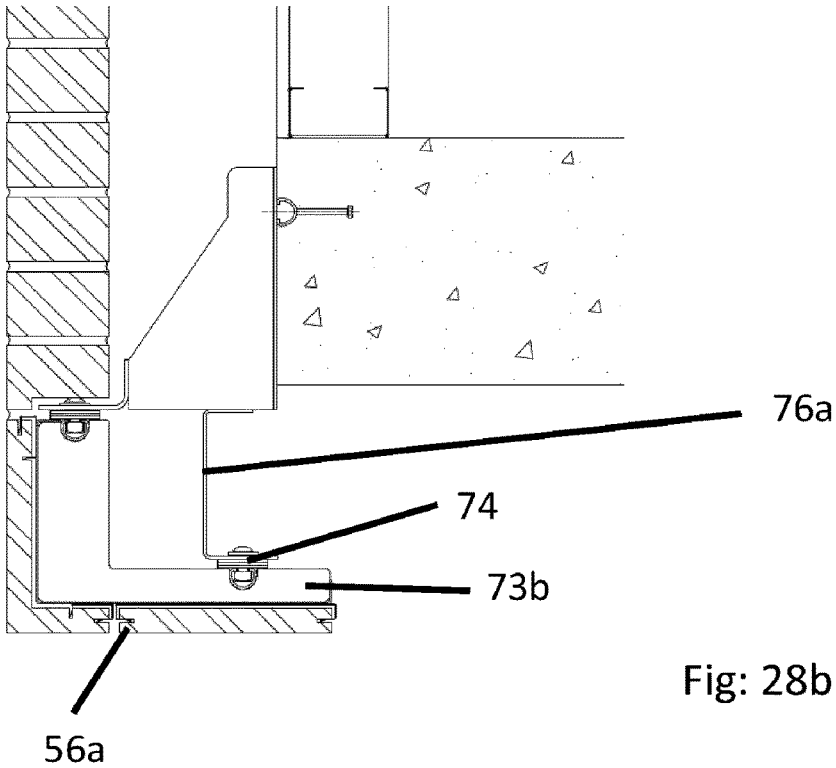
FIG. 28*b* shows another design of a masonry support system
Figure 28C:
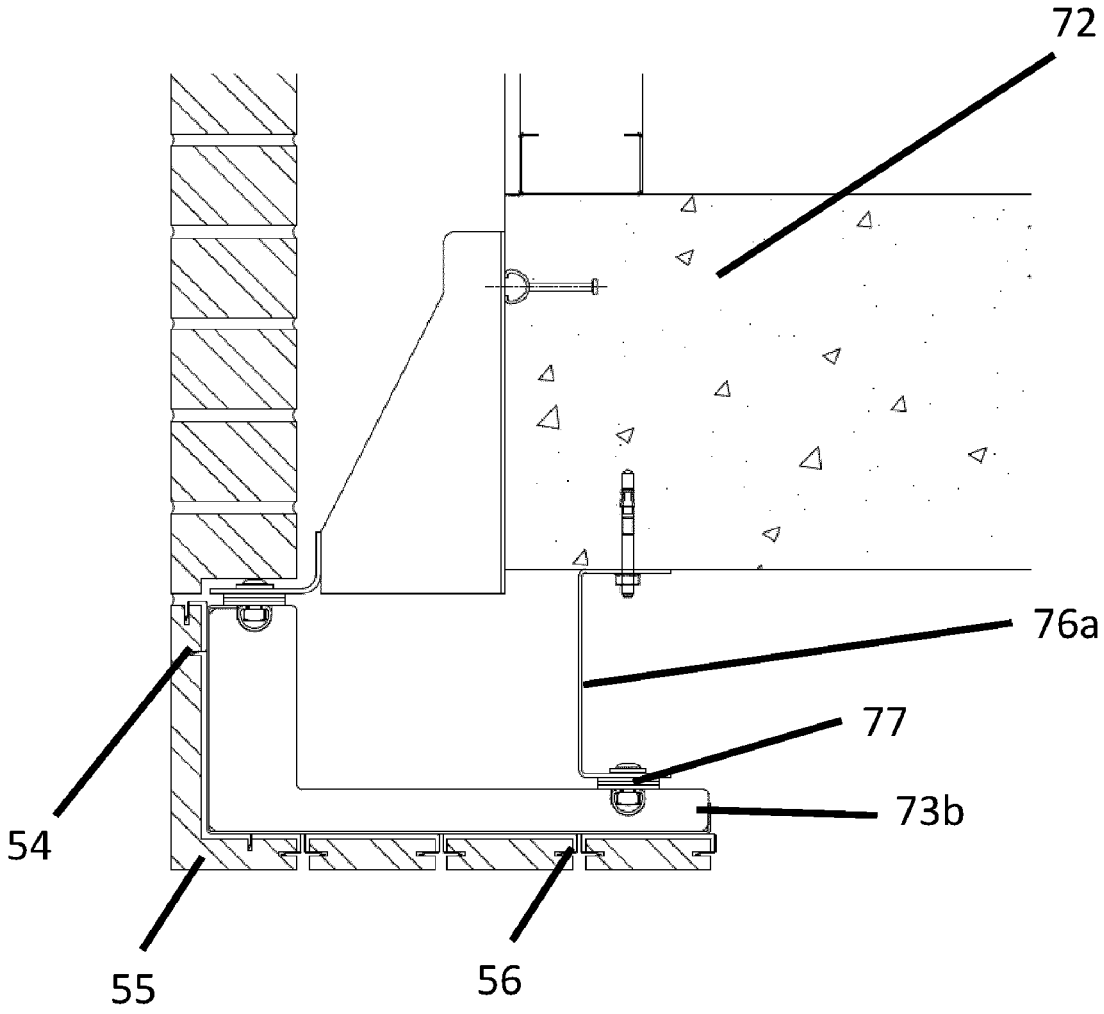
FIG. 28*c* shows another design of a masonry support system

It may, on occasion, be desirable to have multiple masonry slips 2 held by the masonry support system 2 below the external brick cladding 79. FIGS. 27*a* and 27*b* show a taller masonry support carrier 73*a*, as compared with the designs above, which allows for masonry slips 2 to be located in a frame 10 attached to the front of the taller masonry support carrier 73*a* and above the soffit transition slip 55. This allows for the external brick cladding 79 to be supported above the shelf angle 76 in the normal manner, and for further rows of masonry slips 2 to be held below the shelf angle 76. As can be seen in FIG. 27*b*: in some situations, the external brick cladding 79 may comprise bricks which are horizontally offset from neighbouring bricks to give an uneven outer appearance. This can be continued by providing thicker masonry slips 2 integrating with frames 10 on the taller masonry support carrier 73*a*. The same could also be achieved, as desired, by having thicker soffit transition slips 55 and normal thickness masonry slips 2; this is not shown in the Figures. As shown in FIGS. 28*a*, 28*b* and 28*c*, it may be desirable to have the front of the masonry support system 70 showing a taller lower slip. In each of FIGS. 28*a*, 28*b* and 28*c*, the lowest slip is shown as a soffit transition slip 55 oriented with its long face in portrait and facing outward, aligned with the external brick cladding 79. This is by way of example only, and a different form of taller slip may be used instead. Accommodating the soffit transition slip 55 in this orientation is achieved by use of the modified masonry support carrier 73*b* as shown in FIGS. 28*a*, 28*b* and 28*c*. The modified masonry support carrier 73*b* has an L-shaped cross-sectional form and two channel rails 74 for integrating with the shelf angle 76 and the modified shelf angle 76*a* of the masonry support system 70. One of the extensions of the L-shaped modified masonry support carrier 73*b* has a soffit rail 54 attached thereto for interacting with the slot on the soffit transition slip 55. The other extension of the modified masonry support carrier 73*b*, which will be the lower surface forming the soffit in use, has the other soffit rail 54 necessary for holding the soffit transition slip 55. This extension may also comprising one or more bed channel frames 56, as shown in FIGS. 28*a* and 28*c*; one or more modified bed channel frames 56*a* as seen in FIG. 28*b*. In FIGS. 28*a* and 28*b*, the modified shelf angle 76*a* is shown attached to the masonry support bracket 75, the taller masonry support bracket 75*a* may also be used, as required by the final design. In FIG. 28*c*, the modified shelf angle 76*a* is provided attached to the masonry construction 72. In each case, the modified shelf angle 76*a* aligns with the second of the channel rails 74, thus allowing the carrier fixings 77 to attach the rear of the modified masonry support carrier 73*b* to the masonry construction 72.

Figure 30:
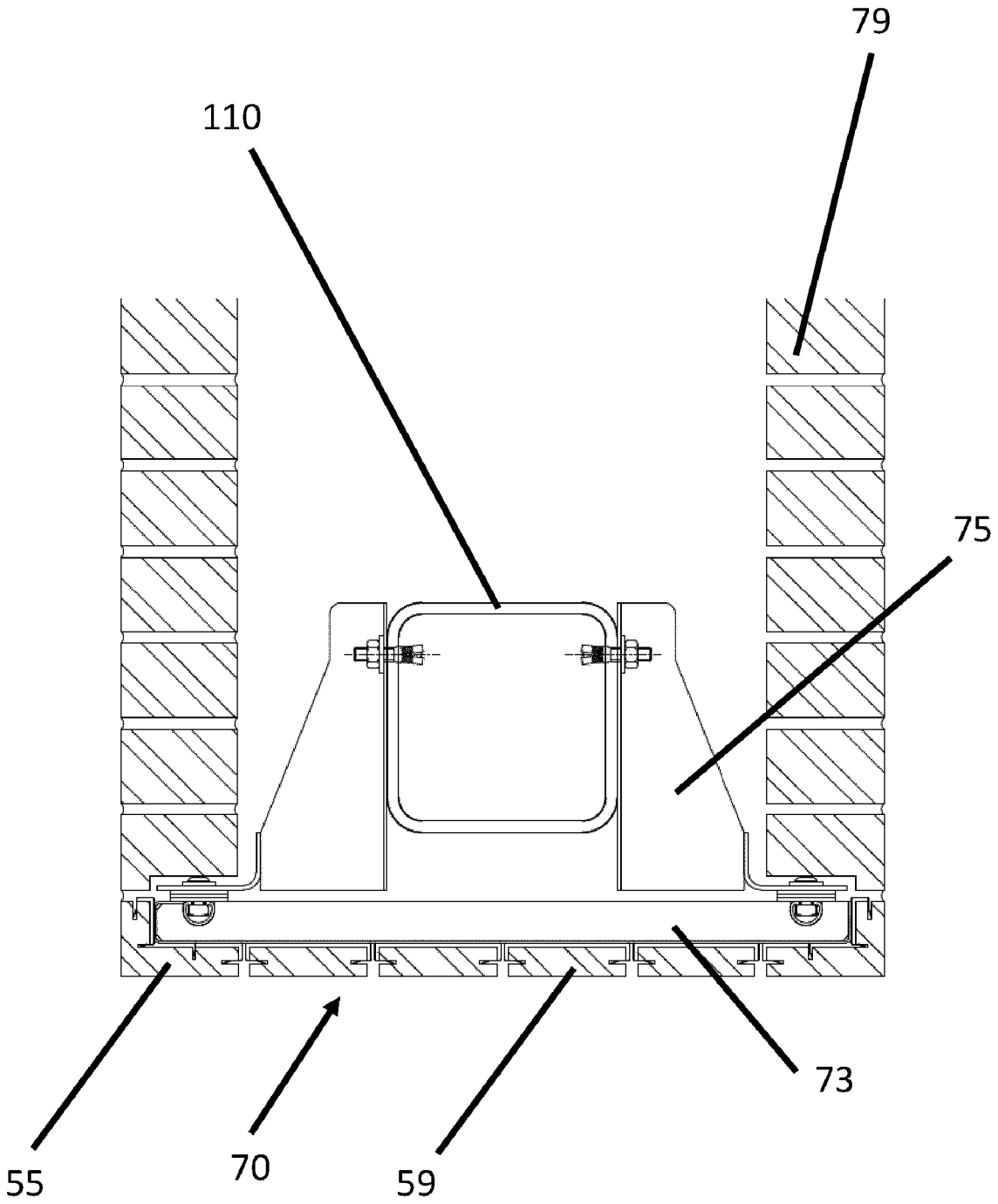
FIG. 30 shows another design of a masonry support system

The design in FIG. 30 shows a masonry support system 70 for providing a soffit under an archway, or the like. Instead of attaching the masonry support brackets 75 to the masonry construction 72 directly as in the above examples, the system of FIG. 30 attaches the masonry support brackets 75 to a girder 110. Girder 110 as shown in FIG. 30 is by way of example only, and whilst FIG. 30 shows this to have an approximately square cross-section, it may have any form including an H cross-section. Additionally, the girder 110 may be replaced by a concrete, wood, or other such material, beam or form, around which the construction of FIG. 30 is to be placed. Two external brick claddings 79 are shown in FIG. 30, and these are joined at their lowest points by the soffit comprising two soffit transition slips 55 and one or more bed face slips 59. The particular soffit transition slips 55 and bed face slips 59 are in no way limited and any of the above slips can be used as desired; furthermore, the bed channel frames 56 or modified bed channel frames 56*a* may be used as may the taller soffit transition slips 55*a*. In FIG. 30, the girder 110 is provided with masonry support carriers 55 either side thereof which are appropriately attached thereto in a load bearing manner: this is shown by means of bolts or rivets in FIG. 30. The taller masonry support brackets 75*a* may also be used, as required. Each masonry support bracket 75 is attached to a respective channel frame 74 of the masonry support carrier 73 via respective shelf angles 76, each of which supports the respective external brick cladding 79 in the normal manner discussed above. The weight of the external brick claddings 79, the masonry support system 70 and associated slips are all transferred to and carried by the girder 110, or other support as provided.

Figure 31:
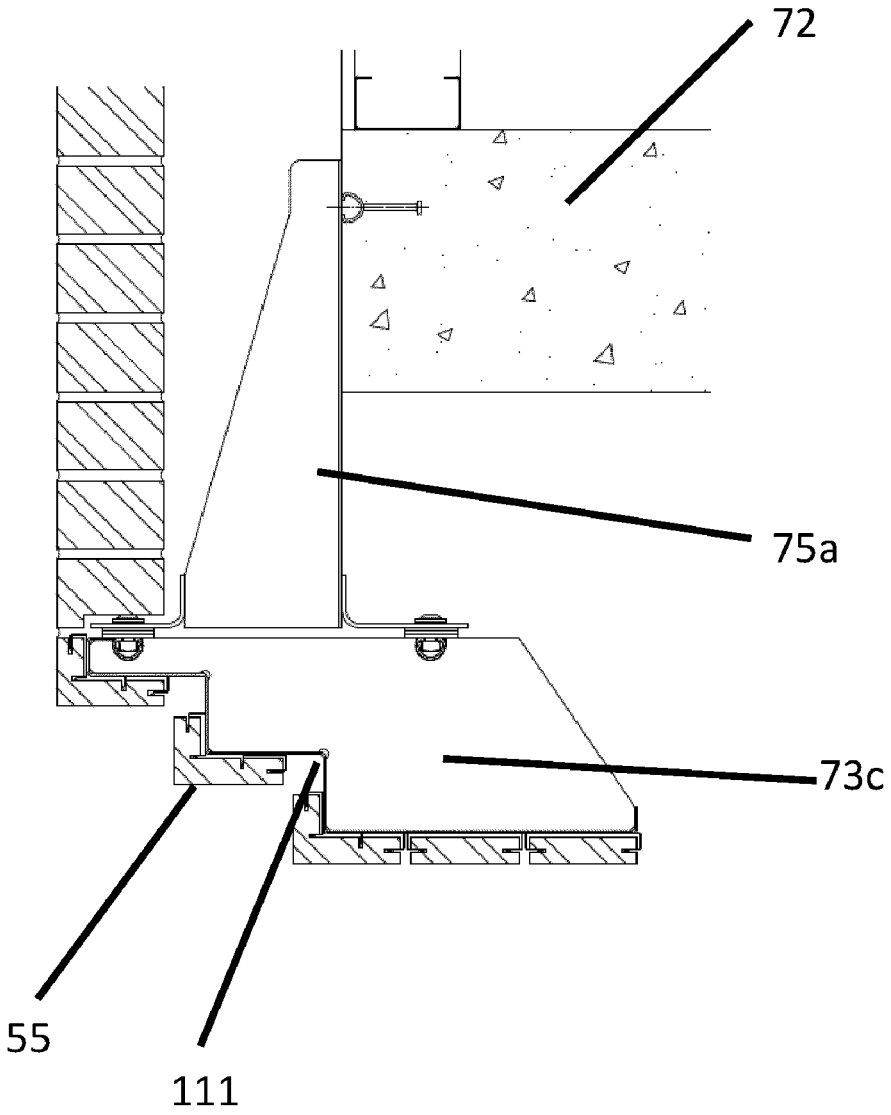
FIG. 31 shows another design of a masonry support system

FIG. 31 shows a stepped masonry support carrier 73*c* for providing a stepped soffit for integration with a building. This stepped masonry support carrier 73*c* provides as series of steps 111 around which appropriate soffit rails 54 are located to allow connection of soffit transition slips 55 or, not shown, taller soffit transition slips 55*a*. A number of bed channel frames 56 or modified bed channel frames 56*a* are provided on the underside of the stepped masonry support carrier 73*c* to complete the soffit underneath the masonry support 72. It will be appreciated that the stepped masonry support carrier 73*c* can be integrated with any of the above concepts for the masonry support systems 70, including the masonry support bracket 75, taller masonry support bracket 75*a* and the modified shelf angle 76*a* in place of the shelf angle 76 shown at the rear side of the taller masonry support bracket 75*a* in FIG. 31.

Figure 32A:
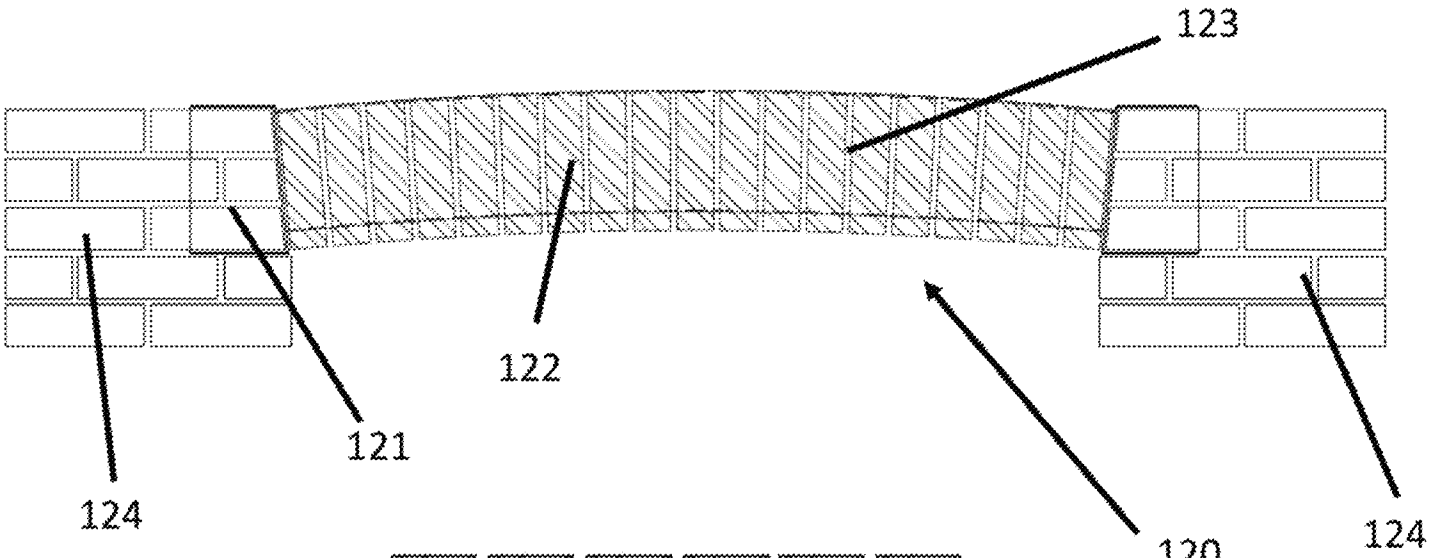
FIG. 32*a* shows a design for an archway
Figure 32B:
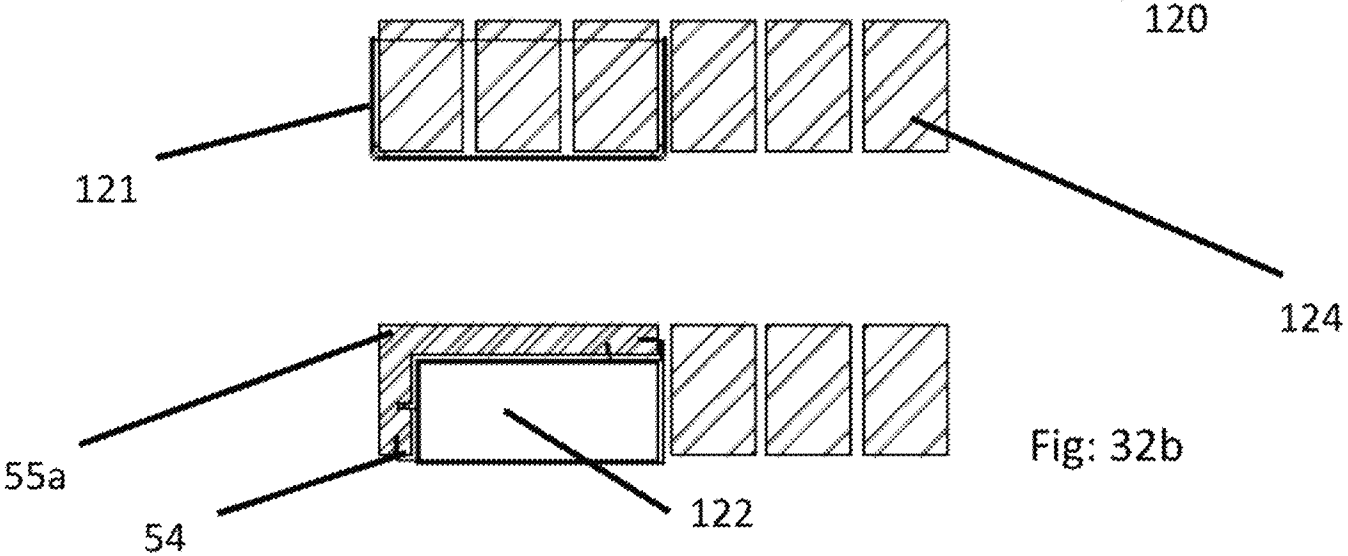
FIG. 32*b* shows cross-sectional views of aspects of the archway in FIG. 32*a*
Figure 32C:
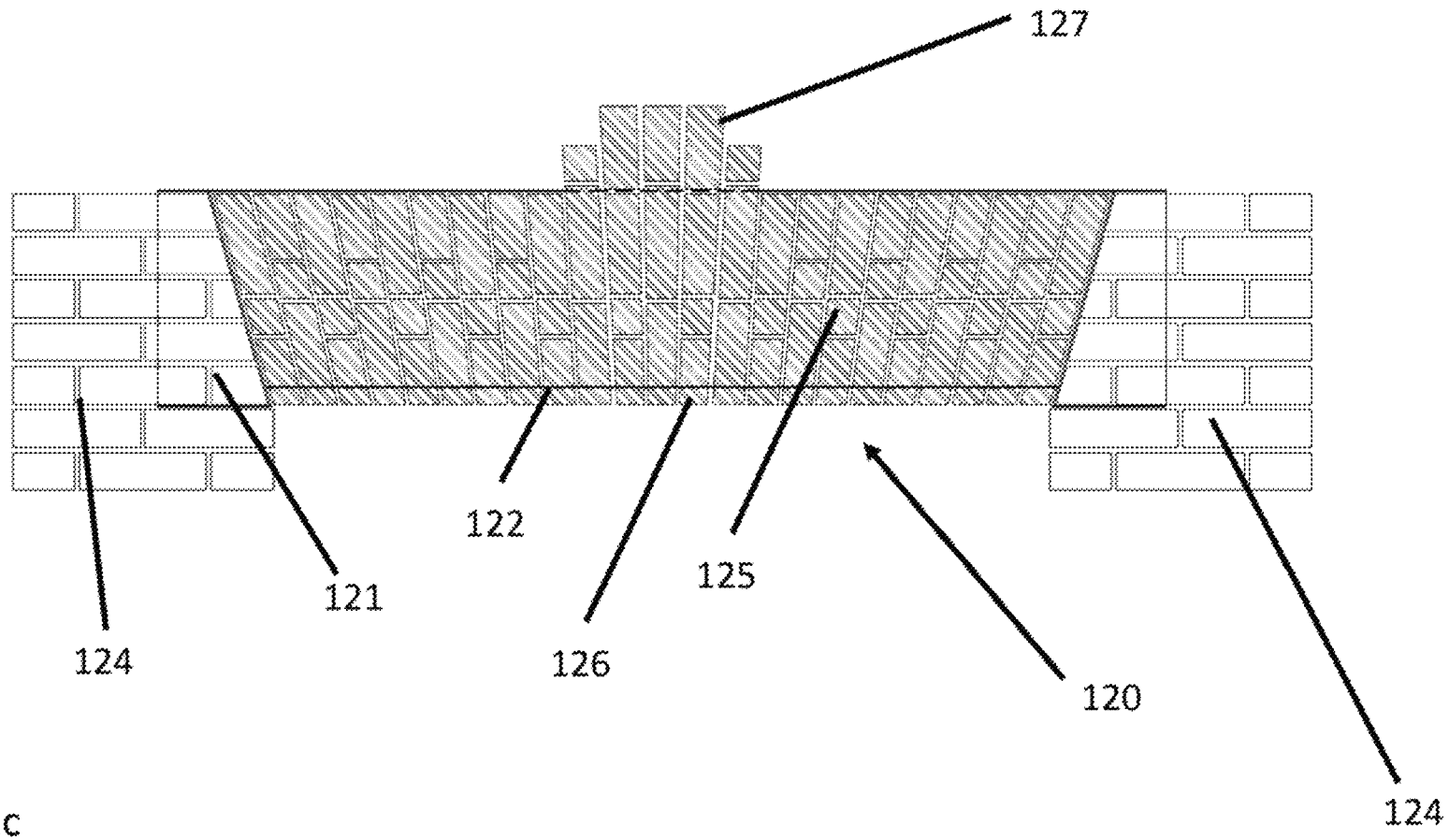
FIG. 32*c* shows another design for an archway
Figure 32D:
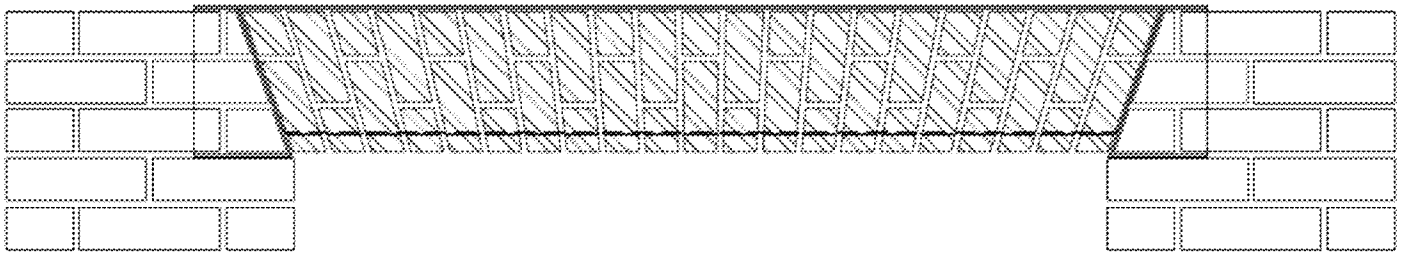
FIG. 32*d* shows another design for an archway
Figure 32E:
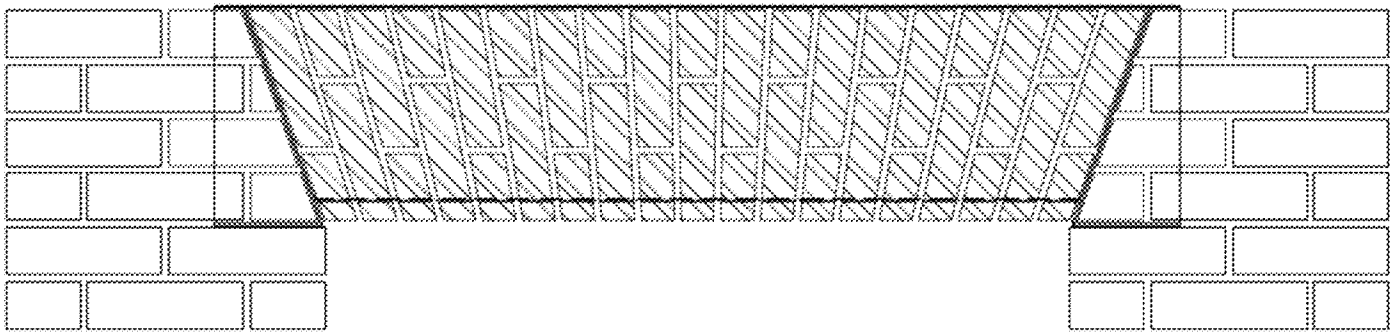
FIG. 32*e* shows another design for an archway

FIG. 32*a* shows an example of an arch support 120 for making a free standing archway 123 across a gap between two brick walls 124. In some cases, it may be desired to have an archway 123 spanning a gap, wherein the brick walls 124 either side of the gap are not able to support the final archway construction or the archway 123 is desired to be too long and/or thin and/or tall to support its own weight. The arch support 120 comprises two lintel sections 121, each of which is intended and adapted to fit within the brick courses of the brick walls 124. The lintel sections 121 have the same form as the lintel 91 shown in, and discussed above in relation to, FIGS. 23*a* to 23*j*. Each lintel section 121 has a straight-sided C cross-sectional form for being held within the brick course of the brick walls 124 either side of the gap. The lintel sections 121 are shown in the front view of FIG. 32*a*, although in reality they would not be visible as they would be held within or behind the brick walls 124. The left image of FIG. 32*b* shows the lintel section 121 integrated with the brick wall 124 in the same manner as seen in FIGS. 23*a* to 23*j*. Attached to, and located between, each of the lintel sections 121 is an arch lintel 122, which is a construction spanning the gap between the two lintel sections 121 and the two brick walls 124. Arch lintel 122 in FIG. 32*a* is slightly curved to provide a curved archway 123; the designs shown in FIGS. 32*c* to 32*e* provide straight arch lintels 122. Any desired form of the arch lintel 122 is, in principle, possible, as the weight of the construction is born through the lintel sections 121 to the two brick walls 124. As can also be seen, the lintel sections 121 may incorporate any desired number of brick courses in the brick walls 124 to attach the archway 123 to the brick walls 124: in FIG. 32*c* there are five brick courses within the lintel sections 121, FIG. 32*e* shows four brick courses within the lintel sections 121.

The right hand image of FIG. 32*b* shows the arch lintel 122 comprising two soffit rails 54 and a taller soffit transition slip 55 in a portrait orientation. This is, of course, exemplary. The arch lintel 122 can comprise any of the frames 10, soffit rails 54, bed channel frames 56 and modified bed channel frames 56*a* as required to provide a final archway 123 with the desired final look by means of appropriate slips integrating with the frames. FIGS. 32*c* to 32*e* show slanted masonry slips 125 on the front, exposed face of the arch lintel 122 to give the desired final optic to the archway 123. These slanted masonry slips 125 may have appropriate slots on their edges in the same manner as the masonry slips 2 for portrait or landscape interaction with the frames on the arch lintel 122. Additionally, there may also be slanted soffit masonry slips 126 extending underneath the archway 123 as seen in the right hand image of FIG. 32*b*. Further decoration may be present on the archway 123, such as the crest 127; this may be attached in normal bricks or be further slips attached to underlying frames, as desired.

Whilst the designs shown in FIGS. 32*a* to 32*e* are presented for use as a freestanding archway, it will be understood that the arch lintel 122 may be used as a load bearing lintel in the same manner as discussed above. The lintel sections 121 could be integrated into the brick walls 124 either side of the gap which is to be spanned, and then appropriate slips can be loaded into the soffit rails 54, as shown in the right hand image of FIG. 23*b*. The upper exposed surface, making the upper part of the straight-sided C, may then be used as a surface onto which further bricks may be mounted and held in a load bearing manner. It would even be possible to use the curved archway 123 according to FIG. 23*a* and have curved rows of bricks there-above. As a final matter, the rear side of the arch lintel 122 may comprise an extending bracket thereto (not shown in the figures) which has a lower surface extending rearward of the archway 123 and which may be used for mounting bed channel frames 56, modified bed channel frames 56*a* and the like. These frames on the underside of the extending bracket can then house appropriate slips and the soffit can be generated rearward of the archway 123.

In use, each of the masonry support carrier 73 or lintel carrier 93 can be preloaded with the appropriate soffit transition slips 55 and bed face slips 59, as appropriate, and these may be mortared in position prior to the lintel carrier 93 or bolt-up unit 71 being integrated with the respective lintel support system 90 or masonry support system 70, respectively. Indeed, it is possible to preload the slips 55, 59 into the respective soffit rails 54 and bed channel frames 59 away from the worksite, deliver the preloaded items and integrate these into the final construction thus reducing the amount of work which must be undertaken on the construction site. As will be clear, the gap which is to be bridged by either the masonry support system 70 or lintel support system 90 will have an integer number of soffit transition slips 55 as a width whilst also incorporating the mortar course there-between, in order that the final structure appears to be a brick construction wall with an archway or gap therein. As is shown in FIG. 22, depending upon the desired form of the soffit transition slip 55 and how this integrates with the wall either side of the arch or gap way, the soffit transition slip 55 may actually form part of the wall 92. As can be seen in FIG. 22 at the position of the upper right of the gap in the wall 92, the brick is missing and will be appropriately replaced by means of the soffit transition slip 55. It will be appreciated that the choice of soffit transition slip 55 determines the length of the lintel carrier 93 or bolt-up unit 71, so as to properly integrate the soffit transition slips 55 into the final building construction. To this end, the system is extremely flexible, allowing the designer of the building to achieve any desired brick work effect whilst also ensuring that the brick work above the archway or gap is properly supported either on the masonry construction 72 or by means of the lintel 91. This preloading of slips can also be undertaken in each of the structures described above, including the archways 123, prior to delivery at the worksite. Furthermore, the orientation of the slips which are included in each of the structures above is only limited by the size and shape of the slips and the location of the relevant frame for holding the same. It will be appreciated that the location and orientation of the slips can be changed to include straight arrangements in which the longitudinal axes of the bricks all align and the long edges are also in complete alignment in the final structure. Other options allow for the normal half-overlapping structure of the slips as in a "normal wall" and seen in FIG. 3. Not only can the vertical walls be so populated with slips, the soffits and archways as described above can also be populated with such patterns to the slips. There is no limit to the placement, orientation and final patterning of the slips—all of these can be accommodated by appropriately placing the correct frames for holding the slips.

Considering the pre-fabricated masonry panel 4, as seen in FIG. 3 and the masonry framework 1 of FIG. 1, it will be appreciated that these are designed to hold the masonry slips 2 in a generally horizontal orientation. That is, the masonry slips 2 have their front faces oriented in a landscape format to appear like normal brickwork. There are occasions, either for aesthetic or structural reasons, when it is desired that the masonry slips 2 are configured in a portrait format, with their long sides extending approximately, or actually, vertically. Perhaps a façade is desired which continues the orientation of the masonry slips 2 around and beyond the slips shown in FIG. 16*g*. The frame 10 as described above and in relation to at least FIGS. 4*a* and 4*b*, can also accommodate such a vertical arrangement of masonry slips 2 to allow for construction of a portrait pre-fabricated masonry panel 99, as seen in FIG. 33*c*.

Figure 33A:
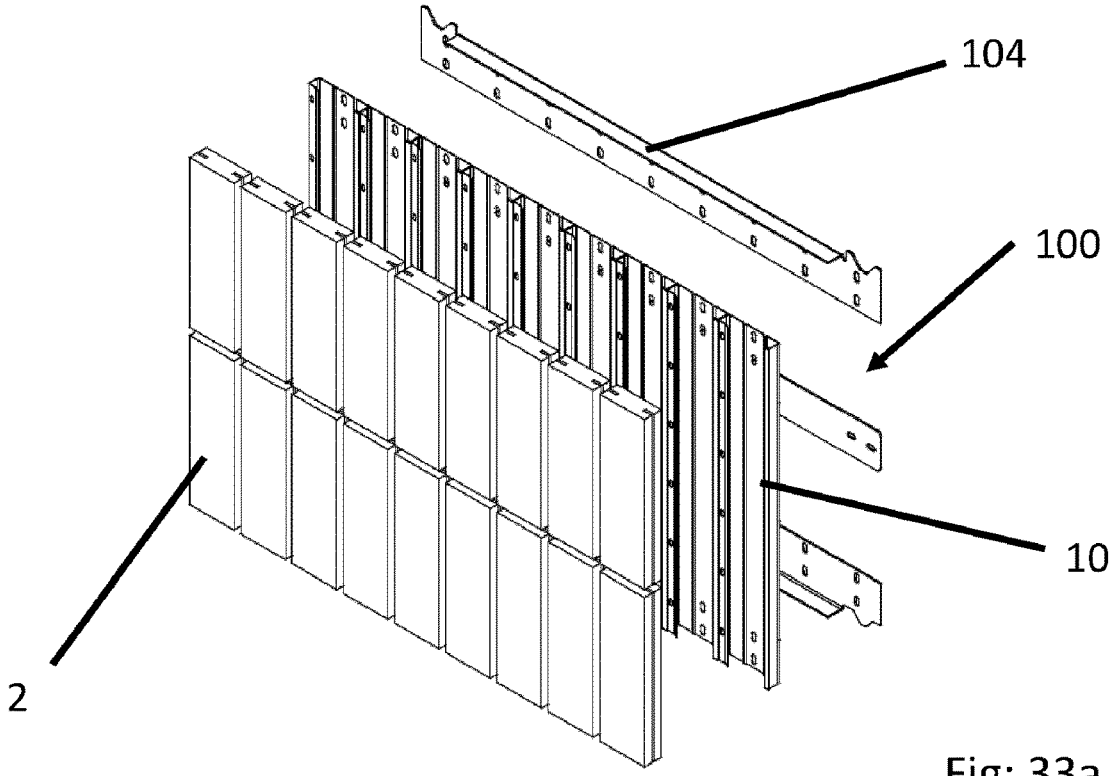
FIG. 33*a* shows an exploded view of a vertical masonry framework
Figure 33B:
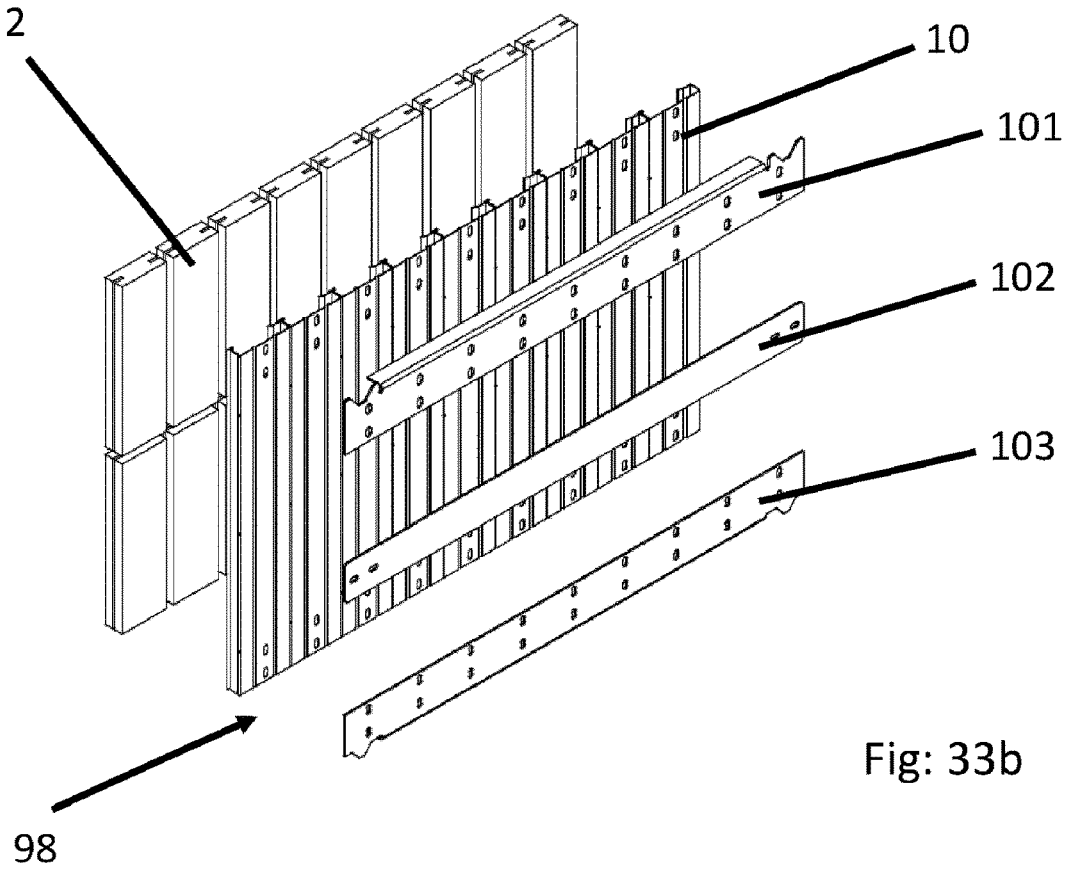
FIG. 33*b* shows another view of the vertical masonry framework of FIG. 33*a*
Figure 33C:
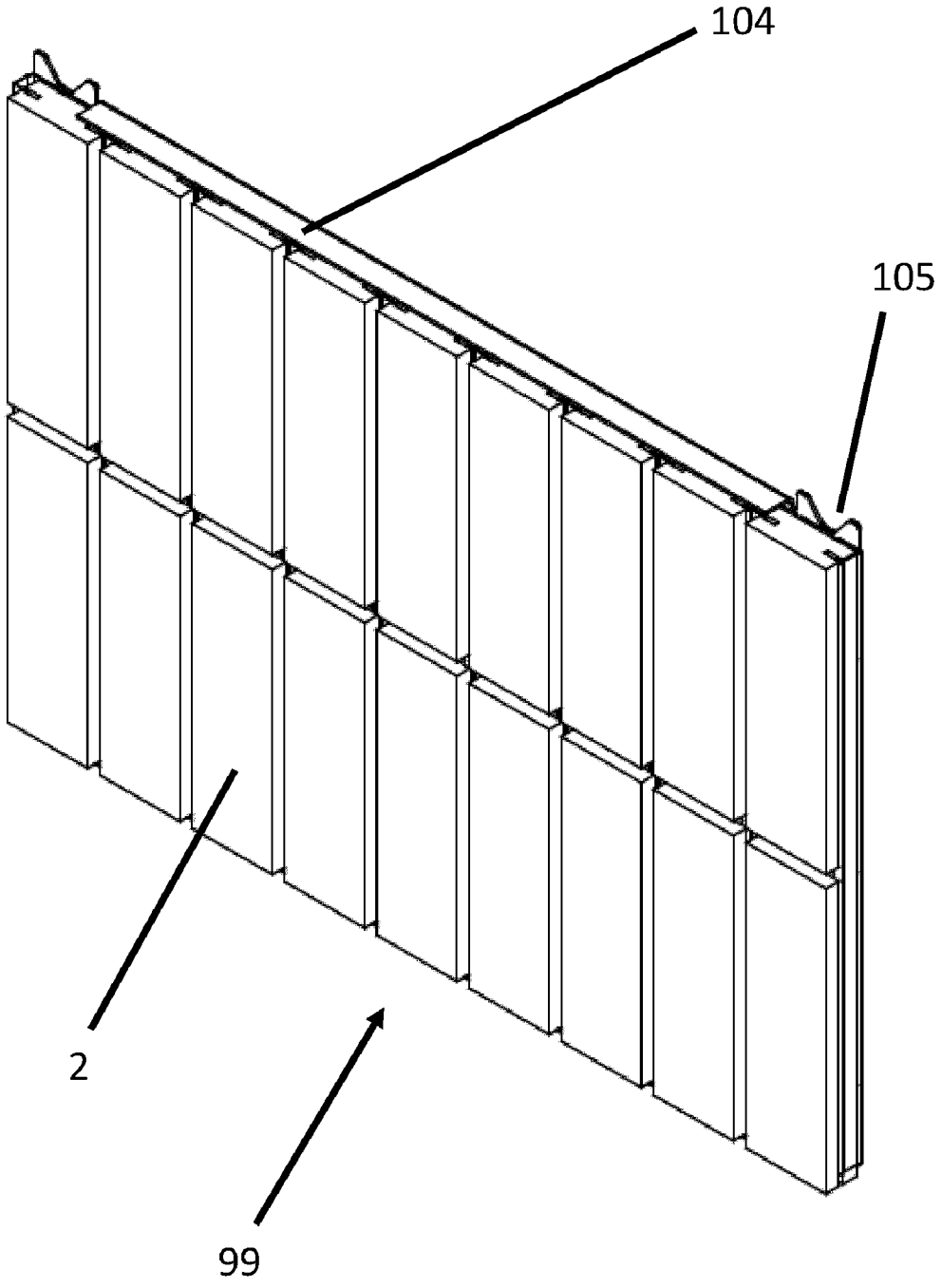
FIG. 33*c* shows a pre-fabricated vertical masonry panel

FIGS. 33*a* and 33*b* show exploded views of the portrait pre-fabricated masonry panel 99 of FIG. 33*c*. To a first order, the masonry framework 1 of FIG. 1 has been rotated by 90° such that each of the frames 10 extend vertically, rather than horizontally. The frames 10 are otherwise the same as each of the embodiments of frames 10 described above, and when arranged side-by-side form the vertical masonry framework 98 when the frames 10 are combined with a jointing structure 100, as seen in FIGS. 33*a* and 33*b*. The same masonry slips 2 as described above may also be used with the vertical masonry framework 98, generally interfacing with the frames 10 in the same manner as shown above in FIG. 5—albeit, rotated by 90°. As further discussed above, the frame 10 is structured such that the slots 3 on the masonry panel 2 are firmly engaged with the upper lip 11 and lower lip 12. The frame 10 when used in the vertical masonry framework 98 will bring the same benefits as in the masonry framework 1 described above: the firm engagement between the upper lip 11 and lower lip 12, even when these are positioned within the slots 3 on either side of the vertically oriented masonry slip 2, will assist in holding the vertically oriented masonry slips 2 in position to complete the façade. The upper lip 11 and lower lip 12 are obviously no longer located above and below the masonry slips 12, however for convenience the same terms are used in this vertically oriented frame 10.

As can be seen in FIGS. 33*a* and 33*b*, the side-by-side frames 10 making up the vertical masonry framework 98 are generally held together by a jointing structure 100. The jointing structure 100 preferably comprises an upper jointing plate 101 and a lower jointing plate 103. The frames 10 are each attached to the upper jointing plate 101 and lower jointing plate 103 to form the vertical masonry framework 98. This connection can be by any suitable means, for example by welding or with the use of nuts and bolts, rivets, screws and the like. Conveniently, the holes or slots in the frames 10, discussed above with relation to the structure shown in FIGS. 6 and 7, for attaching to the jointing plates 20 may also be used to connect the frames 10 in the vertical orientation with the upper jointing plate 101 and lower jointing plate 103. This means that the frames 10 do not need any special handling to allow them to be utilised in the horizontal or vertical orientation.

As will be appreciated, attaching the vertically oriented frames 10 at only their respective tops and bottoms, in use, to the upper jointing plate 101 and lower jointing plate 102 may allow the frames some degree of relative movement. In particular, the two ends of the frames 10 may be moved with respect to each other such that the vertical alignment is lost; this is generally undesirable. In order to add further stability to the vertical masonry framework 98 and pre-fabricated vertical masonry panel 99, and to avoid relative movement of the adjacent frames 10, an additional middle jointing plate 102 can be provided. This middle jointing plate 102 is shown in FIG. 33*b* and provides a further point of contact between one or more of the vertical frames 10, thus minimising or mitigating relative movement of the frames 10. As will be seen in FIG. 33*b* the middle jointing plate 102 only need to connect to the frames 10 at the respective horizontal ends of the vertical masonry framework 98. Each of the frames 10, or just the two end frames 10, can be provided with appropriate slots or holes along their length, such that each may be connected to the middle jointing plate 102 when provided with rivets, nuts and bolts, screws or the like. Additionally and/or alternatively, the middle jointing plate 102 may be welded to the rear sides of the back planes 14 of each of the frames 10, thus ensuring that the frames 10 are held at a third point along their lengths to hold the relative vertical alignment.

As a further mechanism to add stability to the structure, either or both of the upper jointing plate 101 and lower jointing plate 103 can be provided by a flange 104 extending along one of the long sides of the respective jointing plate 101, 103. This flange 104 will provide an L-form to the respective jointing plate 101, 103. Such a flange 104 can either be an integral part of the respective jointing plate 101, 103, perhaps formed by folding over a part thereof to form the L-form in cross-section. Alternatively, the flange 104 may be a separate element which is attached to the respective jointing plate 101, 103 to provide the strengthening L-form. In the FIGS. 33*a* to 34*b*, it will be noted that these show both the upper jointing plate 101 and lower jointing plate 103 provided with a flange 104. Another benefit of the flange 104, is that this provides a surface against which the masonry slips 2 can rest when added into the frames 10. Whilst the masonry slips 2 will be firmly engaged into the frames 10 and should not slip under gravity as a result of the upper lip 11 and lower lip 12, the presence of the flange 104 will ensure that if the pre-fabricated vertical masonry panel 99 is exposed to mechanical shocks then the masonry slips 2 will be stopped from sliding out of the end of the frames 10.

Figure 34A:
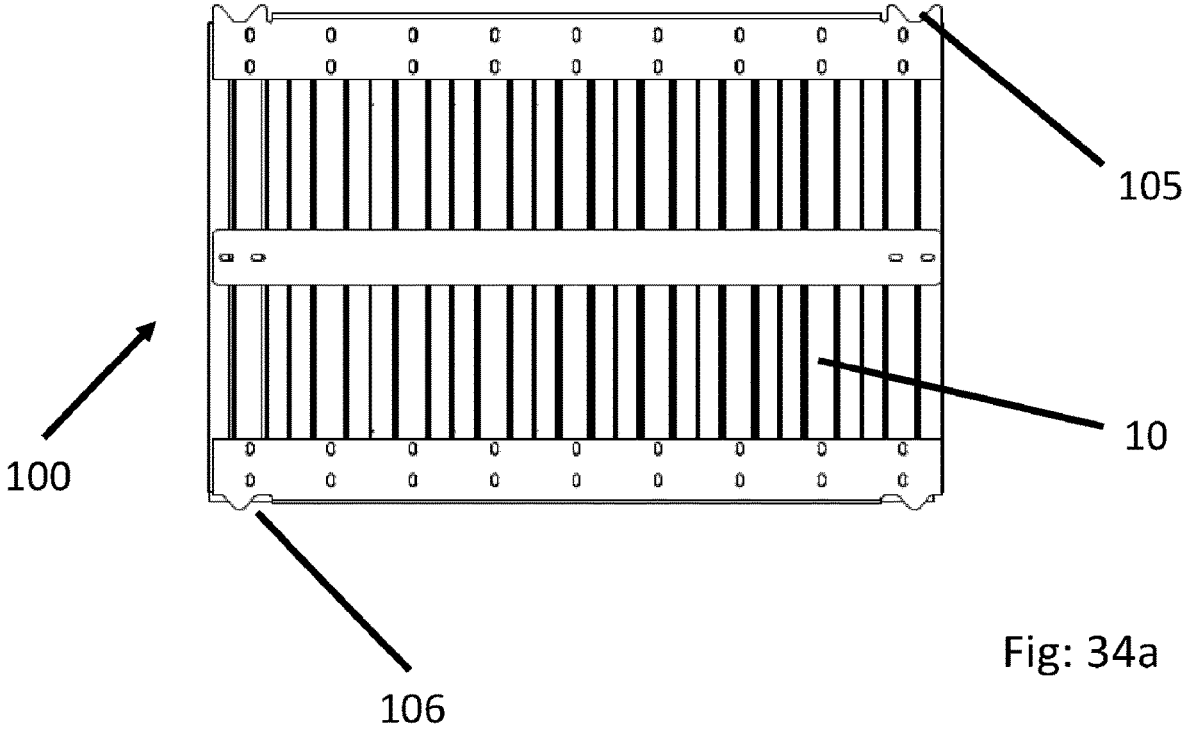
FIG. 34*a* shows the rear side of the pre-fabricated vertical masonry panel of FIG. 33*c*
Figure 34B:
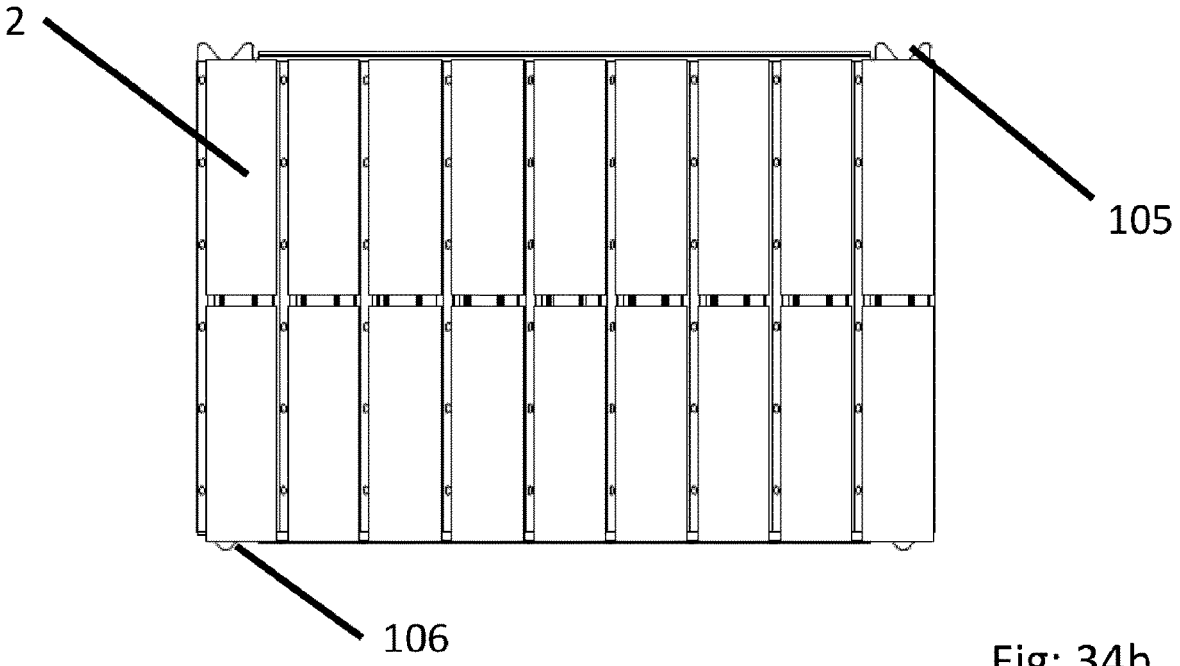
FIG. 34*b* shows the front side of the pre-fabricated vertical masonry panel of FIG. 33*c*

In the same manner that the jointing plates 20 described above comprise a tongue 22 and an appropriate indent 23 to ensure proper alignment, such features are also embodied in the upper jointing plate 101 and the lower jointing plate 103. As best seen in FIG. 34*a*, the two ends of the upper jointing plate 101 at the upper edge, when in use, are provided with vertical plate indents 105. These are shaped, preferably, to appropriately interact with the tongues 22 of the jointing plates 20 thus ensuring proper alignment between adjacent structures. In the same manner that the upper jointing plate 101 is preferably provided with the vertical plate indents 105, the lower jointing plate 103 is preferably provided with vertical plate tongues 106 extending below the lower edge, when in use, of the lower jointing plate 103. The vertical plate tongues 106 are located at each end of the lower jointing plate 103, such that the vertical plate tongues 106 will appropriately align with the vertical plate indents 105 ensuring that vertically adjacent vertical masonry frameworks 98 are properly aligned. This can be understood as possible when considering the vertical pre-fabricated masonry panel 99 of FIG. 34*b*, wherein the vertical plate tongues 106 will align with the vertical plate indents 105.

Whilst the jointing structure 100 has been described above as separate jointing plates 101, 102, 103, each vertical masonry framework 98 can be provided with a single frame-jointing structure, such a design is not shown in the Figures. Such a frame-jointing structure could have a rectangular form, wherein the upper and lower ends of each of the frames 10 attach to each of a first pair of opposing sides of the frame, respectively. The second pair of opposing sides of the frame-jointing structure which join together the ends of the first pair, may be attached to the end frames 10 to add stability; the second pair of sides of the frame-jointing structure will ensure that the first pair of sides as well as the attached frames 10 cannot move with respect to each other, this will be achieved with or without attachment to the end frames 10. Alternatively, the frame-jointing structure could be provided with an "H" form, rotated by 90° so that the respective ends of the frames 10 attach to the two opposing sides. The cross-piece of the H-form will appropriately hold the two opposing sides in alignment, thus reducing the relative movement of the frames 10 in the vertical masonry framework 98.

The invention claimed is:

1. A frame for retaining one or more masonry slips, the one or more masonry slips each having two slots formed on two sides thereof, respectively, the frame comprising:

an elongate channel structure comprising a back plane with two extensions extending away from the back plane, wherein the two extensions and the back plane together form a continuous U-shaped channel structure, two lips extending from distal edges of the two extensions configured so as to engage with each of the two slots on the one or more masonry slips respectively when said one or more masonry slips are present, so as to thereby hold the one or more masonry slips within the elongate channel when said one or more masonry slips are present, wherein a first of the two lips has a straight portion which extends substantially parallel to the back plane and an angled end portion at the end of the straight portion which projects in a direction away from the back plane, thereby making an angle with the straight portion;

wherein the second of the two lips is formed by bending the material of the frame back on itself to create a multi-layered structure;

wherein the thickness of the second of the two lips matches the thickness of the slot in the one or more masonry slips such that the second of the two lips will form a friction fit with the slots of the one or more masonry slips.

2. The frame according to claim 1, wherein the angle and length of the angled end portion is tailored to ensure that a distance in a direction normal to the surface of the back plane, between a rear side of the straight portion of the first lip, the rear side being the side nearest the back plane, and a distal edge of the angled portion matches the width of the slot in the one or more masonry slips.

3. The frame according to claim 1, wherein the angled end portion is shaped to ensure that the first lip will fit within the slot of the one or more masonry slips and hold the one or more masonry slips in place without deformation of the lip whilst making contact with one side of internal side surfaces of the slot in the one or more masonry slips, optionally wherein the first lip is sized, shaped and located such that the rear side of the straight portion of the first lip will rest on the one internal side surface of the slot of the one or more masonry slips and the end of the angled end section will rest on an opposing internal side surface of the slot in the one or more masonry slips without deformation of the lip thereby holding the one or more masonry slips in place by means of surface and edge contact with the internal surfaces of the slot of the one or more masonry slips.

4. The frame according to claim 1, wherein the two extensions extend substantially normal to a back plane, in the same direction, to thereby form the channel; or wherein the second of the two lips has a straight portion which extends substantially parallel to the back plane and wherein the straight portions of the first lip and the second lip extend in directions toward each other.

5. The frame according to claim 1, wherein a gap exists between layers of the multi-layer structure of the second lip, the gap configured such that the total thickness of the second lip matches the thickness of the slot in the one or more masonry slips, optionally wherein the gap increases in width when moving away from the fold, so as to provide a second lip which has a width at the portion away from the fold which is greater than the width of the slot in the one or more masonry slips, thereby providing a friction fit with the one or more masonry slips.

6. The frame according to claim 1, wherein a section of the second lip which has been bent over is longer than the section of the second lip which is not bent over.

7. The frame according to claim 1, wherein back surfaces of each of the lips are spaced an equal distance from the back plane; or wherein the frame is formed from a single piece of material, which has been bent or rolled into the final form; or wherein the distance between opposing edges of the two lips is smaller than the width of the one or more masonry slips and is larger than a solid section of the one or more masonry slips, which solid section is a portion between internal ends of the slots; or wherein the back plane has one or more strengthening ridges running along the length of the frame; or wherein the frame has strengthening bumps, bubbles or extensions along one or more folds or bends between parts of the frame which are connected together.

8. The frame according to claim 1, wherein each of the extensions on the frame is connected with the back plane via respective angled sections, such that the two extensions extend away from the back plane at locations offset from either elongate edge of the back plane, optionally wherein the two angled sections extend parallel with each other such that when two frames are positioned in a side-by-side arrangement with channels lying parallel and back plates in abutment with each other, the flange formed by one angled section on a first frame will fit within the void formed by the angled section on a second, adjacent, frame; or wherein each of the frames comprise one or more stiffening folds in the back plane running along the longitudinal direction of the frame or soffit rail; or wherein the first of the two lips defines one or more holes therethrough, wherein the one or more holes are optionally in the straight portion of the first of the two lips, optionally defining at least two holes therethrough wherein the spacing between adjacent holes is less than one half of the length of a masonry slip, the length of the masonry slip being taken along the direction of the slot therein; or frames comprising one or more drainage holes extending through the frame at or near an intersection of a back plate or back plane, respectively, with one or both of the extensions, optionally wherein the one or more drainage holes are positioned at or near the intersection which will be located at the lower side of the frame when the frame is in use.

9. A masonry panel comprising one or more frames according to claim 1, the one or more masonry slips each having two slots formed on the two sides thereof, the first of the two lips on each frame and the second of the two lips on each frame respectively engaged with one of the slots on each of the one or more masonry slips, optionally, wherein the one or more masonry slips are formed with two slots of uniform width in opposing edges along the entire length of the masonry slip.

10. The masonry panel according to claim 9, wherein the slots in the one or more masonry slips are a uniform distance from a front face of each masonry slip;

or wherein the first lip is within a first of the slots on each of the one or more masonry slips, and wherein each masonry slip is held in place by means of a surface and edge contact between the first of the two lips and the interior of the slot in each masonry slip, without deformation of the first of the two lips; or wherein the second of the two lips of the frame is located within one of the slots of the one or more masonry slips and each masonry slip is held in the frame by means of a friction fit; or wherein each of the extensions on the frame is connected with a back plate via respective angled sections, such that the two extensions extend away from the back plate at locations offset from either elongate edge of the back plate, optionally wherein the two angled sections extend parallel with each other such that when two frames are positioned in a side-by-side arrangement with their channels lying parallel and their back plates in abutment with each other, the flange formed by one angled section on a first frame will fit within the a void formed be the angled section on a second, adjacent, frame; or wherein each of the frames comprise one or more stiffening folds in the back plate running along the longitudinal direction of the frame; or wherein the first of the two lips defines one or more holes therethrough wherein the one or more holes are optionally in the straight portion of the first of the two lips, optionally defining at least two holes therethrough wherein the spacing between adjacent holes is less than one half of the length of a masonry slip, the length of the masonry slip being taken along the direction of the slot therein; or the frames comprising one or more drainage holes extending through the frame at or near an intersection of a back plate or back plane, respectively, with one or both of the extensions, optionally wherein the one or more drainage holes are positioned at or near the intersection located at the lower side of the frame when the frame is in use.

11. The frame according to claim 1 comprising two or more frames arranged in a side-by-side relationship so that the respective channels thereof lie parallel with each other, the two or more frames being attached to one or more jointing plates, optionally wherein the one or more jointing plates extend across the rear of each of the two or more frames on the side of the two or more frames lying opposite their respective channels; or wherein each jointing plate has an elongate structure with alignment means at each of the longitudinal ends thereof that enable alignment of neighbouring masonry panels, optionally wherein the alignment means comprise extensions and/or recesses which will interlock with respectively configured alignment means on an adjacent jointing plate, thereby ensuring alignment of neighbouring masonry panels.

12. The frame according to claim 1, wherein two jointing plates are provided at an end, the end being defined along a channel direction of each frame.

13. The frame according to claim 1, wherein the jointing plate or plates form part of a soffit panel, the soffit panel comprising an extension away from one end of the jointing plate or plates such that the soffit panel has a generally L shaped cross-sectional form, wherein the extension comprises one or more frames, either attached thereto or as the form of the extension, so as to form a soffit when masonry slips are engaged therewith.

14. The frame according to claim 1, wherein the first lip on at least one of the one or more frames extends from a first end of the frame to a position inward of the other, second end of the frame, such that the remainder of the frame extends beyond the second end of the first lip, optionally wherein every alternate frame comprises the shorter first lip at the same side of the masonry panel, further optionally conjoined to a second masonry panel by a corner jointing plate, wherein the corner jointing plate comprises two elongate sections at an angle with respect to each other when viewed along their longitudinal axes, and the rear side of the first masonry panel, which is the side opposite the channel, is connected to a first of the elongate sections and the rear side of the second masonry panel is connected to the second of the elongate sections to thereby form a corner, further optionally, wherein the ends of the first and second masonry panels at which the second ends of the frames are located are connected to the corner jointing plate, and wherein further the frames with the shorter first lips on the first masonry panel do not align with the frames with the shorter first lips on the second masonry panel, further optionally further comprising one or more angled masonry slips which comprise a first portion and a second portion at an angle to the first portion, the angle between the first and second portions being the same as the angle between the first and second masonry panels, wherein the first portion is the same size as the masonry slips and the second portion is half the size of the masonry slips and each portion has slots on two sides thereof, wherein each of the angled masonry slips is located such that the slots of the first portion contain the first and second lip, respectively, of a first frame on a first of the masonry panels, and one of the slots on the second portion contains the second lip of a second frame on the other of the masonry panels and the first lip of second frame does not extend to the second extension of the angled masonry slip; further optionally wherein the corner jointing plate forms part of a corner soffit panel, the corner soffit panel comprising an extension from one end of the corner jointing plate, the extension comprising one or more frames, either attached thereto or as the form of the extension, so as to form a corner soffit when masonry slips are engaged therewith;

further optionally further comprising a soffit rail for holding one or more soffit masonry slips, the soffit rail comprising:

an elongate channel structure comprising a back plate with two extensions extending away from the back plate, to thereby form the channel, a first of the extensions having a lip extending from a distal edge so as to engage with a first slot on the one or more soffit masonry slips, the lip of the first extension having a straight portion which extends substantially parallel to the back plate and an angled end portion at the end of the straight portion which projects in the direction away from the back plate, thereby making an angle with the straight portion, the second of the extensions having a straight portion which extends substantially parallel to the first extension and an angled end portion at the end of the straight portion which projects in the direction away from the first extension, thereby making an angle with the straight portion, and will engage with a second slot on the soffit masonry slip, optionally wherein one soffit rail is located on the jointing plate and a second soffit rail is located on the extension either side of the join there-between and the soffit masonry slips comprise four slots therein such that each soffit masonry slip engages with each of the lips and second extensions of the soffit rails, one within each slot.

15. The frame according to claim 1, wherein a first of the two lips has a straight portion which extends substantially parallel to the back plate and an angled end portion at the end of the straight portion which projects in a direction away from the back plate, thereby making an angle with the straight portion; or comprising one or more masonry slips, the one or more masonry slips each having two slots formed on two sides thereof, a first of the two lips on each frame and a second of the two lips on each frame respectively engaged with one of the slots on each of the one or more masonry slips.

16. The frame according to claim 1, wherein each of the extensions on the frame is connected with the back plate via respective angled sections, such that the two extensions extend away from the back plate at locations offset from either elongate edge of the back plate, optionally wherein the two angled sections extend parallel with each other such that when two frames are positioned in a side-by-side arrangement with their channels lying parallel and their back plates in abutment with each other, the flange formed by one angled section on a first frame will fit within the void formed be the angled section on a second, adjacent, frame.

17. The frame according to claim 1, wherein each of the frames comprise one or more stiffening folds in the back plate running along the longitudinal direction of the frame or soffit rail.

18. The frame according to claim 1, wherein the first of the two lips defines one or more holes therethrough wherein the one or more holes are optionally in a straight portion of the first of the two lips, optionally defining at least two holes therethrough wherein the spacing between adjacent holes is less than one half of the length of a masonry slip, the length of the masonry slip being taken along the direction of the slot therein.

19. The frame according to claim 1, wherein the frames comprise one or more drainage holes extending through the frame at or near an intersection of a back plate or back plane, respectively, with one or both of the extensions, optionally wherein the one or more drainage holes are positioned at or near the intersection located at the lower side of the frame when the frame is in use.

20. The frame of claim 1, wherein the first of the two lips and the second of the two lips extend towards one another.

* * * * *